US011585181B2

(12) United States Patent
Sabatier

(10) Patent No.: US 11,585,181 B2
(45) Date of Patent: Feb. 21, 2023

(54) MODULAR HEAD FOR WELL TUBULARS

(71) Applicant: 2170775 ALBERTA LTD., Bonnyville (CA)

(72) Inventor: Clint Roger Sabatier, Bonnyville (CA)

(73) Assignee: 2170775 Alberta Ltd., Bonnyville (CA)

( * ) Notice: Subject to any disclaimer, the term of this patent is extended or adjusted under 35 U.S.C. 154(b) by 45 days.

(21) Appl. No.: 17/058,576

(22) PCT Filed: May 24, 2019

(86) PCT No.: PCT/CA2019/050709
§ 371 (c)(1),
(2) Date: Nov. 24, 2020

(87) PCT Pub. No.: WO2019/222857
PCT Pub. Date: Nov. 28, 2019

(65) Prior Publication Data

US 2021/0238944 A1 Aug. 5, 2021

Related U.S. Application Data

(60) Provisional application No. 62/726,701, filed on Sep. 4, 2018, provisional application No. 62/676,739, filed on May 25, 2018.

(51) Int. Cl.
*E21B 33/04* (2006.01)
*E21B 19/16* (2006.01)
(Continued)

(52) U.S. Cl.
CPC ..... *E21B 33/04* (2013.01); *E21B 19/161* (2013.01); *E21B 19/22* (2013.01);
(Continued)

(58) Field of Classification Search
CPC ..... E21B 33/03; E21B 33/04; E21B 33/0415
See application file for complete search history.

(56) References Cited

U.S. PATENT DOCUMENTS 1,875,632 A * 9/1932 McEvoy ..... E21B 33/04 277/343
1,888,637 A * 11/1932 Rockwell ..... E21B 33/06 285/123.1
(Continued)

FOREIGN PATENT DOCUMENTS

CA 1011649 A 6/1977
CA 2268223 C 2/2000
(Continued)

OTHER PUBLICATIONS

Drilling and Completions Committee (DACC), Enform Canada, May 2012, vol. 5, pp. 3-45, Retrieved from the Internet: [http://www.energysafetycanada.com/files/pdf/publications/irp05final2012.pdf].
(Continued)

*Primary Examiner* — Giovanna Wright
(74) *Attorney, Agent, or Firm* — Dority & Manning, P.A.

(57) ABSTRACT

A head for a well tubular. The well tubular head includes features that may be applied to a casing head or a tubing head. The well tubular head includes a bowl tubular reversibly connected with a casing connector. The bowl tubular is adapted for connecting with an uphole component of an equipment stack or other system. The bowl tubular includes a hanger profile for receiving a casing hanger or tubing hanger. The casing connector is adapted for connecting with the casing. The bowl tubular and the casing connector may be replaced independently of each other. Removable connection points for flow lines may be included on the well tubular head to facilitate changing flow lines or flow line connection points. The bowl tubular may include a drive system for rotating tubing.

31 Claims, 34 Drawing Sheets

(51) Int. Cl.
*E21B 19/22* (2006.01)
*E21B 33/068* (2006.01)
*E21B 33/06* (2006.01)

(52) U.S. Cl.
CPC ..... *E21B 33/0415* (2013.01); *E21B 33/068* (2013.01); *E21B 33/062* (2013.01)

(56) References Cited

U.S. PATENT DOCUMENTS

| | | | | |
|---|---|---|---|---|
| 1,914,380 | A | 6/1933 | Milton | |
| RE19,587 | E * | 5/1935 | Archer | E21B 33/04 285/123.6 |
| 2,016,454 | A * | 10/1935 | Penick | E21B 33/04 285/123.3 |
| 2,185,478 | A * | 1/1940 | Tschappat | E21B 33/04 285/123.6 |
| 2,715,536 | A | 8/1955 | Shuptrine et al. | |
| 4,526,243 | A * | 7/1985 | Young | E21B 33/085 285/414 |
| 5,515,925 | A | 5/1996 | Boychuk et al. | |
| 6,019,175 | A * | 2/2000 | Haynes | E21B 33/04 166/334.1 |
| 6,315,046 | B1 | 11/2001 | Jack et al. | |
| 6,834,717 | B2 | 12/2004 | Bland | |
| 7,395,867 | B2 | 7/2008 | McGuire et al. | |
| 7,493,960 | B2 | 2/2009 | Leising et al. | |
| 9,291,023 | B2 | 3/2016 | McGilvray, Jr. et al. | |
| 9,689,229 | B2 | 6/2017 | Hanson et al. | |
| 2002/0140184 | A1 * | 10/2002 | Janoff | F16J 15/0887 277/644 |
| 2003/0024709 | A1 | 2/2003 | Cuppen | |
| 2004/0065434 | A1 | 4/2004 | Bland | |
| 2007/0107910 | A1 | 5/2007 | McGuire et al. | |
| 2012/0056413 | A1 * | 3/2012 | Nguyen | E21B 33/0422 285/31 |
| 2012/0085552 | A1 * | 4/2012 | Travis | E21B 33/0415 166/382 |
| 2013/0181147 | A1 * | 7/2013 | Wright | E21B 33/061 251/1.3 |
| 2017/0232794 | A1 * | 8/2017 | Abrahamson | B60B 35/12 301/137 |
| 2017/0342793 | A1 * | 11/2017 | Wesson | E21B 33/04 |
| 2018/0038186 | A1 | 2/2018 | Ross et al. | |
| 2018/0100369 | A1 * | 4/2018 | Perkins | E21B 33/04 |

FOREIGN PATENT DOCUMENTS

| | | | |
|---|---|---|---|
| CA | 2355555 | | 1/2003 |
| CA | 2355555 | A1 | 1/2003 |
| CA | 2428613 | C | 10/2005 |
| CA | 2457217 | C | 12/2010 |
| CA | 2771199 | | 3/2011 |
| CA | 2771199 | A1 | 3/2011 |
| CA | 2747140 | C | 9/2012 |
| CA | 2947572 | A1 | 11/2015 |
| WO | 2015168454 | A1 | 11/2015 |

OTHER PUBLICATIONS

Gulf Cooperation Council Patent Application No. GC201937632, Office Action dated Jul. 5, 2020.

International Patent Application No. PCT/CA2019/050709, International Search Report and Written Opinion dated Aug. 22, 2019.

International Patent Application No. PCT/CA2019/050709, International Preliminary Report on Patentability dated Sep. 22, 2020.

"Minimum Wellhead Requirements an Industry Recommended Practice (IRP) for the Canadian Oil and Gas Industry," Drilling and Completions Committee (DACC), Nov. 2011, vol. 5, XP055657491.

Drilling and Completions Committee (DACC), "Minimum Wellhead Requirements an Industry Recommended Practice (IRP) for the Canadian Oil and Gas industry", Enform Canada, May 2012 (May 2012), pp. 3-45 and 81-95, vol. 5, retrieved from the Internet, http://www.energysafetycanada.com/files/pdf/publications/irp05final2012.pdf.

Patent Office of the Cooperation Council for the Arab States of the Gulf, Application No. GC201937632, Office Action dated Dec. 22, 2020.

* cited by examiner

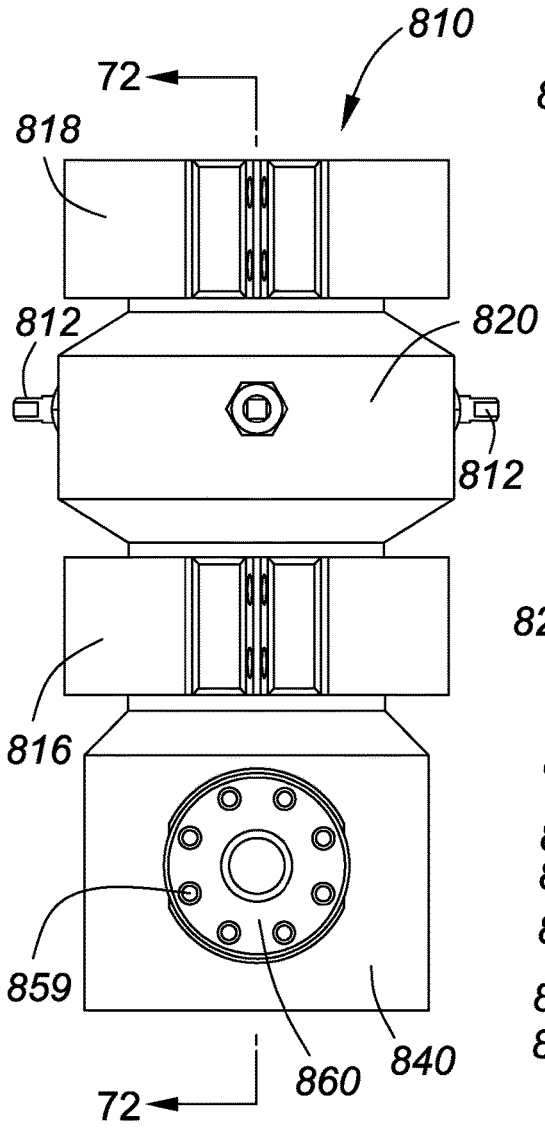
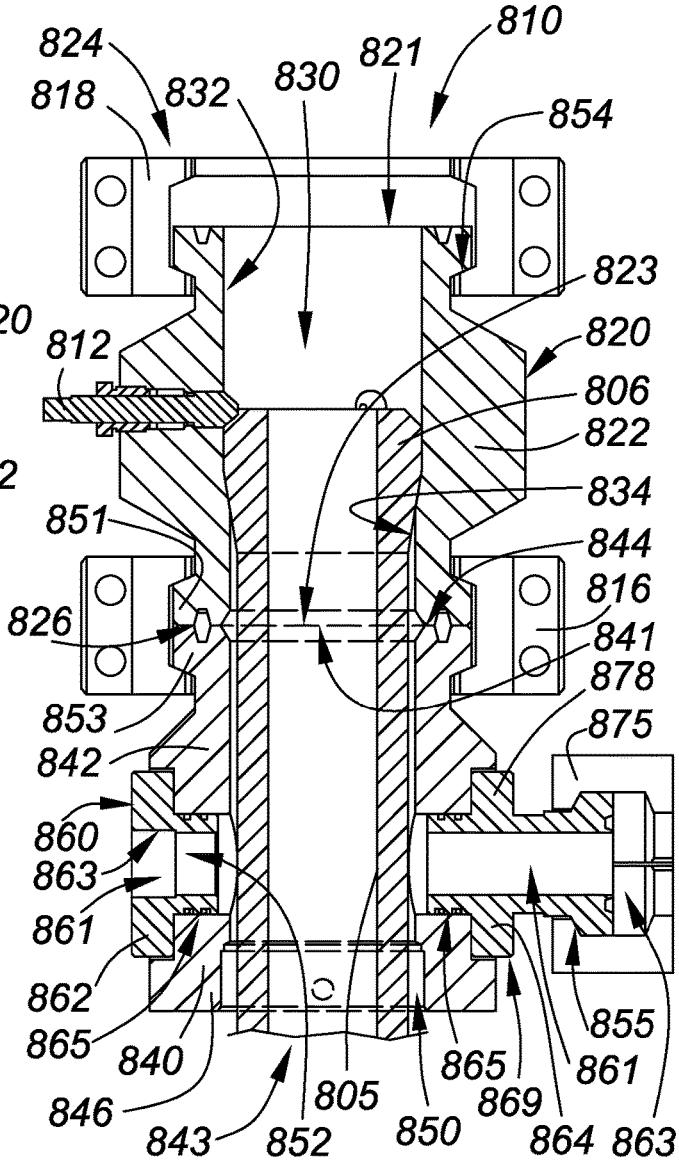
FIG. 71
FIG. 72

MODULAR HEAD FOR WELL TUBULARS

CROSS REFERENCE TO RELATED APPLICATIONS

This application claims the benefit of priority of U.S. Provisional Patent Application No. 62/676,739, entitled MODULAR HEAD FOR WELL TUBULARS, filed May 25, 2018, and of U.S. Provisional Patent Application No. 62/726,701, entitled MODULAR HEAD FOR WELL TUBULARS, filed Sep. 4, 2018, which are each hereby incorporated by reference in its entirety.

FIELD

The present disclosure relates to casing and tubing heads for production from a well.

BACKGROUND

Casing heads and tubing heads connect uphole equipment to the casing of a well.

The online Schlumberger Oilfield Glossary defines "casing head" in the implicit context of pressurized wells as "The adapter between the first casing string and either the blowout preventer stack (during drilling) or the wellhead (after completion). This adapter may be threaded or welded onto the casing, and may have a flanged or clamped connection to match the blowout preventer stack or wellhead."

The online Schlumberger Oilfield Glossary defines "tubing head" as "A wellhead component that supports the tubing hanger and provides a means of attaching the Christmas tree to the wellhead."

Casing heads and tubing heads are distinct well components, but share many structural features. Each of these two types of tool includes a connection point for casing downhole of the casing or tubing head. Each of these two types of tool includes a connection point for equipment uphole of the casing or tubing head. Each of these two types of tool includes a bowl profile for receiving a hanger. A casing head is profiled to receive a casing hanger or a pair of slips for supporting additional casing in the well prior to and following cementing. A tubing head receives a tubing hanger for supporting a production tubing string.

SUMMARY

Herein provided is a modular head for well tubulars. The modular head connects with casing on a well and receives a hanger for hanging a tubular into the well. The modular head may be designed as a casing head for receiving and supporting casing or as a tubing head for receiving and hanging tubing. The modular head includes a bowl tubular reversibly connected with a casing connector. The bowl tubular is flanged or otherwise adapted for connecting with a wellhead during production, or with a blowout preventer, Christmas tree or other pressure rated equipment connected with the wellhead during servicing, production or drilling. A hanger profile is defined within the bowl tubular for receiving a tubing hanger or a casing hanger. The casing connector includes a weld surface for welding to the casing or is otherwise adapted to connect with the casing. The bowl tubular and the casing connector are reversibly connected with each other for replacing the bowl tubular or the casing connector independently of the other. A channel is defined through the modular head, including through the bowl tubular and the casing connector, providing a flow path for fluid communication between an uphole component connected with the bowl tubular and casing connected with the casing connector.

Removable flow line connectors may be provided in the well tubular head for providing fluid communication between flow lines and the channel within the well tubular head. Flow line connectors may be defined in the bowl tubular, the casing connector or an adaptor tubular (see below). Flow lines, valves, pressure gauges or any suitable equipment may be connected with the casing head at the flow line connection points by a ring plug, ring flange or other removable connection point to facilitate changing flow lines or flow line connection points in the event of damage to the flow lines or to the flow line connection points, or in the face of other motivation to change the flow line or the flow line connection.

The bowl tubular may be disconnected from the uphole component and from the casing connector, and replaced for the benefit of a particular well on which the modular head is attached. In some examples a bowl tubular may be replaced to provide, remove, replace or change a profiles, gripping surface, tubing rotator function or other aspect of the bowl tubular. The bowl tubular may be replaced because of damage or any other operational reason, and may be replaced a with a seal plug.

The casing connector tubular may be disconnected from the bowl tubular and from the casing, and replaced for the benefit of a particular well on which the modular head is attached. In some examples, the casing connector may be replaced when a casing connector has been damaged, a change in weld size is required, a change in the threading that connects with the bowl tubular is required or there is otherwise motivation to replace the casing connector.

The bowl tubular may be connected with the casing connector through an adaptor tubular. The bowl tubular, the adaptor tubular or the casing connector may include an extended gripping surface for gripping the modular head during connection of the bowl tubular with an uphole component, the bowl tubular with the casing connector, the bowl tubular with the adaptor tubular, the adaptor tubular with the casing connector, or the modular head with the casing. Similarly, an extended gripping surface may facilitate disconnecting where the modular head is threadedly connected with the casing.

The bowl tubular includes the hanger profile for hanging the tubular. A bowl tubular designed for tubing may include a worm shaft, a cog and bearing system, or other drive system for providing the functionality of a tubing rotator.

The bowl tubular and the casing connector, and where applicable the adaptor tubular and either or both of the bowl tubular and casing connector, may be connected through threaded connections, connection hub, or any suitable connection mechanism that will hold the components of the modular well tubular head. Set screws may be applied to further secure the bowl tubular with the casing connector, and where applicable the adaptor tubular and either or both of the bowl tubular and casing connector.

Coiled tubing inputs ports for providing access to the channel by coiled tubing may also be included in the well tubular head. The coiled tubing input ports may be defined in one or more of the bowl tubular, the casing connector or the adaptor tubular.

A flow line connector is provided herein. The flow line connector is flanged or otherwise adapted to be included in uphole equipment to provide connection points for the flow lines in uphole equipment. The flow lines may be connected with the flow line connector by an adaptor tubular, ring flange or other removable connection point to facilitate adding, removing (and replacing the flow line or flow line connection point with a plug), replacing or changing the flow lines or the removable connection points on the casing head if the flow lines are damaged.

The flow line connector may be a spool included as an uphole component of an uphole equipment stack or other system of uphole tools or other equipment. The flow line connector may be integrated into a tubing head, casing head, tubing rotator, blowout preventer, or other uphole component. The modular well tubular head may include the flow line connection points and thus also serve as a flow line connector. A flow line connector may also include a unitary body tubing head, unitary body casing head, unitary body tubing rotator, blowout preventer or other uphole component used in an uphole equipment stack or other uphole equipment system to provide, remove, replace or change features or functionality of the flow line connector and its role in the uphole equipment stack or other system of uphole tools or other equipment.

In a first aspect, herein provided is a head for a well tubular. The well tubular head includes features that may be applied to a casing head or a tubing head. The well tubular head includes a bowl tubular reversibly connected with a casing connector. The bowl tubular is adapted for connecting with an uphole component of an equipment stack or other system. The bowl tubular includes a hanger profile for receiving a casing hanger or tubing hanger. The casing connector is adapted for connecting with the casing. The bowl tubular and the casing connector may be replaced independently of each other. Removable connection points for flow lines may be included on the well tubular head to facilitate changing flow lines or flow line connection points. The bowl tubular may include a drive system for rotating tubing.

In a further aspect, herein provided is a modular well tubular head comprising: a bowl tubular for connecting with an uphole component; and a casing connector for reversibly connecting with the bowl tubular and for sealingly connecting with casing. The bowl tubular comprises a bowl body, an uphole component connection point on the bowl body for connecting with the uphole component, a first modular connection point on the bowl body for reversibly connecting with the casing connector, and a hanger profile defined on an inside surface of the bowl body. The casing connector comprises a connector body, a casing connection point on the connector body for sealingly connecting with the casing, and a second modular connection point on the connector body for reversibly connecting with the bowl body. The casing connector does not include a hanger profile defined on an inside surface of the casing connector. A flow path is defined through the connector body and the bowl body.

In some embodiments, the well tubular head includes a bowl tubular extended gripping surface on the bowl body for gripping with power tongs. In some embodiments, the well tubular head includes a bowl tubular port defined in the bowl body for providing fluid communication between the flow path and a flow line. In some embodiments, the well tubular head includes a removable connection point connected with the bowl body at the bowl tubular port. In some embodiments, the well tubular head includes a bowl tubular access port defined in the bowl body for establishing fluid communication between the flow path and coiled tubing. In some embodiments, the well tubular head includes a casing connector extended gripping surface on the connector body for gripping with power tongs. In some embodiments, the well tubular head includes a casing connector port defined in the connector body for providing fluid communication between the flow path and a flow line. In some embodiments, the well tubular head includes a removable connection point connected with the casing body at the casing connector port. In some embodiments, the well tubular head includes a casing connector access port defined in the connector body for establishing fluid communication between the flow path and coiled tubing. In some embodiments, the well tubular head includes an adaptor tubular connected with the bowl body and with the connector body, and the flow path is further defined through the adaptor tubular. In some embodiments, the well tubular head includes an adaptor tubular extended gripping surface on the adaptor tubular for gripping with power tongs. In some embodiments, the well tubular head includes an adaptor port defined in the adaptor tubular for providing fluid communication between the flow path and a flow line. In some embodiments, the well tubular head includes a removable connection point connected with the adaptor tubular at the adaptor port. In some embodiments, the well tubular head includes an adaptor access port defined in the adaptor tubular for establishing fluid communication between the flow path and coiled tubing. In some embodiments, the hanger profile is configured to support a tubing hanger and tubing string. In some embodiments, the well tubular head includes a rotation drive connected with the bowl body for rotating a tubing string hanging on the hanger profile. In some embodiments, the hanger profile is configured to support a casing hanger and casing string. In some embodiments, the flow path has a uniform inside diameter through the connector body. In some embodiments, an inside diameter of the flow path within the connector body is equal to an inside diameter of the casing.

In a further aspect, herein provided is a method of establishing fluid communication with a well including casing, the method comprising: sealingly securing a casing connector to the casing, the casing connector lacking a hanger profile defined on an inside surface of the casing connector; reversibly connecting a bowl tubular having a hanger profile with the casing connector, providing a flow path from the casing, through the casing connector and through the bowl tubular; and receiving a string through the casing connector and the bowl tubular, the string having a hanger profiled to match the hanger profile. The casing connector does not include a hanger profile defined on an inside surface of the casing connector In some embodiments, the method includes securing a flow line with the bowl tubular. In some embodiments, the method includes securing a flow line with the casing connector. In some embodiments, the method includes replacing a removable connection point for the flow line. In some embodiments, replacing the removable connection point comprises replacing the removable connection point with a replacement removable connection point, and the replacement removable connection point has a flow path diameter or other property that differs from the corresponding flow path diameter or other property of the removable connection point. In some embodiments, the method includes replacing the bowl tubular. In some embodiments, replacing the bowl tubular comprises replacing the bowl tubular with a replacement bowl tubular, and the replacement bowl tubular has a flow path diameter, hanger profile or other feature that differs from the corresponding flow path diameter, hanger profile or other property of the bowl tubular. In some embodiments, replacing the bowl tubular comprises replacing the bowl tubular with a seal plug. In some embodiments, the method includes replacing the casing connector. In some embodiments, replacing the casing connector comprises replacing the casing connector with a replacement casing connector, and the replacement casing connector has a weld size, flow path diameter or other feature that differs from the corresponding weld size, flow path diameter or other feature of the casing connector. In some embodiments, securing the casing connector to the casing comprises connecting the casing connector to the wellhead free while the bowl tubular is connected with the casing connector. In some embodiments, securing the casing connector to the casing comprises connecting the casing connector to the wellhead free of obstruction from the bowl tubular. In some embodiments, the method includes establishing fluid communication between the well and a first coiled tubing string. In some embodiments, establishing fluid communication between the well and the first coiled tubing string comprises running the first coiled tubing string through a port in the bowl tubular. In some embodiments, the string comprises a tubing string and establishing fluid communication between the well and the first coiled tubing string comprises running the first coiled tubing string into the tubing string. In some embodiments, the method includes establishing fluid communication between the well and a second coiled tubing string by running the second coiled tubing string through a port in the casing connector. In some embodiments, establishing fluid communication between the well and the first coiled tubing string comprises running the first coiled tubing string through a port in the bowl tubular. In some embodiments, the string comprises a casing string. In some embodiments, the string comprises a tubing string. In some embodiments, the bowl tubular comprises a rotation drive for rotating the tubing string. In some embodiments, the method includes replacing the bowl tubular with a bowl tubular including a rotation drive for rotating the tubing string. In some embodiments, the method includes replacing the rotation drive. In some embodiments, the method includes replacing a removable connection point for the adaptor tubular flow line. In some embodiments, replacing the removable connection point comprises replacing the removable connection point with a replacement removable connection point, and the replacement removable connection point has a flow path diameter or other property that differs from the corresponding flow path diameter or other property of the removable connection point. In some embodiments, the method includes running an adaptor coiled tubing string through a port in the adaptor tubular for establishing fluid communication between the well and the adaptor coiled tubing string. In some embodiments, the string comprises a tubing string, and establishing fluid communication between the well and the adaptor coiled tubing string comprises running the adaptor coiled tubing string into the tubing string. In some embodiments, the flow path has a uniform inside diameter through the casing connector. In some embodiments, the inside diameter of the casing connector has an inside diameter equal to an inside diameter of the casing.

In a further aspect, herein provided is a bowl tubular for connecting with an uphole component, the bowl tubular comprising: a bowl body; an uphole component connection point on the bowl body for connecting with an uphole component; a modular connection point on the bowl body for reversibly connecting with a casing connector that is for sealingly connecting with casing, providing a modular well tubular head; a flow path defined through the bowl body; and a hanger profile defined on an inside surface of the bowl body within the flow path.

In some embodiments, the bowl tubular includes an extended gripping surface on the bowl body for gripping with power tongs. In some embodiments, the bowl tubular includes a port defined in the bowl body for providing fluid communication between the flow path and a flow line. In some embodiments, a removable connection point connected with the bowl body at the port.

In a further aspect, herein provided is a casing connector for sealingly connecting with casing, the casing connector comprising: a connector body; a casing connection point on the connector body for connecting with the casing; a modular connection point on the connector body for reversibly connecting with a bowl body, providing a modular well tubular head; and a flow path defined through the connector body. The casing connector does not include a hanger profile defined on an inside surface of the casing connector.

In some embodiments, the casing connector includes an extended gripping surface on the connector body for gripping with power tongs. In some embodiments, the casing connector includes a port defined in the connector body for providing fluid communication between the flow path and a flow line. In some embodiments, the casing connector includes a removable connection point connected with the casing body at the port. In some embodiments, the casing connector includes an access port defined in the connector body for establishing fluid communication between the flow path and coiled tubing. In some embodiments, the flow path has a uniform inside diameter through the connector body. In some embodiments, an inside diameter of the flow path within the connector body is equal to an inside diameter of the casing.

In a further aspect, herein provided is a well tubular head comprising: a seal plug; and a casing connector for connecting the seal plug and with casing. The seal plug comprises a seal plug body and a first modular connection point on the seal plug body for connecting with the casing connector. The casing connector comprises a connector body, a casing connection point on the connector body for connecting with casing, and a second modular connection point on the seal plug body for connecting with the seal plug. A flow path is defined through the connector body.

In some embodiments, the seal plug body further comprises an engagement point for manipulating the seal plug body for securing the seal plug body with the casing connector or with an uphole component. In some embodiments, the casing connector includes an extended gripping surface on the connector body for gripping with power tongs. In some embodiments, the casing connector includes a port defined in the connector body for providing fluid communication between the flow path and a flow line. In some embodiments, the casing connector includes a removable connection point connected with the casing body at the port. In some embodiments, the casing connector includes an access port defined in the connector body for establishing fluid communication between the flow path and coiled tubing. In some embodiments, the bowl tubular includes an adaptor tubular connected with the seal plug body and with the connector body, and wherein the flow path is defined through the adaptor tubular. In some embodiments, adaptor tubular includes an extended gripping surface on the adaptor tubular for gripping with power tongs. In some embodiments, the well tubular head includes an adaptor port defined in the adaptor tubular for providing fluid communication between the flow path and a flow line. In some embodiments, the well tubular head includes a removable connection point connected with the adaptor tubular at the adaptor port. In some embodiments, the well tubular head includes an adaptor access port defined in the adaptor tubular for establishing fluid communication between the flow path and coiled tubing. In some embodiments, the flow path has a uniform inside diameter through the connector body. In some embodiments, an inside diameter of the flow path within the connector body is equal to an inside diameter of the casing.

In a further aspect, herein provided is a modular flow line connector for use in uphole well equipment. The modular flow line connector may be applied to a wellhead, blowout preventer, Christmas tree or other pressure rated equipment during drilling, production, servicing or other activity. The modular flow line connector includes connection points for connecting with an uphole component of an equipment stack or other system. Removable connection points for flow lines on the modular flow line connector facilitate changing flow lines or flow line connection points if the flow lines are damaged or otherwise must be changed. The removable connection points may also allow changing the diameter of the flow lines without removing the modular flow line connector from connection to the uphole components. The removable connection points may be connected with a tubing bowl, casing bowl, tubing rotator, blowout preventer, spool or other uphole component.

In a further aspect, herein provided is a flow line connector comprising: a body; a first uphole component connection point on the body; a second uphole component connection point on the body; a flow path defined within the body and through the first connection point and the second connection point; and a removable connection point connected with the body in fluid communication with the flow path for connecting a flow line with the body and establishing fluid communication between the flow line and the flow path.

In some embodiments, the first uphole component connection point and the second uphole component connection point are located at opposed ends of the body. In some embodiments, at least one of the first uphole component connection point and the second uphole component connection point comprises a flanged connection. In some embodiments, the flow line connector includes an integral port defined in the flow line connector for providing fluid communication between the flow path and a flow line. In some embodiments, the flow line connector includes a hanger profile defined on an inside surface of the body for receiving a tubing hanger. In some embodiments, the second uphole component connection point on the body is configured for connecting with casing. In some embodiments, the flow line connector includes a hanger profile defined on an inside surface of the body for receiving a casing hanger. In some embodiments, the flow line connector includes a ram positioned in the body for providing the functionality of a blowout preventer.

In a further aspect, herein provided is a method of establishing fluid communication with between a flow line and uphole component on a well, the method comprising: establishing fluid communication between a removable connection point and the uphole component; and securing a flow line with the removable connection point.

In some embodiments, the method includes replacing the flow line. In some embodiments, the method includes replacing the removable connection point. In some embodiments, replacing the removable connection point comprises replacing the removable connection point with a replacement removable connection point, wherein the replacement removable connection point has a flow path diameter or other property that differs from the corresponding flow path diameter or other property of the removable connection point. In some embodiments, establishing fluid communication between the removable connection point and the uphole component comprises securing the removable connection point to the uphole component. In some embodiments, establishing fluid communication between the removable connection point and the uphole component comprises securing the removable connection point to a flow line connector in fluid communication with the uphole component. In some embodiments, the removable connection point is connected with a unitary tubing hanger. In some embodiments, the removable connection point is connected with a unitary casing hanger. In some embodiments, the removable connection point is connected with a blowout preventer.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached figures, in which reference numerals sharing a common final two digits refer to corresponding features across figures (e.g. bowl tubular 20, 220, 420, 520, 620, 720, 820, 920, 1020, 1120, 1320 or 1420, etc.).

FIG. 71 is an elevation view of the tubing head of FIG. 70;

FIG. 72 is a cross section elevation view of the tubing head of FIG. 70;

DETAILED DESCRIPTION

Figure 1:
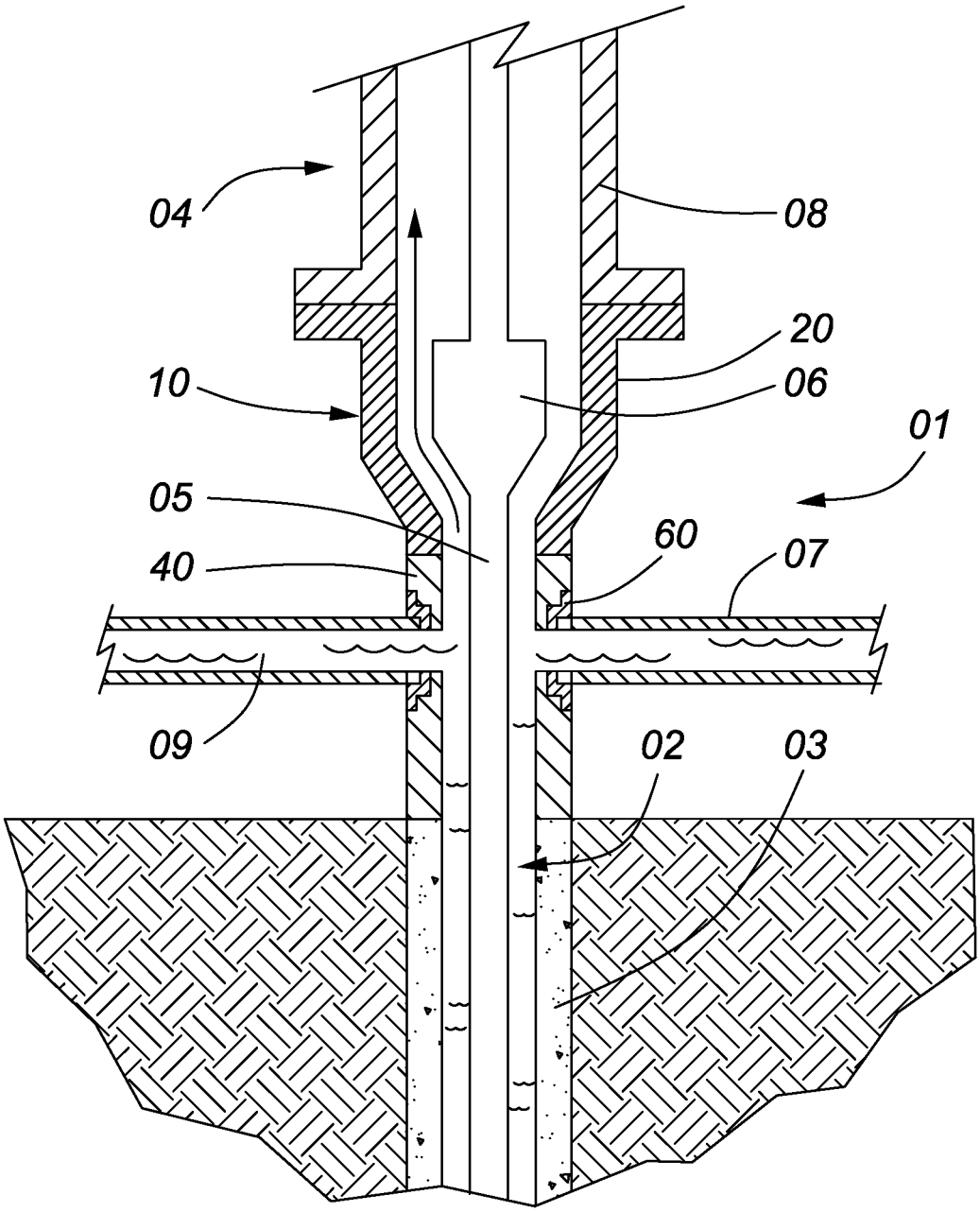
FIG. 1 is a schematic plan view of a tubing head in use on a well.

Heads for well tubulars used when producing hydrocarbons, water or other fluids from cased wells include casing heads and tubing heads. Casing heads and tubing heads are distinct well components but share many structural features. Casing heads and tubing heads each include a connection point for casing downhole of the casing or tubing head. Each of these two types of tool includes a connection point for equipment uphole of the casing or tubing head. Each of these two types of tool includes a bowl profile for receiving a hanger. A casing head is profiled to receive a casing hanger or a pair of slips for supporting additional casing in the well prior to and following cementing. A tubing head is profiled for receiving a tubing hanger for supporting a production tubing string and may include tubing rotator mechanism for rotating the tubing, such as a worm gear, a cog and bearing system, or any suitable mechanism.

When a tubing head requires servicing or repair, a new hanger profile is required, or there is otherwise motivation to replace the or tubing head, a costly and time consuming process is required to cut off the tubing head and weld on a new tubing head. Similarly, when a casing head requires servicing or repair, or must be replaced, a laborious and costly process must be undertaken to change the casing head.

When there is a problem at the wellhead or on other uphole equipment, or a change to needs to be made to well tubular head, whether a casing head or tubing head, then in ordinary circumstances, a normal approach would be to remove and replace the head. The well tubular head may have a leaking ring gasket, leaking lock down pins, a flow line may be damaged or other problems may have occurred with the well tubular head itself. Other changes may be required such as a change in hanger profile, a change in the size of weld, a change in rotation mechanism for a tubing rotator, adding or removing functionality, or sealing a well. The tubing string is pulled by a service rig, and the tubing hanger removed, replaced or otherwise serviced. In view of the shortcomings of previous casing heads and tubing heads, an improved well tubular head is needed.

Herein provided is a well tubular head and a method for using the well tubular head. The well tubular head may be designed as a tubing head or as a casing head, and may be used at various diameters for conventional, unconventional, offshore or any suitable reservoir or well geometry. The well tubular head connects with casing and includes a profile for receiving a tubing or casing hanger.

The well tubular head includes a bowl tubular and a casing connector. The bowl tubular is reversibly connected with the casing connector through any suitable reversible connection (e.g. threaded connection, flanged connection, clamped connection, Greylock clamp connection, Fastlock quick wellhead connectors, BlueSky Bluelock, Vector Techlock clamp connector, j-slot connection, etc.). The bowl tubular includes a profile for hanging a tubing string or casing string, and is connected with for connecting with a blowout preventer, Christmas tree or other pressure-rated equipment connected with the wellhead as applicable for a given tubing string or casing string through any suitable connection, reversible or otherwise (e.g. threaded connection, flanged connection, clamped connection, Greylock clamp connection. Fastlock quick wellhead connectors, BlueSky Bluelock, Vector Techlock clamp connector, j-slot connection, weld surface, etc.). The casing connector includes a weld surface or is otherwise adapted for connection with the casing.

In the event that the bowl tubular is damaged, the profile needs to be changed, tubing rotator functionality is required or is no longer required, a worm gear, cog and bearing system, or other component must be replaced or changed, or there is other motivation to change the bowl tubular, the bowl tubular can be disconnected from the casing connector and replaced without breaking the weld or other connection between the casing connector and the casing. Removing and reconnecting a bowl tubular may be facilitated by the presence of a gripping surface on the bowl tubular or on an adaptor tubular reversibly connected with the bowl tubular and with the casing connector. If the well is to be abandoned or shut in for other reasons, the bowl tubular may be removed and replaced with a plug without breaking the weld or other connection between the casing connector and the casing.

The casing connector may be replaced when a casing connector has been damaged, a change in weld size is required, a change in the threading that connects with the bowl tubular is required or there is otherwise motivation to replace the casing connector.

In a tubing rotator, the bowl tubular may include a worm shaft, cog and bearing system, or other feature under drive for rotating a tubing string hanging in the bowl tubular, providing the functionality of a tubing rotator. The bowl tubular may include a gripping portion to facilitate installation, such as an extended gripping portion for use in connecting the bowl tubular with the casing connector.

An adaptor tubular may be positioned between the bowl tubular and the casting connector, facilitating updating a bowl tubular for changes in the connections between the bowl tubular and the casing connector, changes in the bowl tubular profile or other features, or from damage to one of the adaptor tubular or the bowl tubular.

The bowl tubular and the casing connector, and where applicable the adaptor tubular and either or both of the bowl tubular and casing connector, may be connected through threaded connections, a connection hub, or any suitable connection mechanism that will hold the components of the modular well tubular head.

Set screws may be applied to further secure the bowl tubular with the casing connector, and where applicable the adaptor tubular, and either or both of the bowl tubular and casing connector.

Coiled tubing inputs ports for coiled tubing may also be included in the well tubular head for providing fluid communication between coiled tubing and the channel defined though the well tubular head. The coiled tubing input ports may be included in the bowl tubular, in the casing connector, or both, and where applicable, in the adaptor tubular.

Flow lines connectors may be defined in the well tubular head for providing fluid communication between flow lines and the channel within the well tubular head. Flow line connectors may be defined in the bowl tubular, the casing connector or the adaptor tubular. The flow lines may be connected with the casing head by a flanged plug, ring flange or other removable connection point to facilitate changing flow lines, or flow line connection with the casing head, if the flow lines are damaged or otherwise must be replaced. The removable connection point may be replaced rather than replacing the entire casing connector, bowl tubular or casing head. The flow lines may be connected with the removable connection point by any suitable reversible connection.

In addition to use on the head for well tubulars, the removable connection points may have application in other portions of uphole equipment. Damage to flow lines can also be costly to operation of a well and may stop production. When a flow line is damaged, often the entire tubular that the flow line was connected with must be replaced. To address this shortcoming, a flow line connector is provided herein.

The flow line connector is flanged or otherwise adapted to be included in uphole equipment to provide connection points for the flow lines in uphole equipment. Flanged examples of the flow line connector may be a spool for connection with two uphole components. The flow line connectors includes attachment points for flow lines that may be removed and are more likely to fail than the body of the flow line connector if the flow line connectors are damaged or stressed, as may occur if a flow line is unintentionally struck with a falling object, struck by a vehicle or otherwise damages or stressed. The flow lines may be connected with the flow line connector by a ring flange or other removable connection point to facilitate changing the flow lines or flow line connection points with the casing head in the event that the flow lines are damaged or need to be changed for other reasons. A flow line connector tubular may be included separately from the well tubular hanger. The flow line connector tubular may include connection portions for integrating with other uphole components of an uphole equipment stack, other uphole equipment system or portions of the wellhead.

In addition to connection with a separate flow line connector that is in fluid communication with an uphole component, the removable connection points may be connected directly to an uphole component, or the flow line connector may include features to serve the purpose of the uphole component. The uphole component may include a unitary tubing bowl (i.e. a tubing bowl lacking the modularity of the bowl tubular and the casing connector), a unitary casing bowl (i.e. a casing bowl lacking the modularity of the bowl tubular and the casing connector), a unitary tubing rotator (i.e. a tubing rotator lacking the modularity of the bowl tubular and the casing connector), a blowout preventer, a component connected with the blow out preventer stack, a component of a rod pumping wellhead, a component of an injection wellhead, a flow tee, a component of flowing wellhead a component of a PCP wellhead or any suitable uphole component.

Replacement of the bowl tubular, the casing connector or the removable connection points may be required in the field. Any bowl tubulars or casing connectors that require refurbishing after being removed may be returned to a shop after a replacement added to the wellhead. Refurbishing the bowl tubulars separately from the casing connectors may increase the lifetime of the well tubular hanger as a whole by avoiding refurbishment on a component that is not yet in need of refurbishment. The removable connections points may be made single-use and not subject to refurbishment. Many of the above changes of both the bowl tubular and the casing connector may occur in the context of well workover, intervention, recompletion.

FIG. 1 shows a well site 01 on which a wellbore 02 is located. The wellbore 02 is cased with casing 03. An uphole equipment stack 04, in this case a production rig, is accessing the wellbore 02 for production of hydrocarbons or other fluids though tubing 05. The tubing 05 includes a tubing hanger 06. Fluids are produced from the well flow through the tubing 05 and the tubing hanger 06. Uphole equipment 08 is connected with the tubing hanger 06. The tubing hanger 06 is hanging in a tubing head 10. The tubing head 10 is welded to the casing 03 and connected by a flanged connection to the uphole equipment 08. Flow lines 07 are also connected with the casing head 10. Injected fluid 09 is flowing into the wellbore 02 between the casing 03 and the tubing 05. The injected fluid 09 flows through the casing head 10 and into the flow lines 07.

Figure 2:
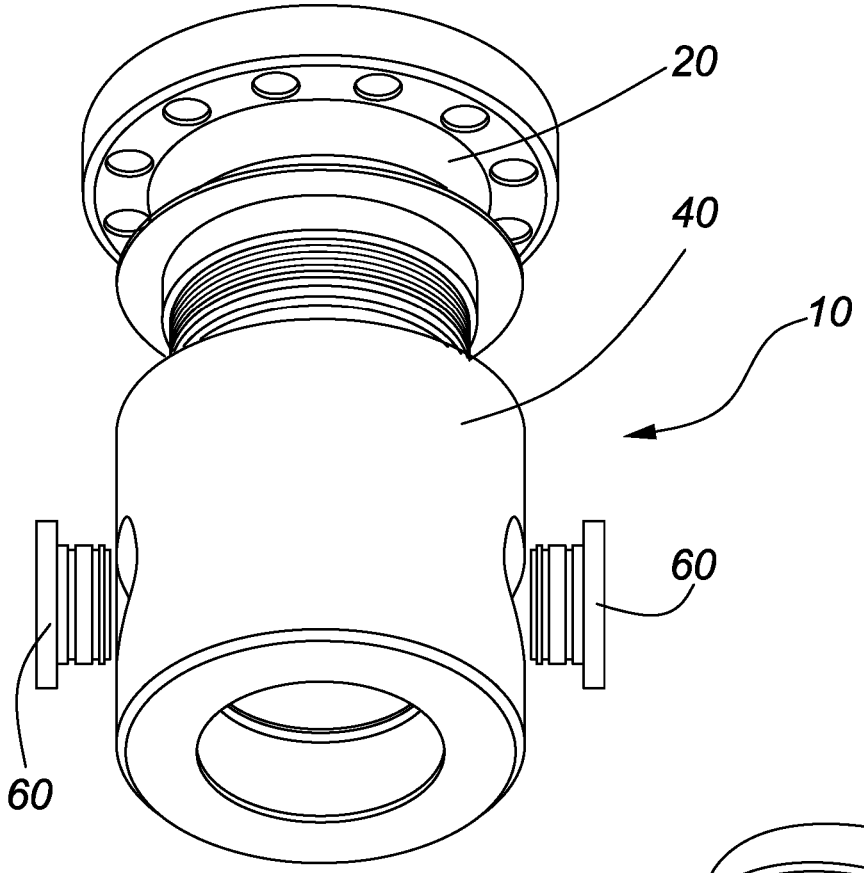
FIG. 2 is a schematic exploded view of the tubing head of FIG. 1.
Figure 3:
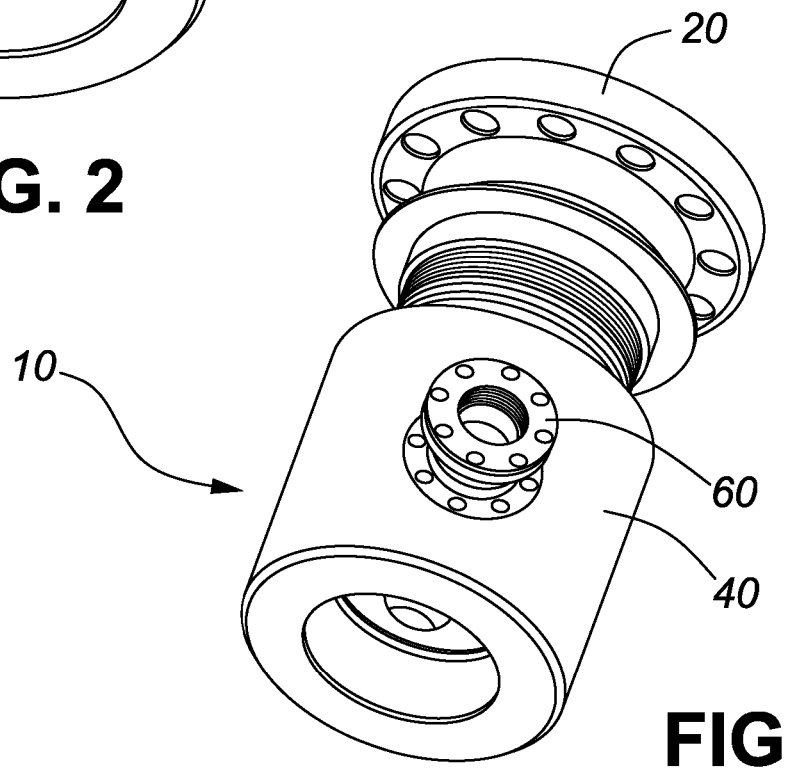
FIG. 3 is a schematic exploded view of the tubing head of FIG. 1.
Figure 4:
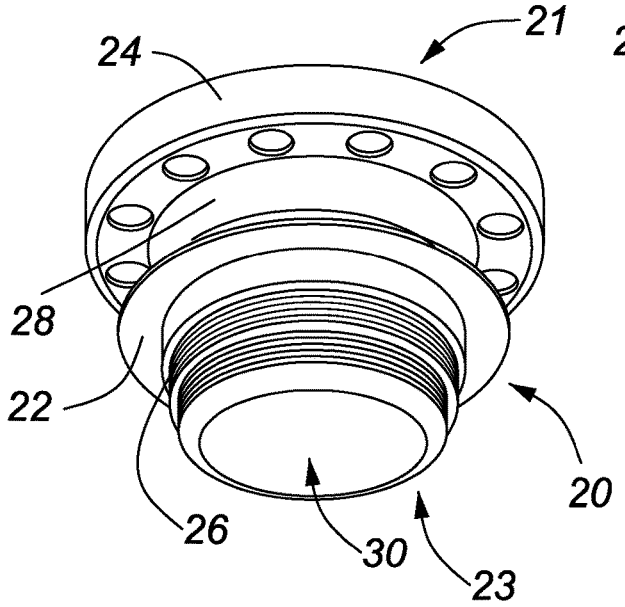
FIG. 4 is an isometric view of a bowl tubular of the tubing head of FIG. 1.
Figure 5:
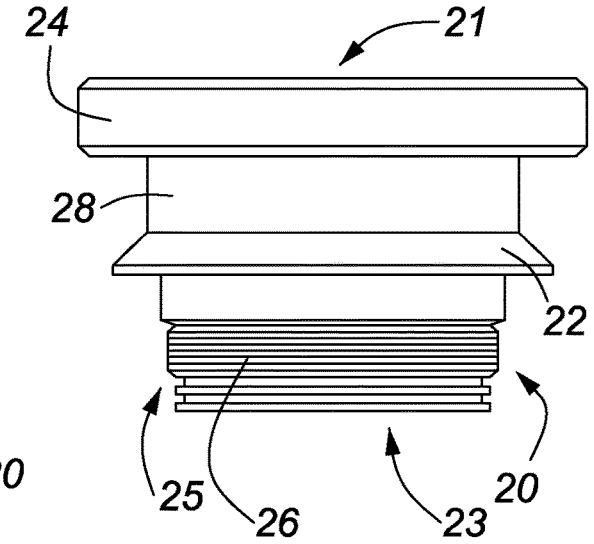
FIG. 5 is an elevation view of the bowl tubular of FIG. 4.
Figure 6:
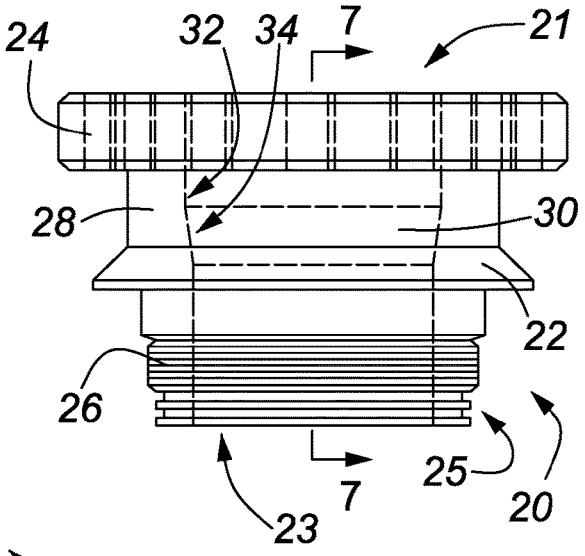
FIG. 6 is an elevation view of the bowl tubular of FIG. 4 showing interior details.
Figure 7:
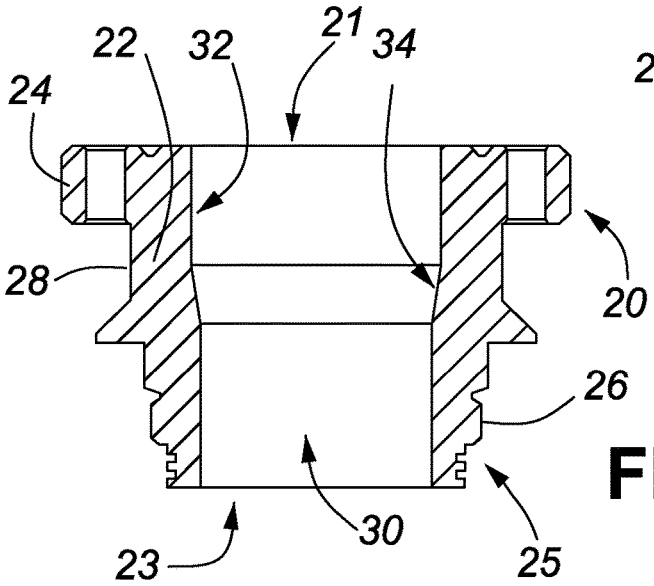
FIG. 7 is a cross section elevation view of the bowl tubular of FIG. 4.
Figure 8:
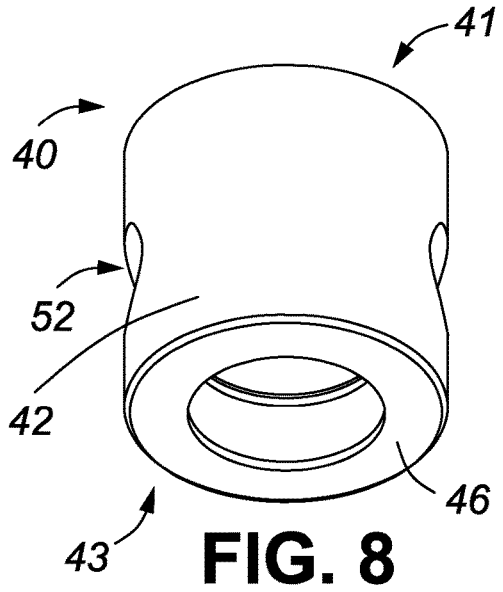
FIG. 8 is an isometric view of a casing connector of the casing head of FIG. 1.
Figure 9:
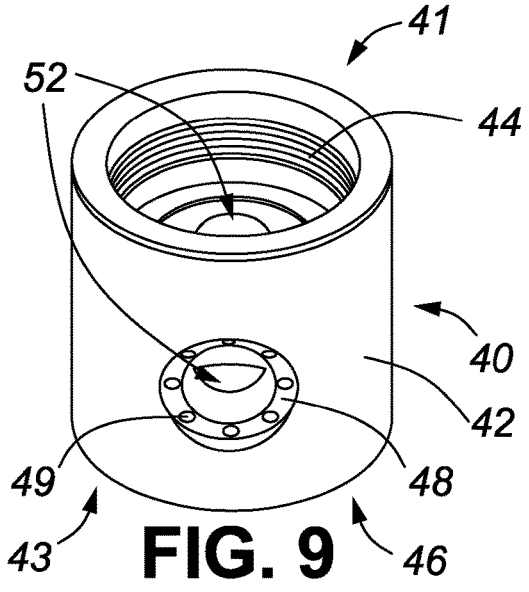
FIG. 9 is an isometric view of the casing connector of FIG. 8.
Figure 10:
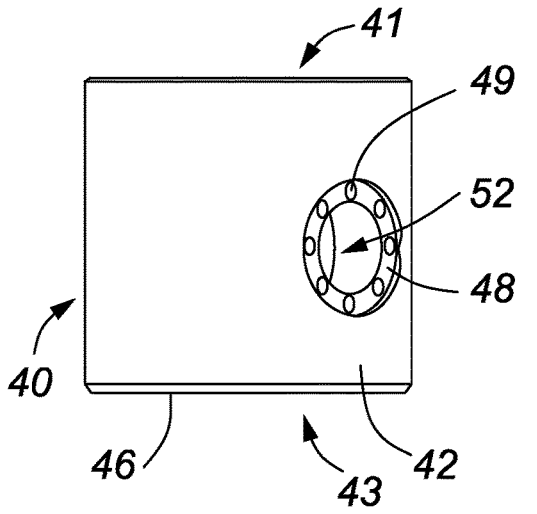
FIG. 10 is an elevation view of the casing connector of FIG. 8.
Figure 11:
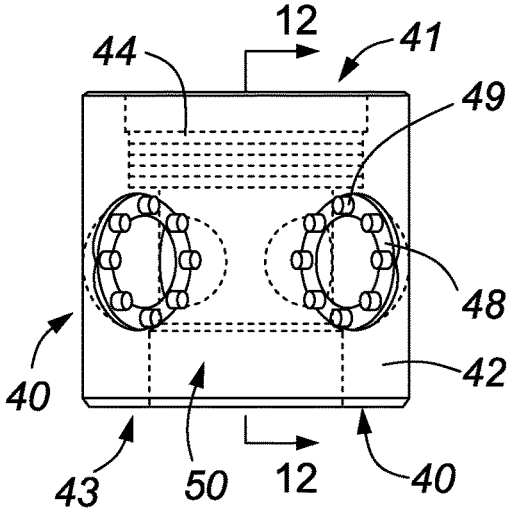
FIG. 11 is an elevation view of the casing connector of FIG. 8 showing interior details.
Figure 12:
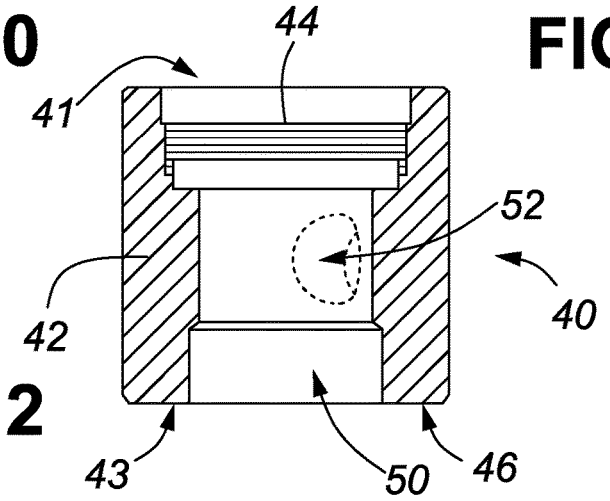
FIG. 12 is a cross section elevation view of a casing connector of FIG. 8.
Figure 13:
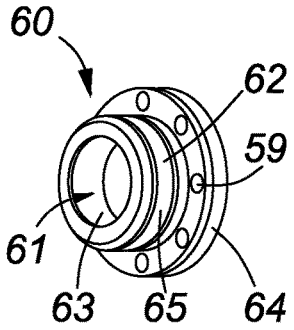
FIG. 13 is an isometric view of an adaptor tubular of the casing head of FIG. 1.
Figure 14:
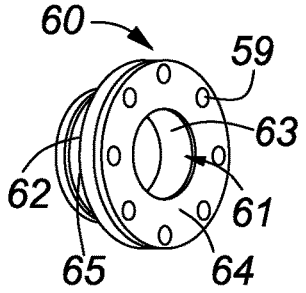
FIG. 14 is an isometric view of the adaptor tubular of FIG. 13.
Figure 15:
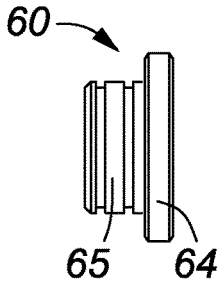
FIG. 15 is an isometric view of the adaptor tubular of FIG. 13.
Figure 16:
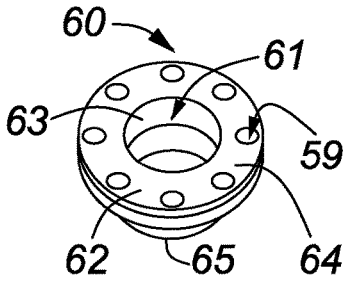
FIG. 16 is an isometric view of the adaptor tubular of FIG. 13.
Figure 17:
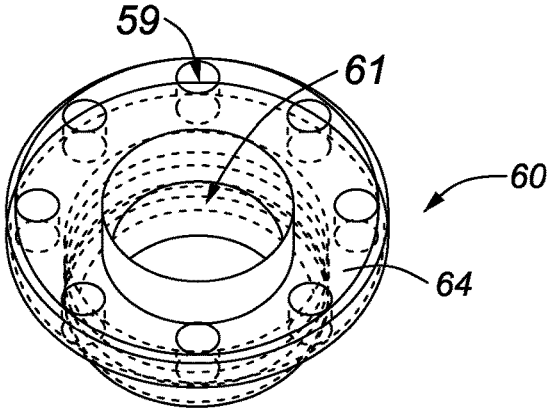
FIG. 17 is an isometric view of the adaptor tubular of FIG. 13.
Figure 18:
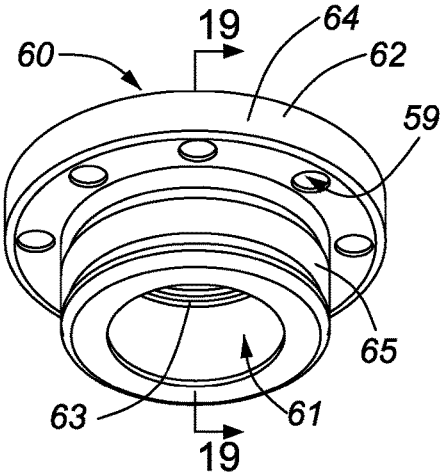
FIG. 18 is an isometric view of the adaptor tubular of FIG. 13 showing interior details.
Figure 19:
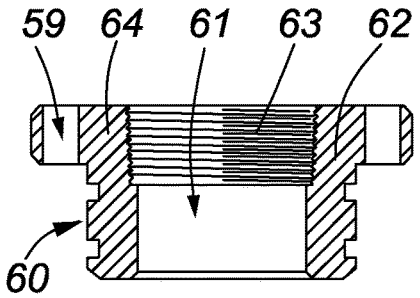
FIG. 19 is a cross section elevation view of the adaptor tubular of FIG. 13.

FIGS. 2 and 3 show exploded views of the tubing head 10. The tubing head 10 includes a bowl tubular 20 that may be connected with a casing connector 40. A pair of flanged plugs 60 are connected with the casing connector 40. By changing the dimensions of the bowl tubular 20, the casing connector 40 and other components of the tubing head 10, a casing head may be designed with the same features as the tubing head 10.

FIGS. 4 to 7 show various views of the bowl tubular 20. The bowl tubular 20 includes a bowl body 22 extending between a first end 21 and a second end 23. An uphole component connection point 24 is located proximate the first end 21 for connecting with a blowout preventer, Christmas tree or other pressure rated equipment connected with the wellhead. The uphole component connection point 24 includes a flange but any suitable connection point may be used. A first modular connection point 26 is located proximate the second end 23 for connecting the bowl tubular 20 to the casing connector 40. The first modular connection point 26 includes a threaded pin end. Any threaded connections or connection points in this disclosure may be any suitable connection point (e.g. 8 threads per inch ("TPI") Acme stub thread, 6 TPI Acme stub thread, 8 TPI Acme stub thread, other Acme threads, other threads, etc.), but any suitable reversible modular connection point may be applied. When the bowl tubular 20 and the casing connector 40 are connected with each other, o-rings may be received within grooves 25, and shear pins may be threadedly connected with the casing connector 40 into grooves 25 defined in the bowl tubular 20 proximate the second end 23. In addition, set screws may be threaded through the casing connector 40 into contact with the bowl tubular 20 to maintain additional connections between the casing connector and the bowl tubular 20.

A gripping portion 28 is defined on the bowl body 22 for manipulating the bowl tubular 20 when connecting the bowl tubular 20 with the casing connector 40. A portion of the gripping portion 28 may overlap with the profile 34. Tubing and casing may have a variety of outer diameter sized, including 2⅜" (6.0325 cm), 2⅞" (7.3025 cm), 3.5" (8.89 cm), 4" (10.16 cm), 4.5" (11.43 cm), 5" (12.7 cm), 5.5" (13.97 cm), 6⅝" (16.8275 cm), 7" (17.78 cm), 7⅝" (19.3675 cm), 7¾" (19.685 cm), 8⅝" (21.9075 cm), 9⅜" (23.8125 cm), 9⅝" (24.4475 cm), 9⅞" (25.0825 cm), 10⅛" (25.7175 cm), 10¾" (27.305 cm), 11¾" (29.845 cm), 11⅞" (30.1625 cm), 13⅜" (33.9725 cm), 13⅝" (34.6075 cm), 14" (35.56 cm), 16" (40.64 cm) and any other sizes. Correspondingly, tongs may have lengths of between 5.5" (13.97 cm) and 24.5" (62.23 cm) including 5.5" (13.97 cm) 7⅝" (19.3675 cm), 9⅝" (24.4475 cm), 11¾" (29.845 cm), 13⅝" (34.6075 cm), 17" (43.18 cm), 20" (50.8 cm), 24.5" (62.23 cm), 24" (60.96 cm) or any suitable size, and the gripping portion 28 may be sized accordingly for the application expected in a given tubing head 10 or casing head.

A channel 30 is defined within the bowl body 22. An inside surface 32 of the bowl body 22 is shaped to define a hanger profile 34 in the bowl body 22. The hanger profile 34 is shaped to receive a well tubular hanger with a matching profile on an outside surface of the well tubular hanger. The channel 30 provides a flow path for fluids passing through the bowl body 22.

FIGS. 8 to 12 show various views of the casing connector 40.

The casing connector 40 includes a connector body 42 extending between a first end 41 and a second end 43. A second modular connection point 44 is located proximate the first end 41 for connecting with the bowl tubular 20. A second modular connection point 44 includes a threaded box end but any suitable reversible connection point may be used. A casing connection point 46 is located proximate the second end 43 for connecting the casing connector 40 to casing. The casing connection point 46 includes a weld surface but any suitable connection point may be used.

A channel 50 is defined within the connector body 42, providing a flow path for fluids around tubing hanging through the casing head 10. The channel 50 provides a flow path for fluids passing through the connector body 42. A pair of ports 52 are defined in the connector body 42 for providing fluid communication between the channel 50 and a flow line connected with the connector body 42. A recessed connection point 48 with a plurality of bolt holes 49 allow flanged connection between the connector body 42 and the flanged plugs 60.

FIGS. 13 to 19 show various views of the flanged plug 60. The flanged plug 60 includes a plug body 62 connected with a flange 64 having a plurality of bolt holes 59. A channel 61 is defined within the plug body 62 for providing fluid communication with the channel 50. The flange 64 connects with the connector body 42 in this example but any suitable reversible connection may be used. A flow line connection point 63 is defined by the plug body 62 within the channel 61. The flow line connection point 63 is a threaded box end in this example but any suitable reversible connection may be used. A sealing point 65 is included on the plug body 62, and includes grooves for holding o-rings to provide a seal between the plug body 62 and an inside surface of the connector body 42 at the port 52.

In operation, as shown in FIG. 1, the tubing head 10 is connected with the casing 03, the flow lines 07 and the blowout preventer 08. The casing connector 40 is connected with the casing 03 at the casing connection point 46. The bowl tubular 20 is connected with the blowout preventer 08 at the uphole component connection point 24. The flow lines 07 are connected with the flanged plugs 60 at the flow line connection points 63. During some types of well servicing or production methods, fluids 09 are injected into the wellbore 02 through the flow lines 07 and the casing connector 40, or are circulated through the flow lines 07 and the wellbore 02 during drilling or servicing.

When connecting the bowl tubular 20 to the casing connector 40, the first modular connection point 26 is engaged with the second modular connection point 44. Where the first modular connection point 26 and the second modular connection point 44 define a threaded box/pin combination, the bowl tubular 20 and the casing connector 40 may be rotatably engaged with each other until the bowl tubular 20 begins to back off from the casing connector 40. A metal-to-metal seal may be formed by a ring extending from the second end 23 and a matching groove defined on the first end 41 (not shown). This seal may have application where steam would otherwise weaken an o-ring.

The casing connector 40 may be welded or otherwise connected with the casing joints 03 at the casing connection point 46 for receiving the tubing 05 that hangs from the hanger 06 seated on the hanger profile 34. The second modular connection point 44 may be reversibly connected with the bowl body 20 through any suitable reversible connection.

The bowl tubular 20 may remain disconnected from the casing connector 40 while welding the casing connector 40 to the casing 03, facilitating welding or otherwise connecting the casing connector 40 to the casing without interference from the flange or other features at the uphole component connection point 24.

The bowl tubular 20 may be replaced independently of the casing connector 40. The bowl tubular 20 may be replaced when damaged, such as at the hanger profile 45, at a groove proximate the first end 21 to receive a ring gasket on the flange for the uphole component connection point 24. The bowl tubular 20 may be replaced if a new pressure rating on the blowout preventer or Christmas Tree is required, and a corresponding new flange on the uphole component connection point 24. The bowl body 20 may be replaced with a bowl body having other functionality, such as a different hanger profile 34, rotation drive to provide functionality of a tubing rotator (e.g. the bowl body 420, 520 or 620), an extended gripping portion (e.g. the bowl body 520 or 620), an adaptor tubular (e.g. for use with the bowl body 220 or 620), or any other suitable bowl body.

There are many different hanger profiles 34. If there is need for a specific hanger profile 34, a new bowl tubular 20 with the hanger profile 34 may be provided without having to cut the casing 03 from the casing connector 40. In previous tubular heads, the tubular head would be cut off and a new tubular head welded on to the top of the resulting string.

The casing connector 40 may be replaced independently of the bowl tubular 20. The casing connector 40 may be replaced when the casing connector 40 is damaged, such as at the casing connection point 46 after being refurbished many times and having a socket weld that is too large on the inside diameter. The casing connector 40 may be replaced if size of weld or the thread is being changed, such as from 7' to 4½". The casing connector 40 may be replaced if flow lines 07 leading into the casing connector 40 damage the connector body 42 (e.g. through as impact to a flow line 07 connected with an integral connection point 156, etc.).

The casing connector 40 may be replaced after repeated refurbishment, which fatigues the metal of the connector body 42. Rather than discarding the entire casing head 10 after repeated welding to casing 03, the casing connector 40 may be replaced and the bowl tubular 20 connected with a new casing connector 40.

The flanged plugs 60 may be replaced independently of the casing connector 40. The flanged plugs 60 may be damaged in the event of a flow line 07 being impacted by a vehicle or otherwise subject to strong force. The force would impact the flanged plugs 60, which are threadedly connected with the flow lines 07 at the flow line connection points 63. The flanged plugs 60 would absorb at least a portion of the impact force and the resulting damage, which may spare the connector body 42, or make it salvageable with refurbishment of the recessed connection point 48.

Figure 20:
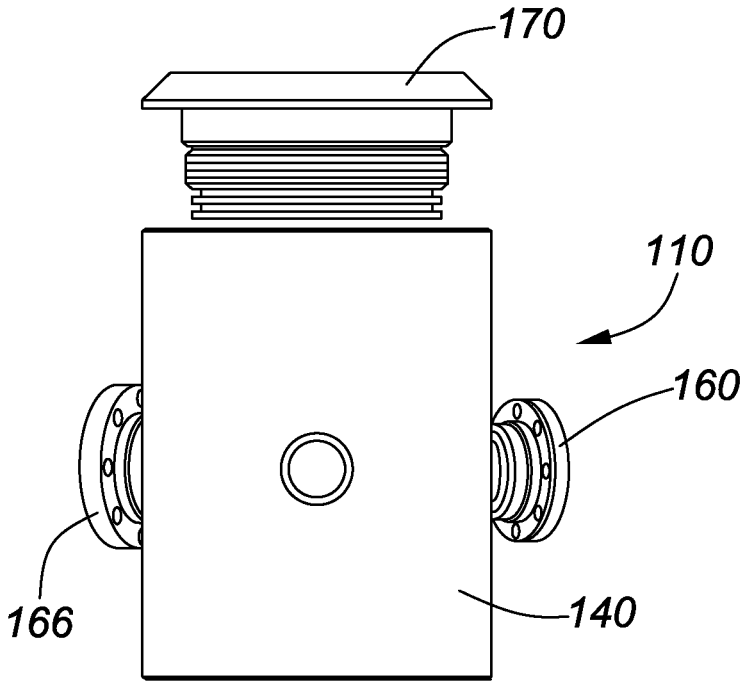
FIG. 20 is a schematic exploded view of a tubing head.
Figure 21:
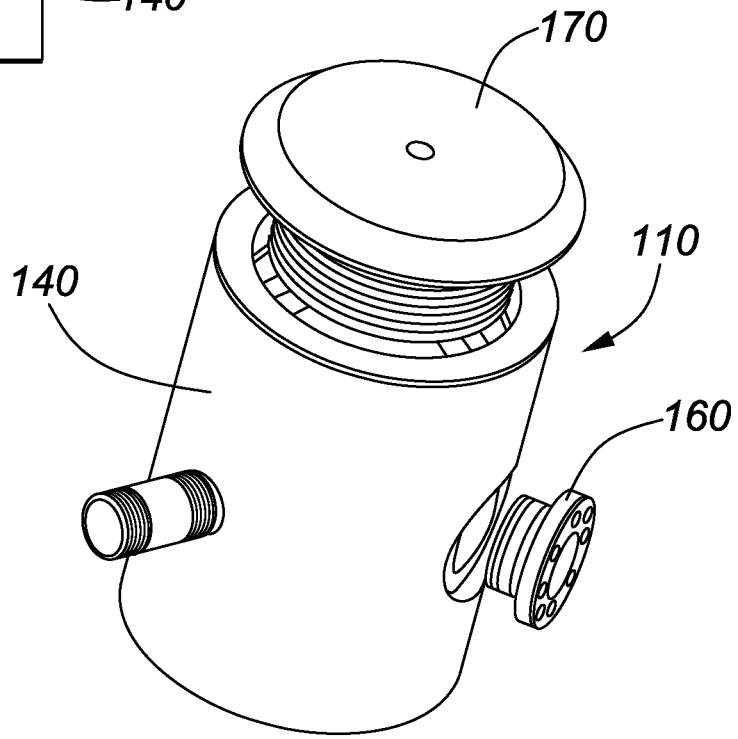
FIG. 21 is a schematic exploded view of the tubing head of FIG. 20.
Figure 22:
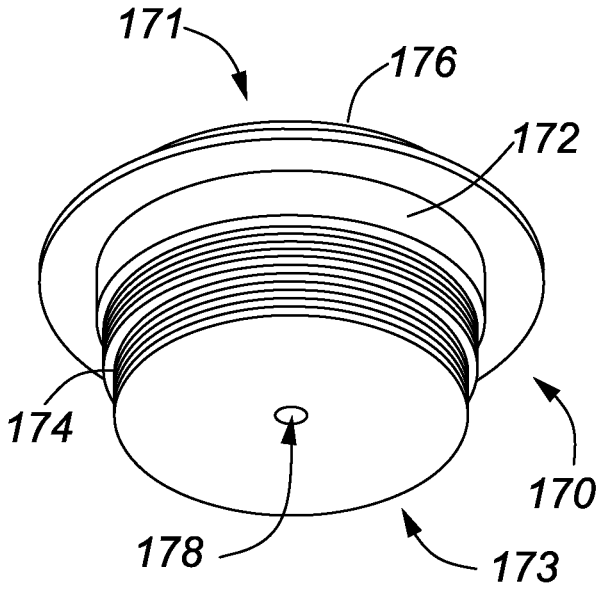
FIG. 22 is an isometric view of a casing plug of the casing head of FIG. 20.
Figure 23:
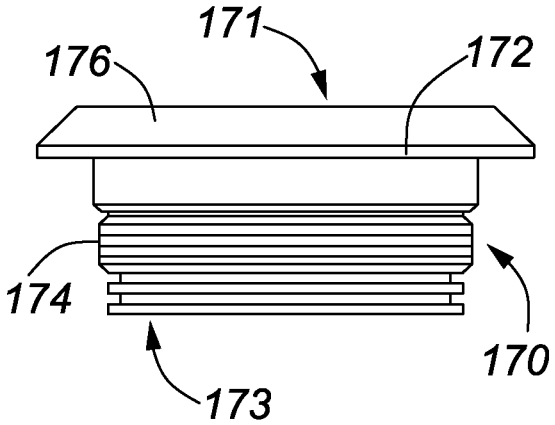
FIG. 23 is an elevation view of the casing plug of FIG. 22.
Figure 24:
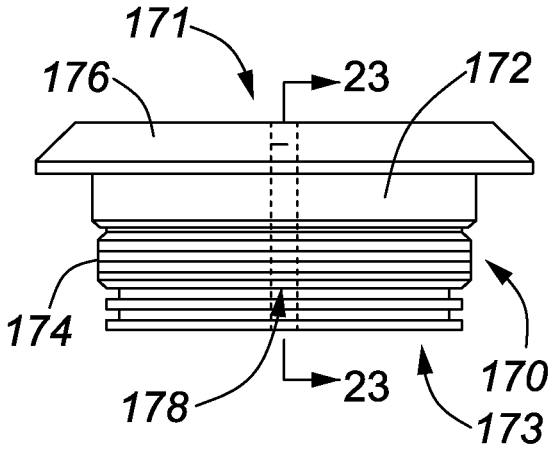
FIG. 24 is an elevation view of the casing plug of FIG. 22 showing interior details.
Figure 25:
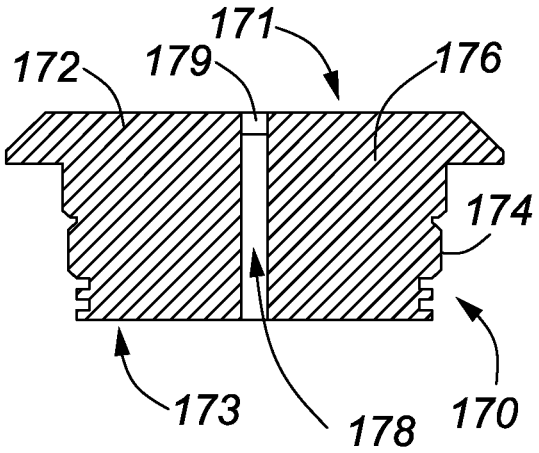
FIG. 25 is a cross section elevation view of a casing plug of FIG. 22.
Figure 26:
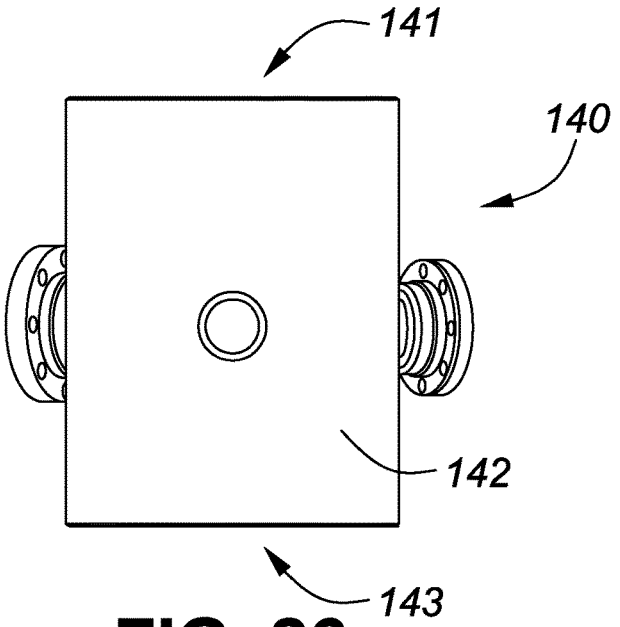
FIG. 26 is an elevation view of a casing connector of the casing head of FIG. 20.
Figure 27:
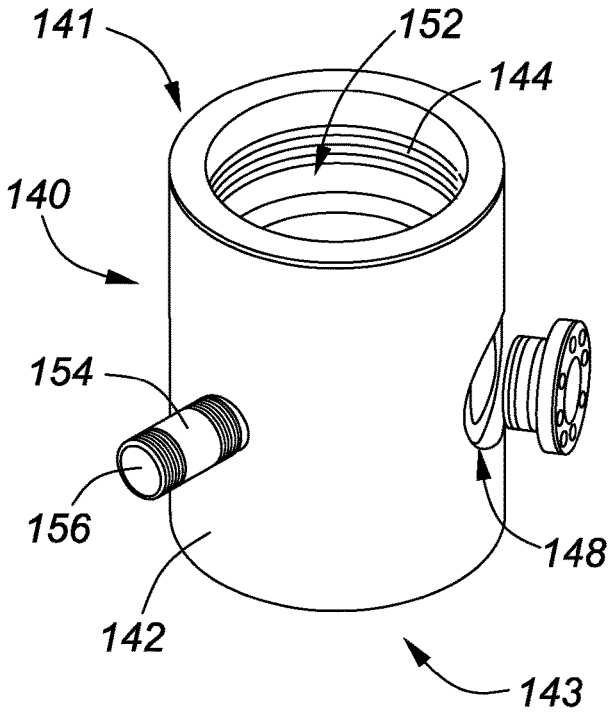
FIG. 27 is an isometric view of the casing connector of FIG. 26.
Figure 28:
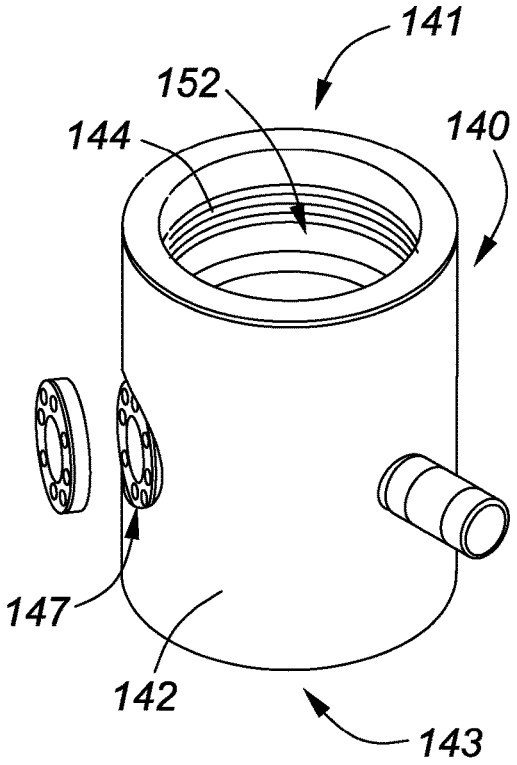
FIG. 28 is an isometric view of the casing connector of FIG. 26.
Figure 29:
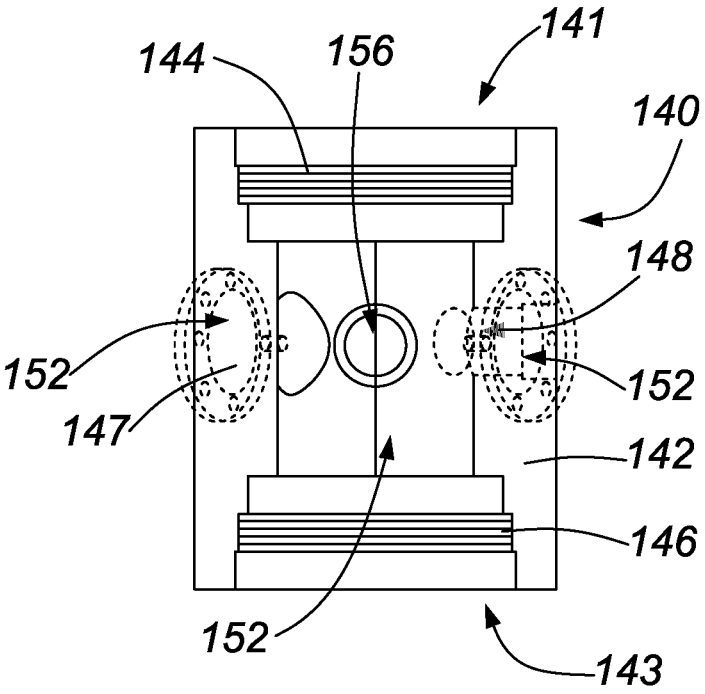
FIG. 29 is an elevation view of the casing connector of FIG. 26 showing interior details.
Figure 30:
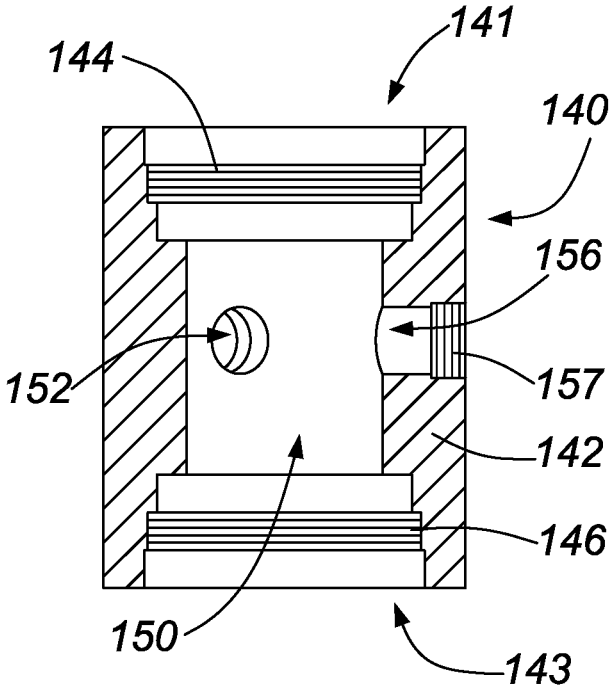
FIG. 30 is a cross section elevation view of a casing connector of FIG. 26.
Figure 31:
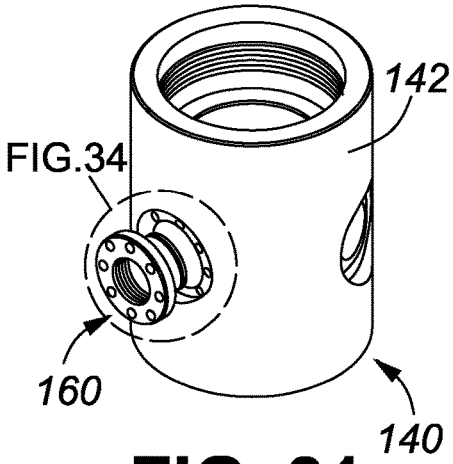
FIG. 31 is an isometric view of the casing connector of FIG. 26.
Figure 32:
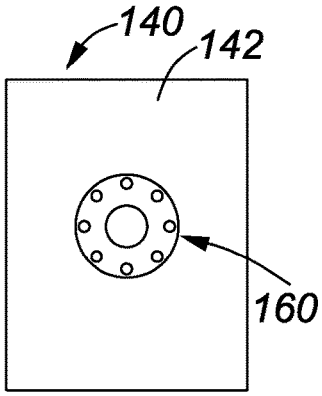
FIG. 32 is an elevation view of the casing connector of FIG. 26.
Figure 33:
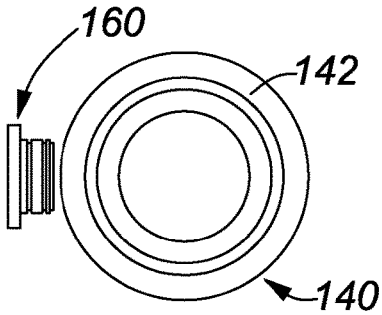
FIG. 33 is a plan view of the casing connector of FIG. 26.
Figure 34:
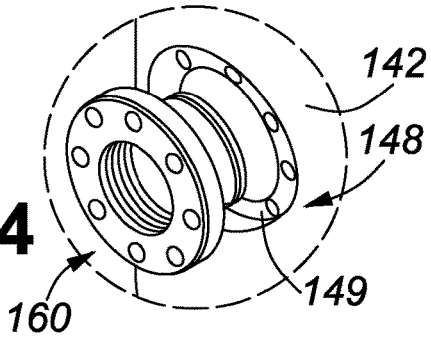
FIG. 34 is an isometric view of the casing connector of FIG. 26.
Figure 35:
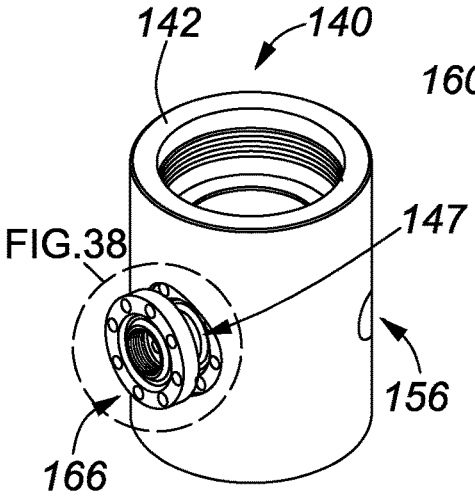
FIG. 35 is an isometric view of the casing connector of FIG. 26.
Figure 36:
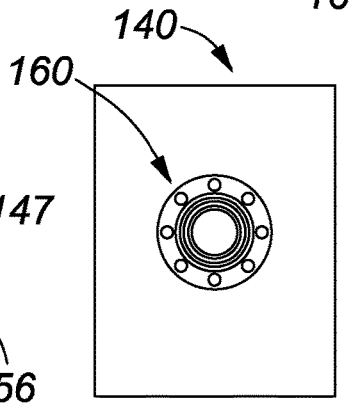
FIG. 36 is an elevation view of the casing connector of FIG. 26.
Figure 37:
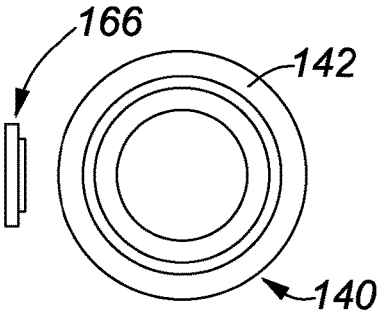
FIG. 37 is a plan view of the casing connector of FIG. 26.
Figure 38:
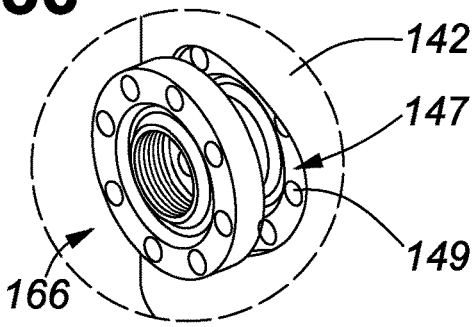
FIG. 38 is an isometric view of the casing connector of FIG. 26.
Figure 39:
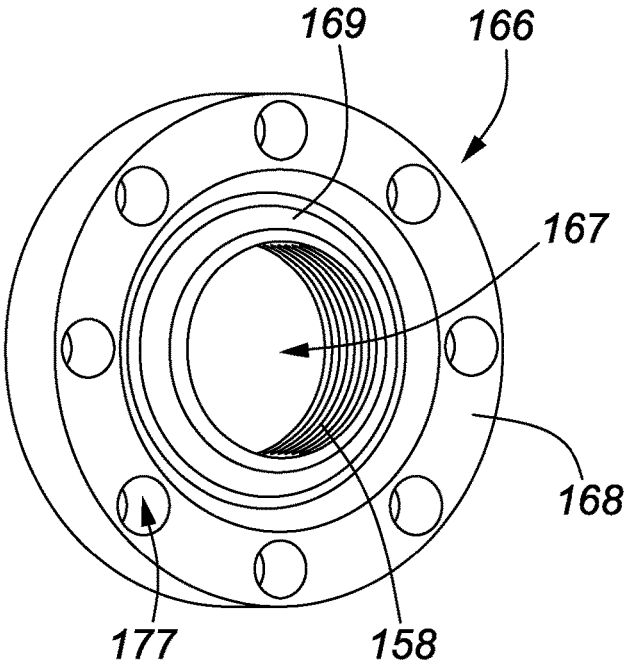
FIG. 39 is an isometric view of a flange ring of the casing head of FIG. 20.
Figure 40:
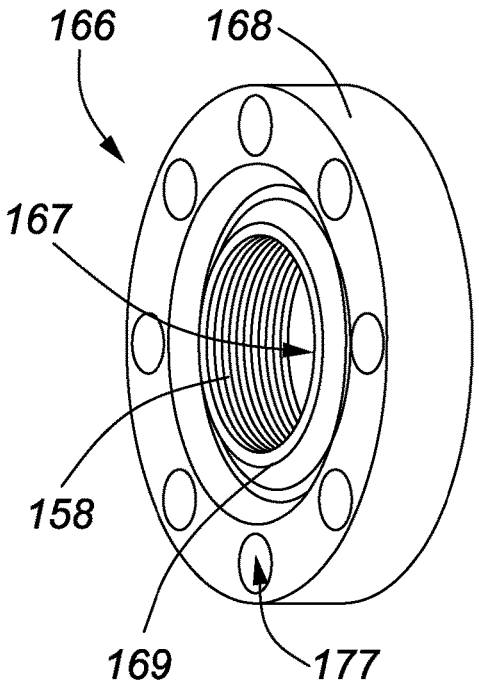
FIG. 40 is an isometric view of the flange ring of FIG. 39.
Figure 41:
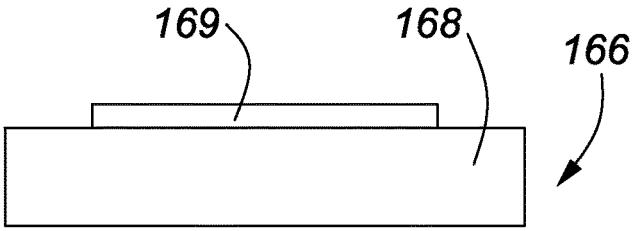
FIG. 41 is an elevation view of the flange ring of FIG. 39.

FIGS. 20 and 21 show exploded views of a casing head 110. The casing head 10 includes a seal plug 170 that may be connected with the casing connector 140. The flanged plug 160 and a flanged ring 166 are connected with the casing connector 140.

FIGS. 22 to 25 show various views of the seal plug 170. The seal plug 170 includes a seal plug body 172 extending between a first end 171 and a second end 173. The seal plug body 172 includes a first modular connection point 174 for connecting with the casing connector 140. The first modular connection point 174 is a pin threaded connection portion, but any suitable reversible connection portion may be used. The seal plug 170 also includes a plug cap 176 for plugging off the casing connector 140. A gripping channel 178 topped by a valve 179 allows for gripping with tools to thread on the plug cap 176. Any suitable engagement point for a tool, tongs or other uphole equipment may be used in place of the gripping channel 178. Once the seal plug 170 is in place on the casing connector 140, the valve 179 can be allowed to close by removal of a tool and seal in the well.

FIGS. 26 to 38 show various views of the casing connector 140, including with the flanged plug 160 and the flanged ring 166.

The casing connector 140 includes the connector body 142 extending between the first end 141 and the second end 143. The second modular connection point 144 is located proximate the first end 141 for connecting with the bowl tubular 120. The second modular connection point 144 includes a threaded box end but any suitable reversible connection point may be used. The casing connection point 146 is located proximate the second end 143 for connecting the casing connector 140 to casing. The casing connection point 146 includes a weld surface but any suitable connection point may be used.

A channel 150 is defined within the connector body 142, providing a flow path for fluids around tubing hanging through the casing head 10. The ports 152 are defined in the connector body 142 for providing fluid communication between the channel 150 and a flow line connected with the connector body 142. The recessed connection point 148 with the plurality of bolt holes 149 allow flanged connection between the connector body 142 and the flanged plug 160.

The casing connector 140 includes an integral connection point 156, which unlike the flanged plugs 60 of the casing connector 40, are not removable connection points that can be replaced. The integral connection points 156 include integral flow line connectors 157, which in this case are threaded connectors. If the integral connection points 156 are damaged, they cannot easily be swapped out as with the flanged plug 160 or the flanged ring 166.

FIGS. 31 to 40 show various views of the casing connector 140, the flanged plug 160, and the flanged ring 166.

The flanged plug 160 includes the plug body 162 and the flange 164 having the plurality of bolt holes 159. The channel 161 is defined within the plug body 162 for providing fluid communication with the channel 150. The flow line connection point 163 is defined by the plug body 162 within the channel 161. The flow line connection point 163 is a threaded box end in this example. The sealing point 165 is included on the plug body 162, and includes grooves for holding o-rings to provide a seal between the plug body 162 and an inside surface of the connector body 142 at the port 152.

The flanged ring 166 provide a similar functionality to the flanged plug 160—a removable connection point for flow lines in a ring connection point 147. The flanged ring 166 includes a ring body 168 having a plurality of bolt holes 177 and a channel 167 with a flow line connection point 158 defined by the ring body 168 within the channel 167. The flow line connection point 158 is a threaded box end in this example but any suitable reversible connection may be applied.

Figure 42:
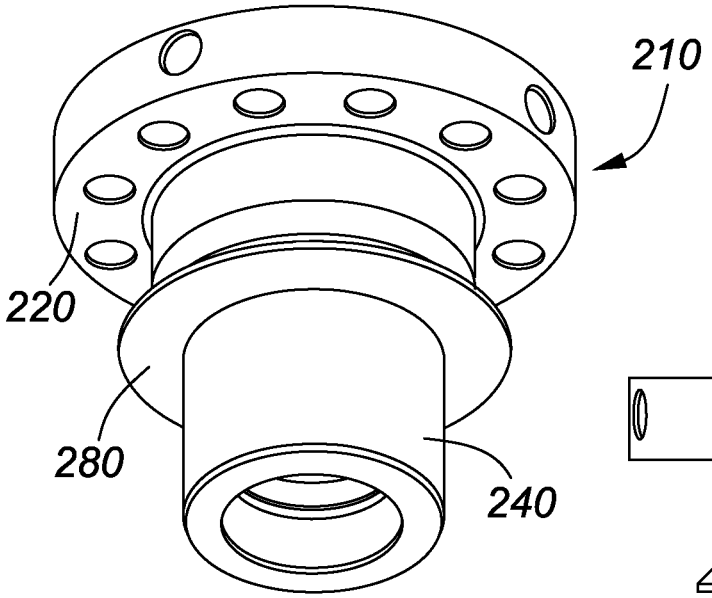
FIG. 42 is an isometric view of a tubing head.
Figure 43:
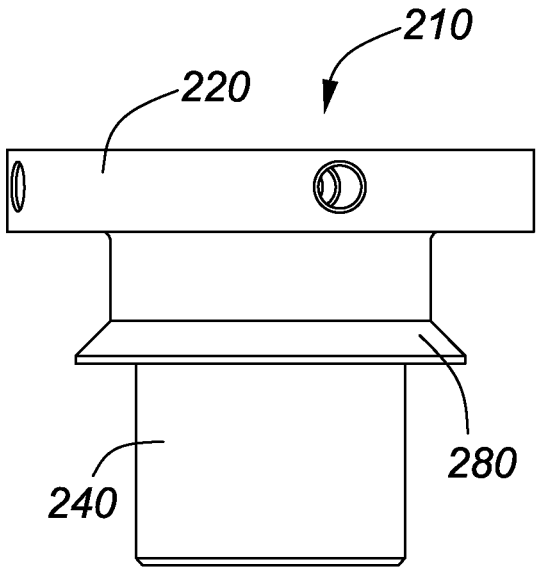
FIG. 43 is an elevation view of the tubing head of FIG. 42.
Figure 44:
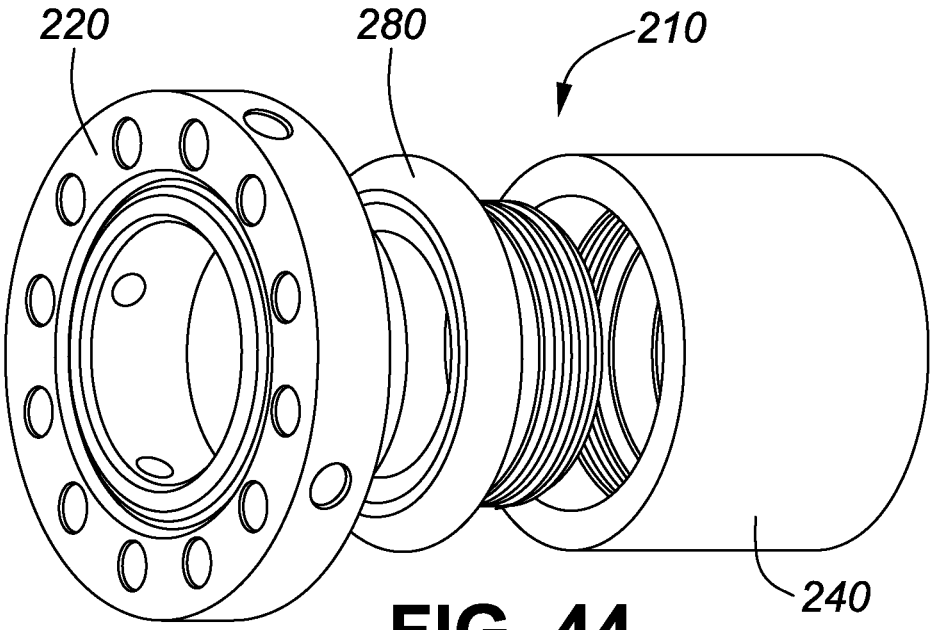
FIG. 44 is an exploded isometric view of the tubing head of FIG. 42.
Figure 45:
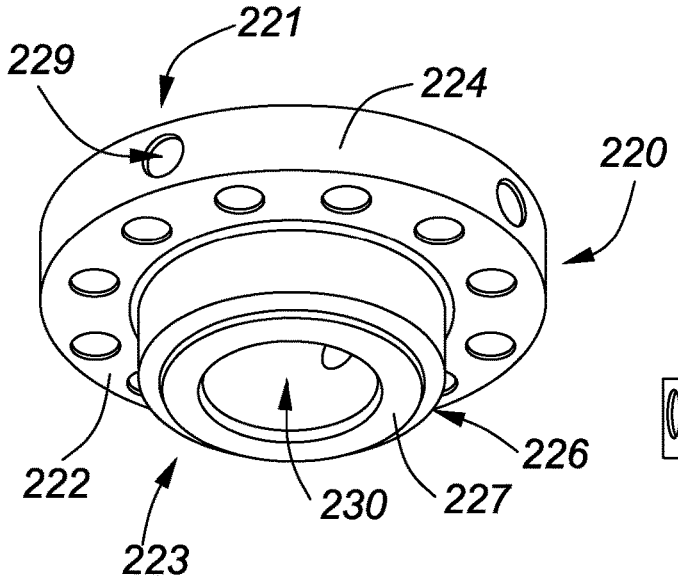
FIG. 45 is an isometric view of a bowl tubular of the tubing head of FIG. 42.
Figure 46:
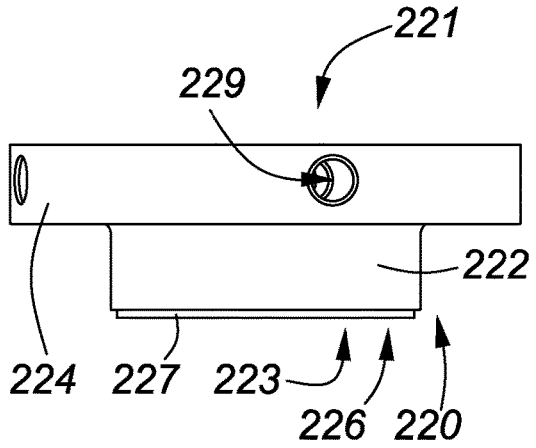
FIG. 46 is an elevation view of the bowl tubular of FIG. 44.
Figure 47:
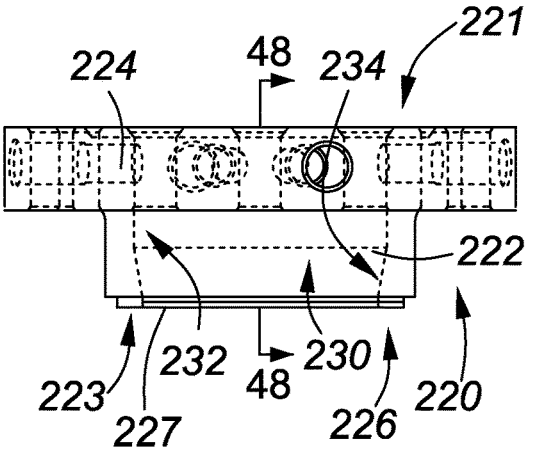
FIG. 47 is an elevation view of the bowl tubular of FIG. 44 showing interior details.
Figure 48:
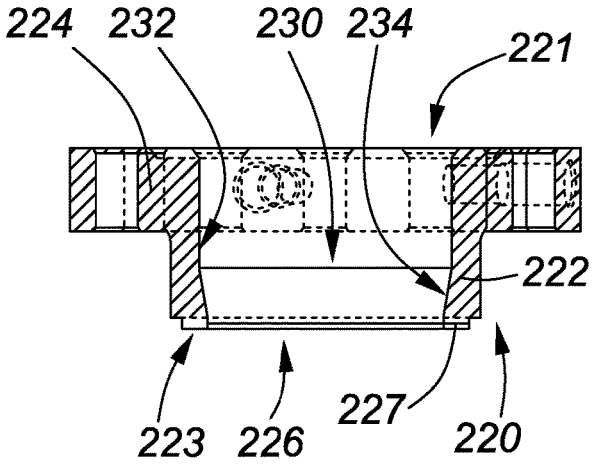
FIG. 48 is a cross section elevation view of a bowl tubular of FIG. 44.
Figure 49:
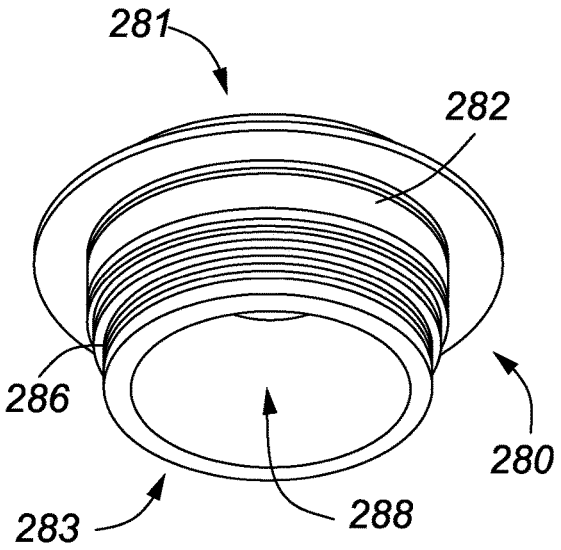
FIG. 49 is an isometric view of an adaptor tubular of the tubing head of FIG. 42.
Figure 50:
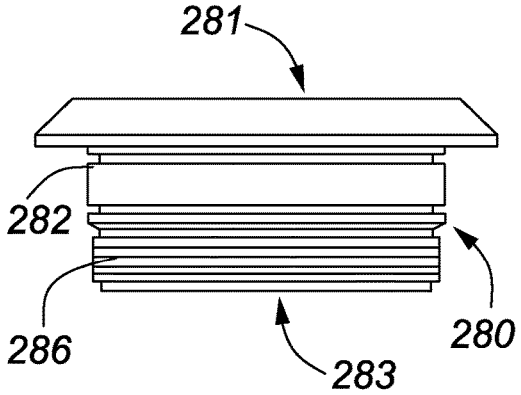
FIG. 50 is an elevation view of the adaptor tubular of FIG. 48.
Figure 51:
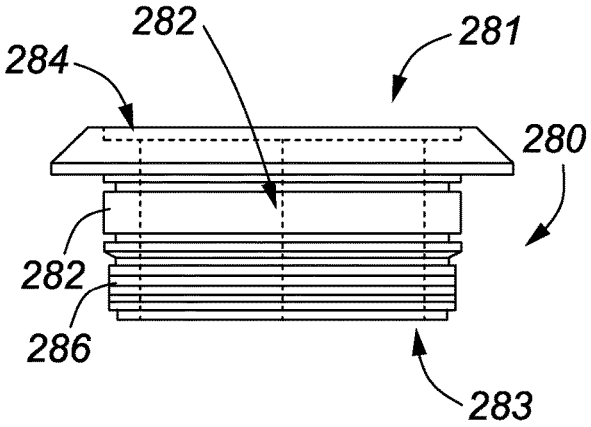
FIG. 51 is an elevation view of the adaptor tubular of FIG. 48 showing interior details.
Figure 52:
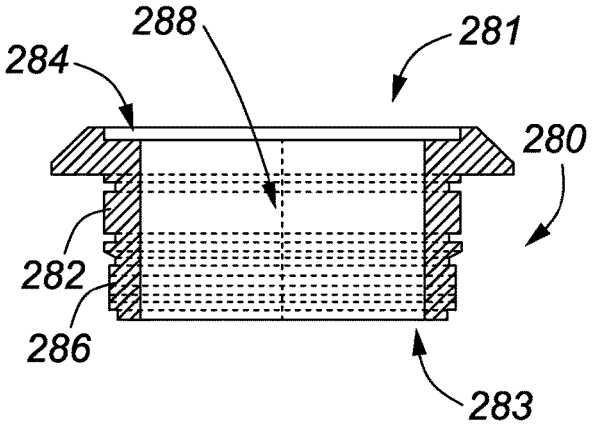
FIG. 52 is a cross section elevation view of an adaptor tubular of FIG. 48.
Figure 53:
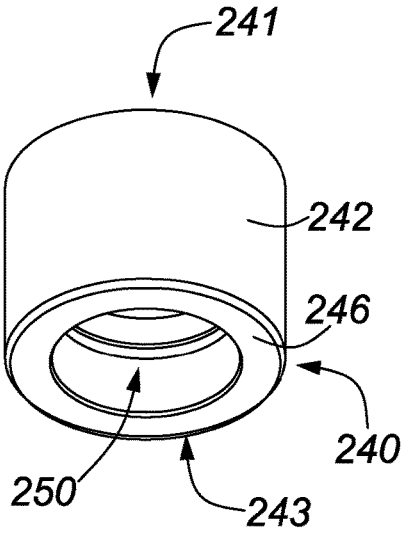
FIG. 53 is an isometric view of a casing connector of the tubing head of FIG. 42.
Figure 54:
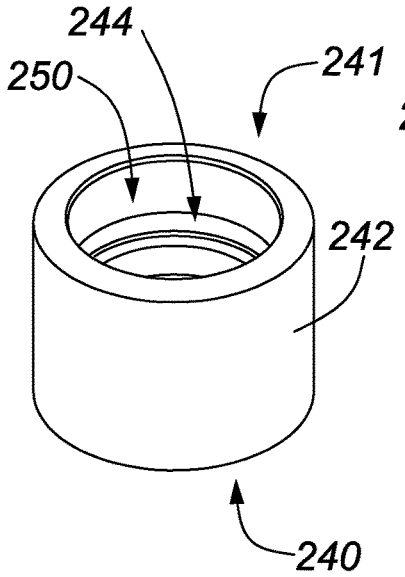
FIG. 54 is an isometric view of the casing connector of FIG. 52.
Figure 55:
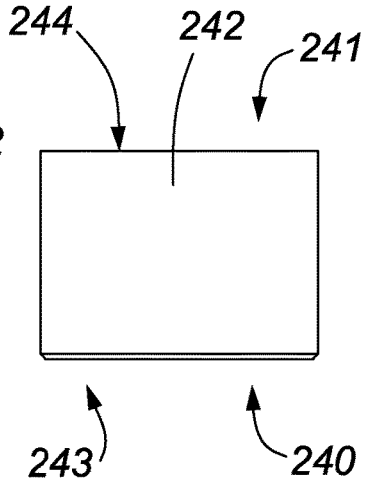
FIG. 55 is an elevation view of the casing connector of FIG. 52.
Figure 56:
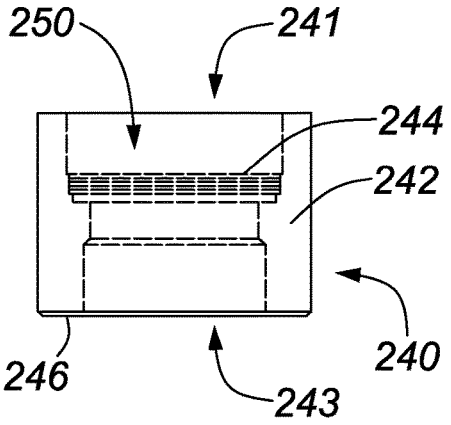
FIG. 56 is an elevation view of the casing connector of FIG. 52 showing interior details.
Figure 57:
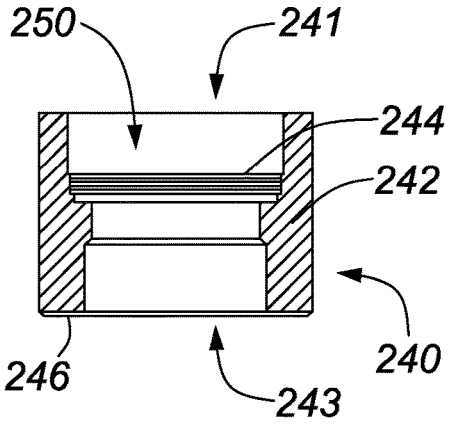
FIG. 57 is a cross section elevation view of a casing connector of FIG. 52.

FIGS. 42 to 44 show exploded views of a tubing head 210. The tubing head 210 includes the bowl tubular 220 that may be connected with an adaptor tubular 280. The adaptor tubular 280 connects with the casing connector 240 for connecting the bowl tubular 220 with the casing connector 240.

FIGS. 45 to 48 show various views of the bowl tubular 220. The bowl tubular 220 includes the bowl body 222 extending between the first end 221 and the second end 223. The uphole component connection point 224 is located proximate the first end 221 for connecting with a blowout preventer, Christmas tree or other pressure rated equipment connected with the wellhead. The uphole component connection point 224 includes a flange but any suitable connection point may be used. The first modular connection point 226 is located proximate the second end 223 for connecting the bowl tubular 220 to the adaptor tubular 280.

The channel 230 is defined within the bowl body 222. An inside surface 232 of the bowl body 222 is shaped to define the hanger profile 234 in the bowl body 222. The hanger profile 234 is shaped to receive a well tubular hanger with a matching profile on an outside surface of the well tubular hanger.

The bowl tubular 220 includes a ring 227 protruding from the second end 223 to connect with the adaptor tubular 280. The bowl tubular 220 includes threaded bores 229 for lockdown pins to engage the hanger profile when securing the tubing head 210 in a well.

FIGS. 49 to 52 show various views of the adaptor tubular 280. The adaptor tubular 280 includes an adaptor body 282 extending between a first end 281 and a second end 283. A channel 288 is defined within the adaptor body 282 for providing fluid communication between the channel 230 and the channel 250. A casing connector connection point 286, in this example a threaded pin end but any suitable reversible connection point may be used, is located proximate the second end 283 for connecting with the casing connector 240. A bowl tubular connector point 284, in this case a groove in the adaptor body 282 to receive the ring 227 but any suitable reversible connection point may be used, is located proximate the first end 281 for receiving the ring 227. The channel 288 provides a flow path for fluids passing through the bowl body adaptor body 282.

FIGS. 53 to 57 show various views of the casing connector 240. The casing connector 240 includes an adaptor connection portion 289 and otherwise includes many of the features of the casing connectors 40 and 140, although the casing connector 240 does not include any flow line connections. The flow line connections may be included in the adaptor portion 280, as in the well tubular head 1410 of FIG. 86.

The casing connector 240 includes the connector body 242 extending between the first end 241 and the second end 243. The second modular connection point 244 is located proximate the first end 241 for connecting with the bowl tubular 220. The second modular connection point 244 includes a threaded box end but any suitable reversible connection point may be used. The casing connection point 246 is located proximate the second end 243 for connecting the casing connector 240 to casing. The casing connection point 246 includes a weld surface but any suitable connection point may be used. The channel 250 is defined within the connector body 242, providing a flow path for fluids around tubing hanging through the casing head 10.

Figure 58:
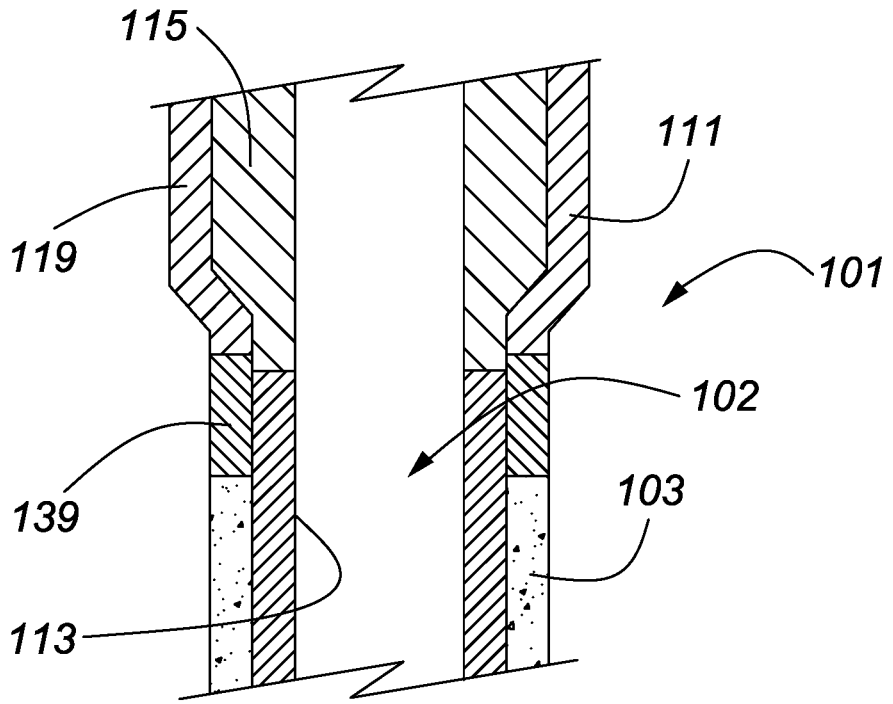
FIG. 58 is an elevation view of a casing head installed on a well.

FIG. 58 shows a casing head 111 in place on a well site 101. The well 102 is cased with the casing 103. A second set of casing 113 is located within the casing 103 and the second set of casing 113 is hanging from a casing hanger 115 connected with the second set of casing 113.

The casing head 111 includes a casing bowl tubular 119 reversibly connected with a casing connector 139. The casing bowl tubular 119 and the casing connector 139 may be connected through any suitable reversible connection. The casing connector 139 may be connected with the casing 103 by any suitable connection. The casing bowl tubular 119 may be connected with an uphole component (not shown) through any suitable connection.

The casing hanger 115 is hanging from a profile defined in the casing bowl tubular 119. The casing bowl tubular 119 may include the structural features of any of the bowl tubulars described for tubing hangers described herein (e.g. the bowl tubular 20, 220, 420, 520, 620, 720, 820, 920, 1020, 1120, 1320 or 1420, etc.) that are required to take the full casing weight and provide a seal between the casing hanger 115 and the bowl tubular 111. The casing bowl tubular 119 may include flow line connection points, particularly in cases where the casing bowl tubular 119 remains above grade and outside the wellbore 102.

Figure 59:
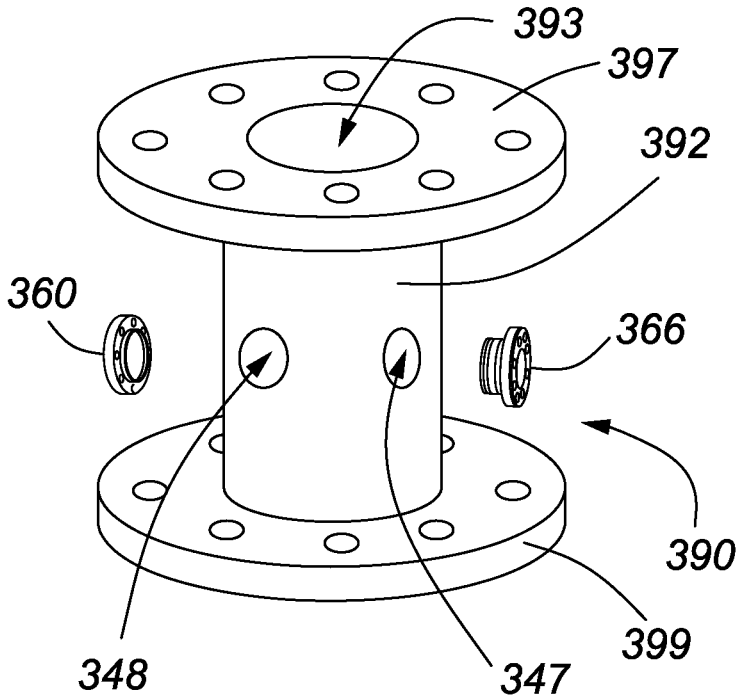
FIG. 59 is an elevation view of a flow line connection point tool.

FIG. 59 is a schematic of a flow line connector 390. The flow line connector 390 includes a flow line connector body 392 that is flanged or otherwise adapted to be connected with an uphole component in an uphole equipment stack or other uphole equipment system. The flow line connector body 392 extends between a first uphole component connection point 397 and a second uphole component connection point 399. The first uphole component connection point 397 may be connected with a first uphole component, such as an uphole component located uphole of the flow line connector 390, such as a blowout preventer. The second uphole component connection point 399 may be connected with a second uphole component, such as an uphole component located downhole of the flow line connector 390, such as a wellhead. The flow line connector 390 is shown with flanged connectors at both the first uphole component connection point 397 and the second uphole component connection point 399, and other suitable connection points may be used.

The flow line connector body 392 defines a channel 393 therethrough for tubulars, such as the well tubing 05, to be run through the flow line connector 390. The flow line connector body 392 may include ports for providing fluid communication between the channel 393 and a flow line (such as the flow lines 07 in FIG. 1). The recessed connection point 348 is included for connecting with the flanged plug 360, and the ring connection point 347 is included in the flow line connector body 392 for connecting with the ring flange 366.

Flow lines, such as the flow lines 07 in FIG. 1, may be connected with the flow line connector 390 by the flanged plug 360, the ring flange 366 or other removable connection point to facilitate changing the flow lines or flow line connection points with the flow line connector 390. Changes in flow lines and flow line connection points may be made in response to damage on the flow lines, to change flow rate or other properties of the uphole equipment, or to add or remove a flow line. The flanged plug 360, the ring flange 366 or other removable connection points facilitate making these changes without replacing the entire flow line connector 390.

Figure 60:
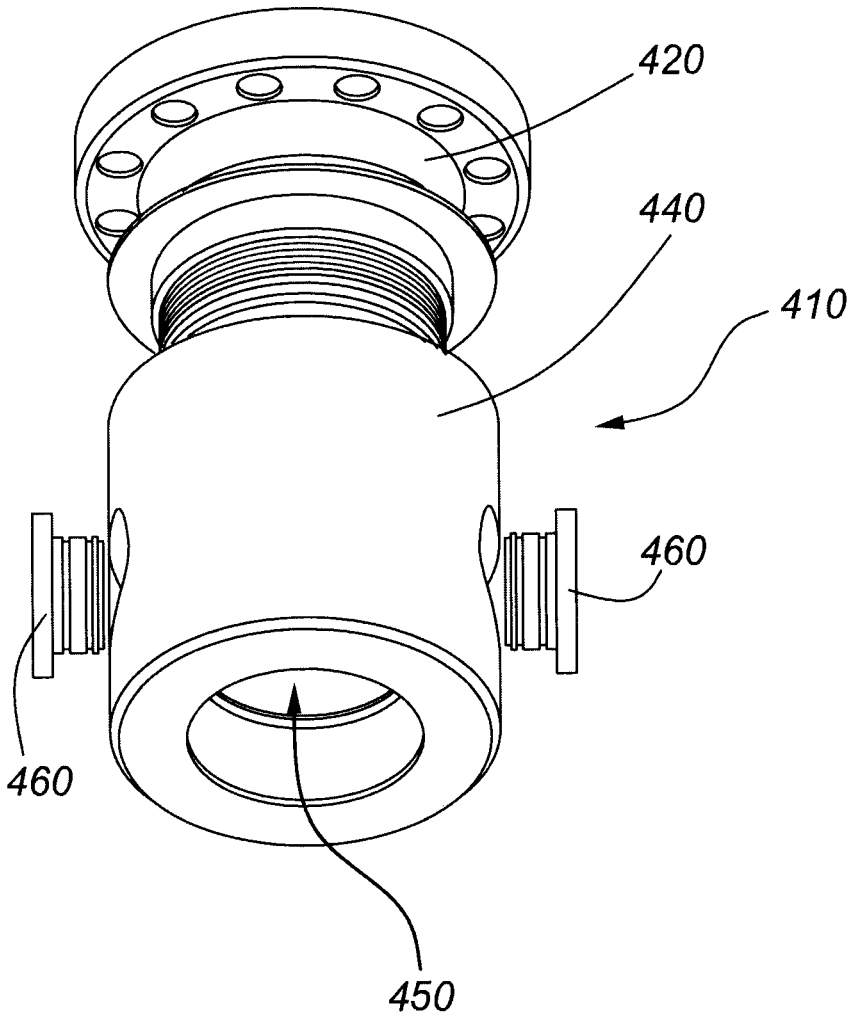
FIG. 60 is a schematic exploded view of a tubing head.
Figure 61:
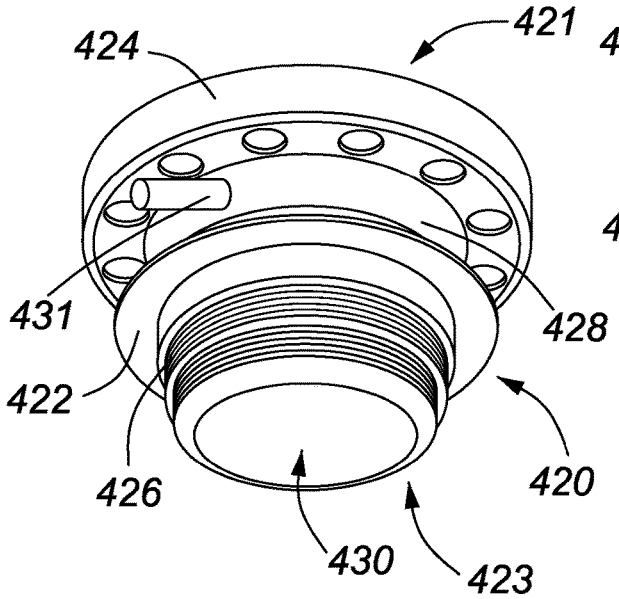
FIG. 61 is an isometric view of a bowl tubular of the tubing head of FIG. 60.
Figure 62:
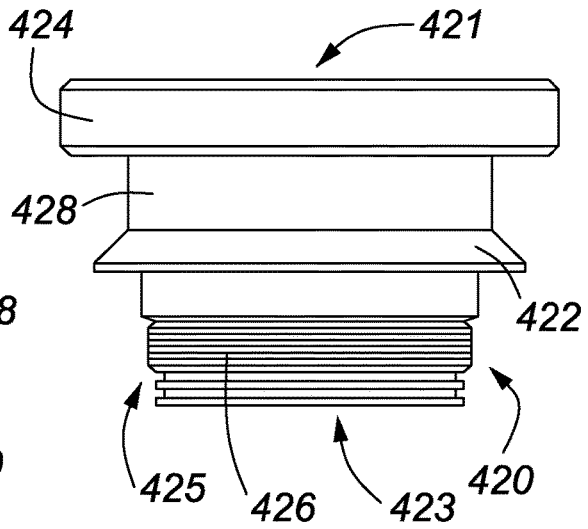
FIG. 62 is an elevation view of the bowl tubular of FIG. 60.
Figure 63:
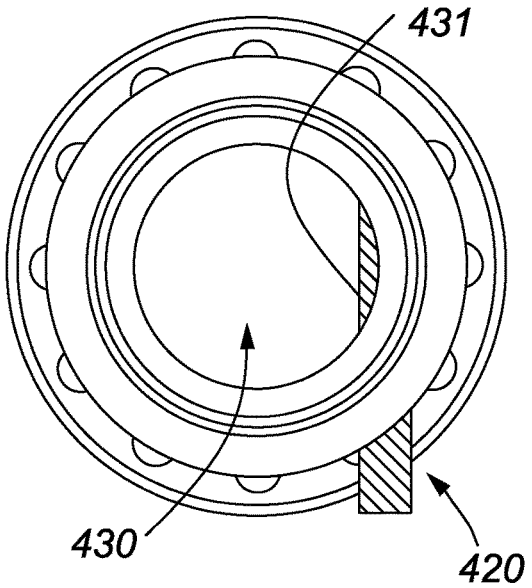
FIG. 63 is a plan view of the bowl tubular of FIG. 60.
Figure 64:
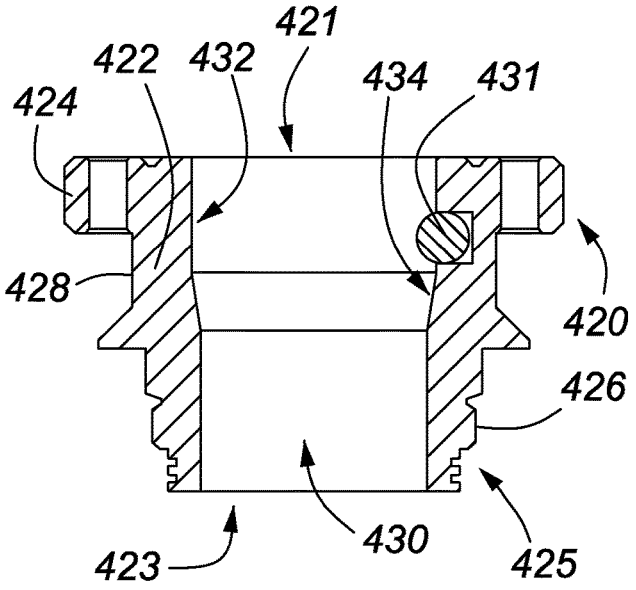
FIG. 64 is a cross section elevation view of the bowl tubular of FIG. 60.

FIG. 60 is an exploded view of a tubing head 410. The tubing head 410 includes a bowl tubular 420 that may be connected with the casing connector 440. A pair of flanged plugs 460 are connected with the casing connector 440.

The casing connector 440 includes the connector body 442 extending between the first end 441 and the second end 443. The second modular connection point 444 is located proximate the first end 441 for connecting with the bowl tubular 420. The second modular connection point 444 includes a threaded box end but any suitable connection reversible point may be used. The casing connection point 446 is located proximate the second end 443 for connecting the casing connector 440 to casing. The casing connection point 446 includes a weld surface but any suitable connection point may be used.

The channel 450 is defined within the connector body 442, providing a flow path for fluids around tubing hanging through the casing head connected with the casing connector 440. The ports 452 are defined in the connector body 442 for providing fluid communication between the channel 450 and a flow line connected with the connector body 442. The recessed connection point 448 with the plurality of bolt holes 449 allow flanged connection between the connector body 442 and the flanged plug 460.

FIGS. 61 to 64 show various views of the bowl tubular 420. The bowl tubular 420 includes the bowl body 422 extending between the first end 421 and the second end 423. The uphole component connection point 424 is located proximate the first end 421 for connecting with a blowout preventer, Christmas tree or other pressure rated equipment connected with the wellhead. The uphole component connection point 424 includes a flange but any suitable connection point may be used. The first modular connection point 426 is located proximate the second end 423 for connecting the bowl tubular 420 to the casing connector 440. The first modular connection point 426 includes a threaded pin end but any suitable reversible connection point may be used. When the bowl tubular 420 and the casing connector 440 are connected with each other, o-rings may be received within grooves 425, and shear pins may be threadedly connected with the casing connector 440 into grooves 425 defined in the bowl tubular 420 proximate the second end 423. In addition, set screws may be threaded through the casing connector 440 into contact with the bowl tubular 420 to maintain additional connections between the casing connector and the bowl tubular 420.

The bowl body 420 includes a worm shaft 431 for threadedly engaging a paired thread 433 on the tubing hanger 406 connected with the tubing string 405. The worm shaft 431 may be engaged by a drive shaft to rotate the tubing string 405.

The gripping portion 428 is defined on the bowl body 422 for manipulating the bowl tubular 420 when connecting the bowl tubular 420 with the casing connector 440. A portion of the gripping portion 428 may overlap with the profile 434.

The channel 430 is defined within the bowl body 422. An inside surface 432 of the bowl body 422 is shaped to define the hanger profile 434 in the bowl body 422. The hanger profile 434 is shaped to receive the tubing hanger 406 with a matching profile on the outside surface of the tubing hanger 406 for rotating the tubing hanger 406 and the tubing string 405 under driving force from the worm shaft 431.

Figure 65:
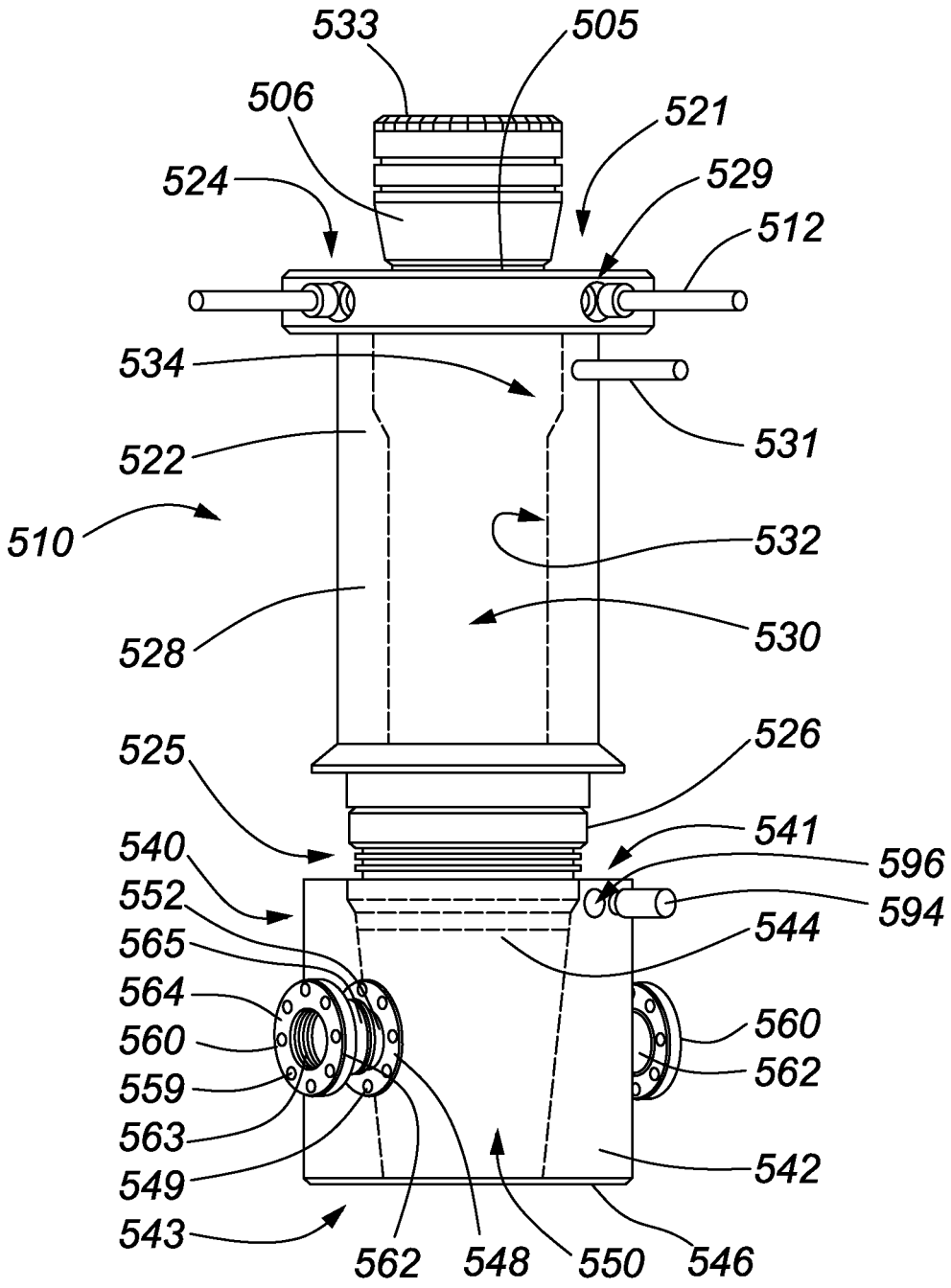
FIG. 65 is a schematic exploded view of a tubing head.

FIG. 65 is an exploded view of a tubing head 510. The tubing head 510 includes a bowl tubular 520 that may be connected with the casing connector 540. A pair of flanged plugs 560 are connected with the casing connector 540.

The bowl tubular 520 includes the bowl body 522 extending between the first end 521 and the second end 523. The uphole component connection point 524 is located proximate the first end 521 for connecting with a blowout preventer, Christmas tree or other pressure rated equipment connected with the wellhead. The uphole component connection point 524 includes a flange but any suitable connection point may be used. The first modular connection point 526 is located proximate the second end 523 for connecting the bowl tubular 520 to the casing connector 540. The first modular connection point 526 includes a threaded pin end but any suitable reversible connection point may be used. When the bowl tubular 520 and the casing connector 540 are connected with each other, o-rings may be received within grooves 525, and shear pins may be threadedly connected with the casing connector 540 into grooves 525 defined in the bowl tubular 520 proximate the second end 523. A set screw 594 may be threaded through a set screw aperture 596 in the casing connector body 542 and into contact with the bowl tubular 520 to maintain additional connections between the casing connector 540 and the bowl tubular 520.

The extended gripping portion 528 is defined on the bowl body 522 for manipulating the bowl tubular 520 when connecting the bowl tubular 520 with the casing connector 540. The extended gripping portion 528 is at least as long as the die length for a pair of power tongs that may be used to connect the bowl tubular 520 with the casing connector 540. The gripping portion 528 extends along the bowl body 522 over a portion of the bowl body 522 at least as long as the die length for a pair of power tongs that may be used to connect the bowl tubular 520 with the casing connector 540.

The channel 530 is defined within the bowl body 522. An inside surface 532 of the bowl body 522 is shaped to define the hanger profile 534 in the bowl body 522. The hanger profile 534 is shaped to receive the tubing hanger 506 with a matching profile on the outside surface of the tubing hanger 506 for rotating the tubing hanger 506 and the tubing string 505 under driving force from the worm shaft 531. The bowl body 522 includes the threaded bores 529 for lockdown pins 512 to engage the hanger profile when securing the tubing head 510 in a well.

The casing connector 540 includes the connector body 542 extending between the first end 541 and the second end 543. The second modular connection point 544 is located proximate the first end 541 for connecting with the bowl tubular 520. The second modular connection point 544 includes a threaded box end but any suitable connection reversible point may be used. The casing connection point 546 is located proximate the second end 543 for connecting the casing connector 540 to casing. The casing connection point 546 includes a weld surface but any suitable connection point may be used.

The channel 550 is defined within the connector body 542, providing a flow path for fluids around tubing hanging through the casing head connected with the casing connector 540. The ports 552 are defined in the connector body 542 for providing fluid communication between the channel 550 and a flow line connected with the connector body 542. The recessed connection point 548 with the plurality of bolt holes 549 allow flanged connection between the connector body 542 and the flanged plug 560.

The flanged plug 560 includes the plug body 562 and the flange 564 having a plurality of bolt holes 559. The channel 561 is defined within the plug body 562 for providing fluid communication with the channel 550. The flange 564 connects with the connector body 542 in this example but any suitable reversible connection may be used. The flow line connection point 563 is defined by the plug body 562 within the channel 561. The flow line connection point 563 is a threaded box end in this example but any suitable reversible connection may be used. The sealing point 565 is included on the plug body 562, and includes grooves for holding o-rings to provide a seal between the plug body 562 and an inside surface of the connector body 542 at the port 552.

Figure 66:
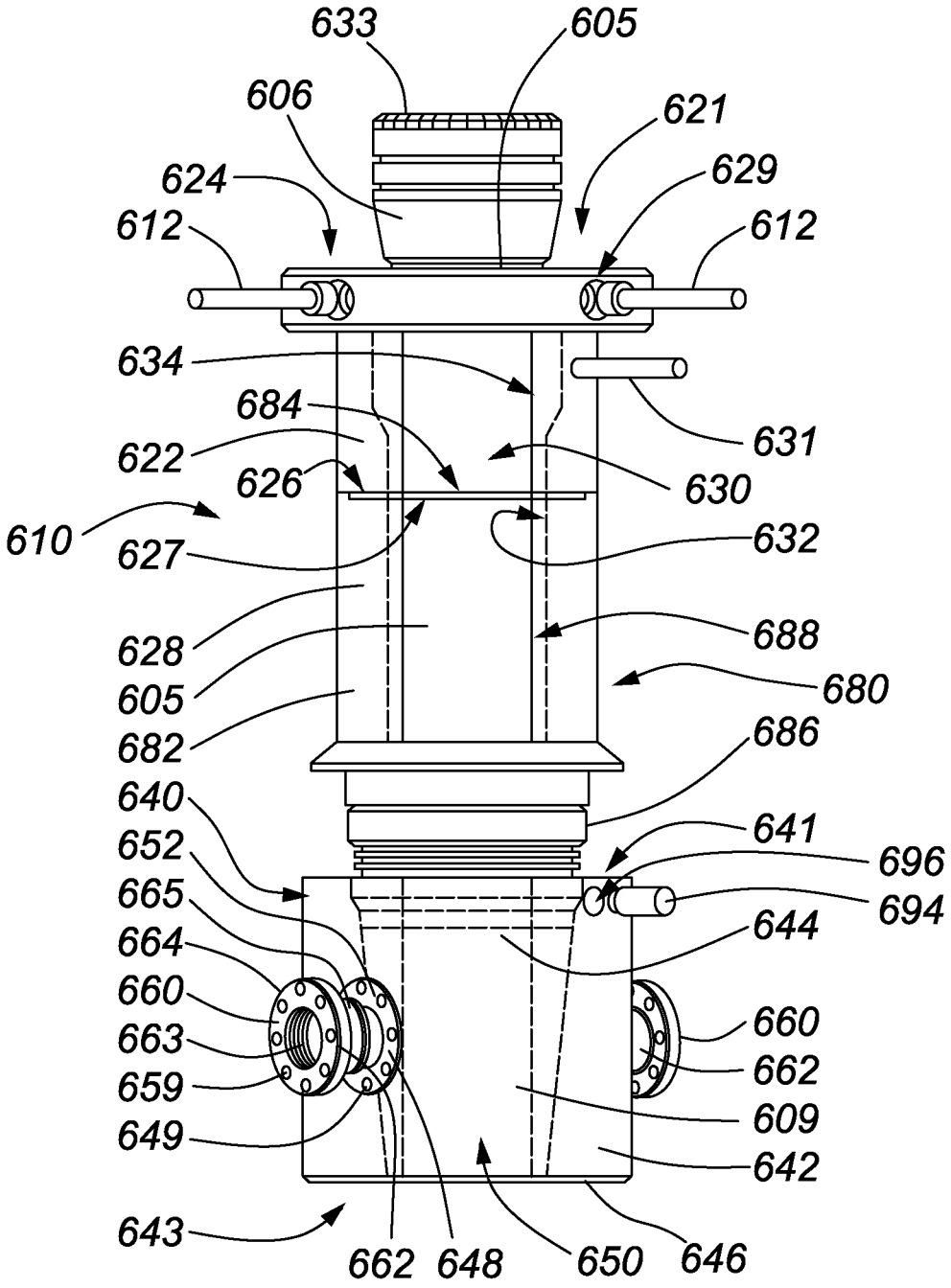
FIG. 66 is a schematic exploded view of a tubing head.

FIG. 66 is a schematic exploded view of a tubing head 610. The tubing head 610 includes the bowl tubular 620 that may be connected with the casing connector 640 through the adaptor tubular 680. A pair of flanged plugs 660 are connected with the casing connector 640.

The bowl tubular 620 includes the bowl body 622 extending between the first end 621 and the second end 623. The uphole component connection point 624 is located proximate the first end 621 for connecting with a blowout preventer, Christmas tree or other pressure rated equipment connected with the wellhead. The uphole component connection point 624 includes a flange but any suitable connection point may be used. The first modular connection point 626 is located proximate the second end 623 for connecting the bowl tubular 620 to the casing connector 640. The first modular connection point 626 includes a threaded pin end but any suitable reversible connection point may be used. When the bowl tubular 620 and the casing connector 640 are connected with each other, o-rings may be received within grooves 625, and shear pins may be threadedly connected with the casing connector 640 into grooves 625 defined in the bowl tubular 620 proximate the second end 623. The set screw 694 may be threaded through the set screw aperture 696 in the casing connector body 642 and into contact with the adaptor tubular 680 to maintain additional connections between the casing connector 640 and the adaptor tubular 680.

The extended gripping portion 628 is defined on the bowl body 622 for manipulating the bowl tubular 620 when connecting the bowl tubular 620 with the casing connector 640. The extended gripping portion 628 is at least as long as the die length for a pair of power tongs that may be used to connect the bowl tubular 620 with the casing connector 640.

The channel 630 is defined within the bowl body 622. An inside surface 632 of the bowl body 622 is shaped to define the hanger profile 634 in the bowl body 622. The hanger profile 634 is shaped to receive the tubing hanger 606 with a matching profile on the outside surface of the tubing hanger 606 for rotating the tubing hanger 606 and the tubing string 605 under driving force from the worm shaft 631. The bowl body 622 includes the threaded bores 629 for the lockdown pins 612 to engage the hanger profile when securing the tubing head 610 in a well.

The casing connector 640 includes the connector body 642 extending between the first end 641 and the second end 643. The second modular connection point 644 is located proximate the first end 641 for connecting with the bowl tubular 620. The second modular connection point 644 includes a threaded box end but any suitable connection reversible point may be used. The casing connection point 646 is located proximate the second end 643 for connecting the casing connector 640 to casing. The casing connection point 646 includes a weld surface but any suitable connection point may be used.

The channel 650 is defined within the connector body 642, providing a flow path for fluids around tubing hanging through the casing head connected with the casing connector 640. The ports 652 are defined in the connector body 642 for providing fluid communication between the channel 650 and a flow line connected with the connector body 642. The recessed connection point 648 with the plurality of bolt holes 649 allow flanged connection between the connector body 642 and the flanged plug 660.

The adaptor tubular 680 includes the adaptor body 682 extending between the first end 681 and the second end 683. The channel 688 is defined within the adaptor body 682 for providing fluid communication between the channel 630 and the channel 650. The casing connector connection point 686, in this example a threaded pin end but any suitable reversible connection point may be used, is located proximate the second end 683 for connecting with the casing connector 640. The bowl tubular connector point 684, in this case a groove in the adaptor body 682 to receive the ring 627 but any suitable reversible connection point may be used, is located proximate the first end 681 for connecting with the first modular connection point 626.

The flanged plug 660 includes the plug body 662 and the flange 664 having a plurality of bolt holes 659. The channel 661 is defined within the plug body 662 for providing fluid communication with the channel 650. The flange 664 connects with the connector body 642 in this example but any suitable reversible connection may be used. The flow line connection point 663 is defined by the plug body 662 within the channel 661. The flow line connection point 663 is a threaded box end in this example but any suitable reversible connection may be used. The sealing point 665 is included on the plug body 662, and includes grooves for holding o-rings to provide a seal between the plug body 662 and an inside surface of the connector body 642 at the port 652.

Figure 67:
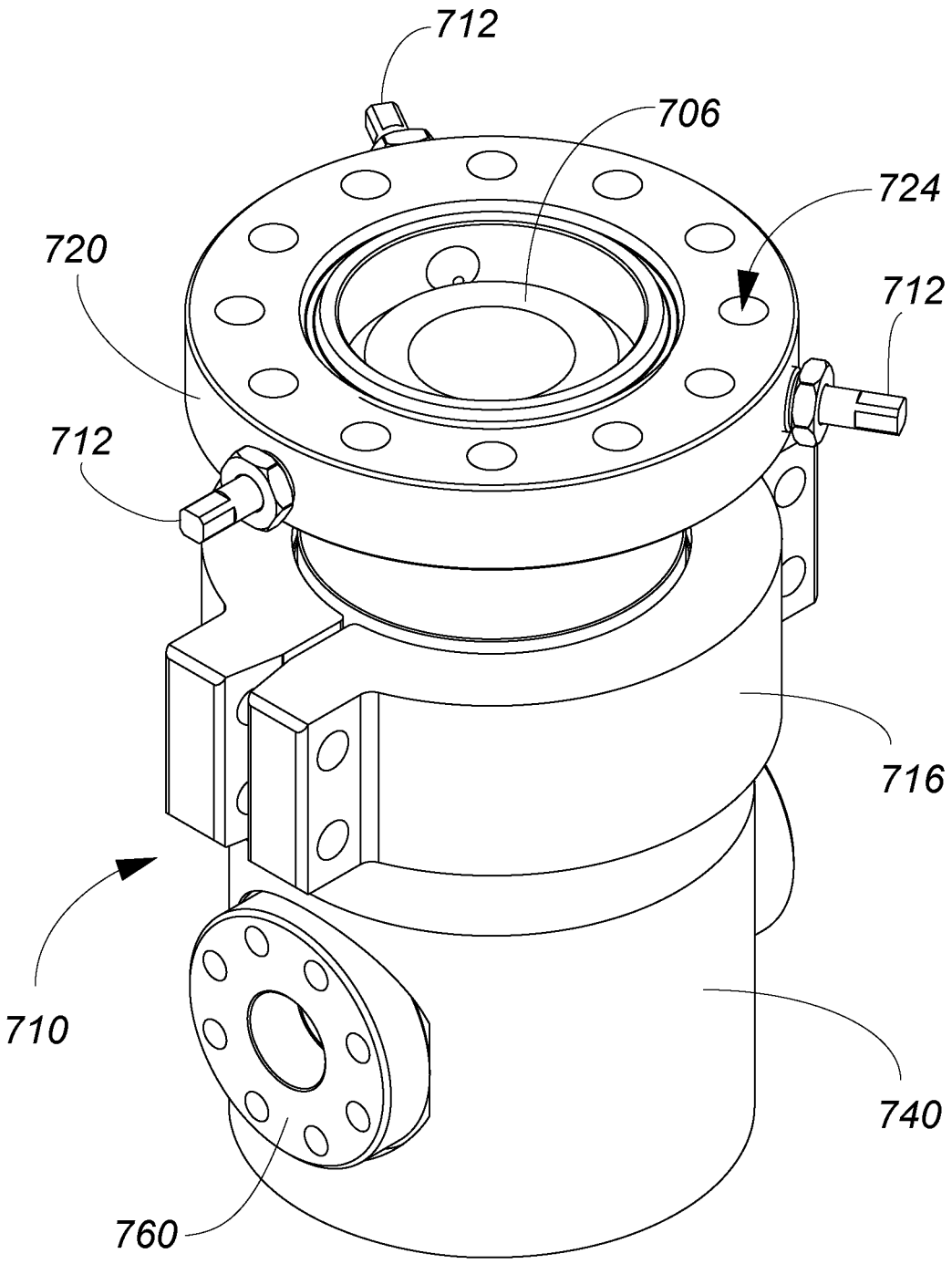
FIG. 67 is an isometric view of a tubing head.
Figure 68:
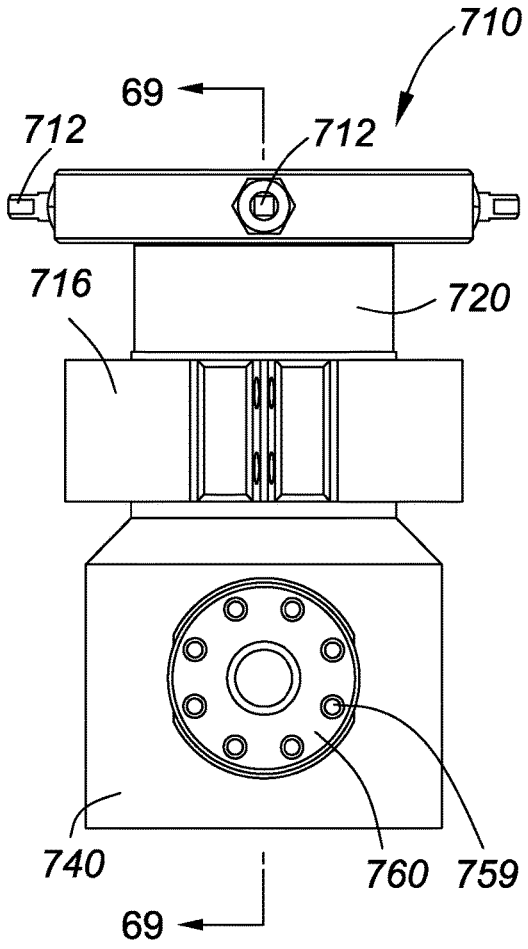
FIG. 68 is an elevation view of the tubing head of FIG. 67.
Figure 69:
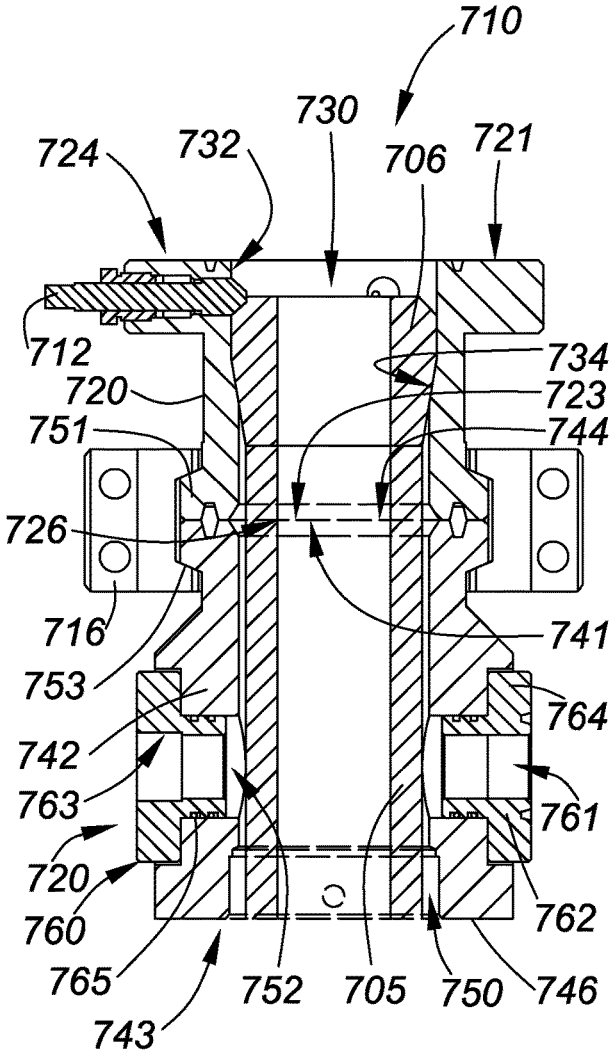
FIG. 69 is a cross section elevation view of the tubing head of FIG. 67.

FIGS. 67 to 69 show a tubing head 710. The tubing head 710 includes the bowl tubular 720 that may be connected with the casing connector 740. A pair of flanged plugs 760 are connected with the casing connector 740. The tubing 705 is hanging from the tubing hanger 706 into the channel 730 and the channel 750. The tubing hanger 706 is hanging from the hanger profile 734.

The bowl tubular 720 includes the bowl body 722 extending between the first end 721 and the second end 723. The uphole component connection point 724 is located proximate the first end 721 for connecting with a blowout preventer, Christmas tree or other pressure rated equipment connected with the wellhead. The uphole component connection point 724 includes a flange but any suitable connection point may be used. The first modular connection point 726 is located proximate the second end 723 for connecting the bowl tubular 720 to the casing connector 740. The first modular connection point 726 includes a bowl tubular clamping point 751. Other suitable reversible connection points may be used. The set screw 794 may be threaded through the set screw aperture 796 in the casing connector body 742 and into contact with the bowl tubular 720 to maintain additional connections between the casing connector 740 and the bowl tubular 720.

The gripping portion 728 is defined on the bowl body 722 for manipulating the bowl tubular 720 when connecting the bowl tubular 720 with the casing connector 740. A portion of the gripping portion 728 may overlap with the profile 734.

The channel 730 is defined within the bowl body 722. An inside surface 732 of the bowl body 722 is shaped to define the hanger profile 734 in the bowl body 722. The bowl body 722 includes the threaded bores 729 for the lockdown pins 712 to engage the hanger profile when securing the tubing head 710 in a well.

The casing connector 740 includes the connector body 742 extending between the first end 741 and the second end 743. The second modular connection point 744 is located proximate the first end 741 for connecting with the bowl tubular 720. The second modular connection point 744 includes a casing connector clamping point 753, but any suitable reversible connection point may be used. The casing connection point 746 is located proximate the second end 743 for connecting the casing connector 740 to casing. The casing connection point 746 includes a weld surface but any suitable connection point may be used. The channel 750 includes a port near the second end 743 for pressure testing a casing weld.

A modular connection clamp 716 engages with the bowl tubular clamping point 751 and with the casing connector clamping point 753 on the casing connector 740, to connect the bowl tubular 720 with the casing connector 740. The bowl tubular clamping point 751 and the casing connector clamping point 753 are each shaped with a cam to be securely clamped by the modular connection clamp 716 when the modular connection clamp 716 is engaged with both the bowl tubular clamping point 751 and the casing connector clamping point 753. The modular connection clamp 716 may be an API connecting hub clam or any suitable clamp. A gasket may be included between the bowl tubular clamping point 751 and the casing connector clamping point 753.

The channel 750 is defined within the connector body 742, providing a flow path for fluids around tubing hanging through the casing head 710. The ports 752 are defined in the connector body 742 for providing fluid communication between the channel 750 and a flow line connected with the connector body 742. The recessed connection point 748 with the plurality of bolt holes 749 allow flanged connection between the connector body 742 and the flanged adaptor 760.

The flanged plug 760 includes the plug body 762 and the flange 764 having a plurality of bolt holes 759. The channel 761 is defined within the plug body 762 for providing fluid communication with the channel 750. The flange 764 connects with the connector body 742 in this example but any suitable reversible connection may be used. The flow line connection point 763 is defined by the plug body 762 within the channel 761. The flow line connection point 763 is a threaded box end in this example but any suitable reversible connection may be used. The sealing point 765 is included on the plug body 762, and includes grooves for holding o-rings to provide a seal between the plug body 762 and an inside surface of the connector body 742 at the port 752.

Figure 70:
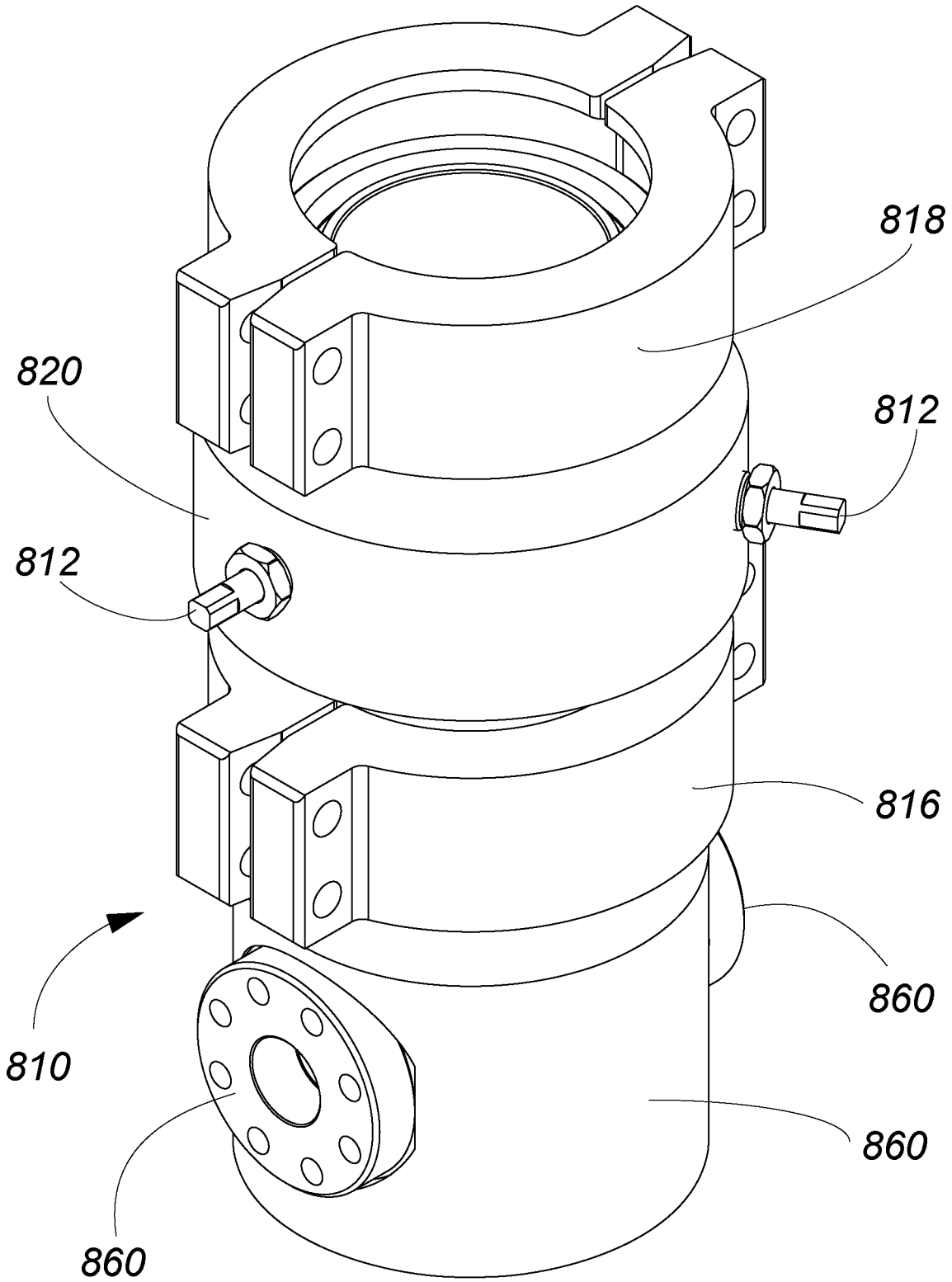
FIG. 70 is an isometric view of a tubing head.

FIGS. 70 to 72 show a tubing head 810. The tubing head 810 includes the bowl tubular 820 that may be connected with the casing connector 840. A flanged plug 860 and a flanged plug 869 are connected with the casing connector 840. The tubing 805 is hanging from the tubing hanger 806 into the channel 830 and the channel 850. The tubing hanger 806 is hanging from the hanger profile 834.

The bowl tubular 820 includes the bowl body 822 extending between the first end 821 and the second end 823. The uphole component connection point 824 is located proximate the first end 821 for connecting with a blowout preventer, Christmas tree or other pressure rated equipment connected with the wellhead. The uphole component connection point 824 includes a uphole component clamping point 854 but any suitable connection point may be used. The first modular connection point 826 is located proximate the second end 823 for connecting the bowl tubular 820 to the casing connector 840. The first modular connection point 826 includes the bowl tubular clamping point 851. Other suitable reversible connection point may be used. When the bowl tubular 820 and the casing connector 840 are connected with each other, o-rings may be received within grooves 825, and shear pins may be threadedly connected with the casing connector 840 into grooves 825 defined in the bowl tubular 820 proximate the second end 823. The set screw 894 may be threaded through the set screw aperture 896 in the casing connector body 842 and into contact with the bowl tubular 820 to maintain additional connections between the casing connector 840 and the bowl tubular 820.

The gripping portion 828 is defined on the bowl body 822 for manipulating the bowl tubular 820 when connecting the bowl tubular 820 with the casing connector 840. A portion of the gripping portion 828 may overlap with the profile 834.

The channel 830 is defined within the bowl body 822. An inside surface 832 of the bowl body 822 is shaped to define the hanger profile 834 in the bowl body 822. The bowl body 822 includes the threaded bores 829 for the lockdown pins 812 to engage the hanger profile when securing the tubing head 810 in a well.

The casing connector 840 includes the connector body 842 extending between the first end 841 and the second end 843. The second modular connection point 844 is located proximate the first end 841 for connecting with the bowl tubular 820. The second modular connection point 844 includes the casing connector clamping point 853, but any suitable reversible connection point may be used. The casing connection point 846 is located proximate the second end 843 for connecting the casing connector 840 to casing. The casing connection point 846 includes a weld surface but any suitable connection point may be used. The channel 850 includes a port near the second end 843 for pressure testing a casing weld.

The modular connection clamp 816 engages with the bowl tubular clamping point 851 and with the casing connector clamping point 853 on the casing connector 840, for connecting the bowl tubular 820 with the casing connector 840. The bowl tubular clamping point 851 and the casing connector clamping point 853 are each shaped with a cam to be securely clamped by the modular connection clamp 816 when the modular connection clamp 816 is engaged with both the bowl tubular clamping point 851 and the casing connector clamping point 853. The modular connection clamp 816 may be an API connecting hub clamp or any suitable clamp. A gasket may be included between the bowl tubular clamping point 851 and the casing connector clamping point 853.

An uphole component connection point clamp 818 engages with the uphole component clamping point 854 and with a clamping point on an uphole component (not shown), for connecting the bowl tubular 820 with the uphole component. The uphole component clamping point 854 and the clamping point on the uphole component are each shaped with a cam or other feature to be securely clamped by the uphole component connection point clamp 818 when the uphole component connection point clamp 818 is engaged with both the bowl tubular clamping point 851 and the clamping point on the uphole component. The uphole component connection point clamp 818 may be an API connecting hub clamp or any suitable clamp. A gasket may be included between the uphole component clamping point 854 and a clamping point on the uphole component.

The channel 850 is defined within the connector body 842, providing a flow path for fluids around tubing hanging through the casing head 810. The ports 852 are defined in the connector body 842 for providing fluid communication between the channel 850 and a flow line connected with the connector body 842. The recessed connection point 848 with the plurality of bolt holes 849 allow flanged connection between the connector body 842 and the flanged adaptor 860.

The flanged plug 860 includes the plug body 862 and the flange 864 having a plurality of bolt holes 859. The channel 861 is defined within the plug body 862 for providing fluid communication with the channel 850. The flange 864 connects with the connector body 842 in this example but any suitable reversible connection may be used. The flow line connection point 863 is defined by the plug body 862 within the channel 861. The flow line connection point 863 is a threaded box end in this example but any suitable reversible connection may be used. The sealing point 865 is included on the plug body 862, and includes grooves for holding o-rings to provide a seal between the plug body 862 and an inside surface of the connector body 842 at the port 852.

The flanged plug 869 is connected with one of the ports 852. The flanged plug 869 includes a plug body 878 and the flange 864 having a plurality of the bolt holes 859. The channel 861 is defined within the plug body 878 for providing fluid communication with the channel 850. The flange 864 connects with the connector body 842 in this example but any suitable reversible connection may be used. The flow line connection point 863 is defined by the plug body 878 at a flow line clamping point 855 in this example but any suitable reversible connection may be used. The sealing point 865 is included on the plug body 862, and includes grooves for holding o-rings to provide a seal between the plug body 862 and an inside surface of the connector body 842 at the port 852.

A flow line clamp 875 engages with the flow line clamping point 855 and with a clamping point on a flow line (not shown in FIGS. 70 to 72; similar to the flow line 07), for connecting the flanged plug 869 with the flow line. The flow line clamping point 855 and the clamping point on the flow line are each shaped with a cam or other feature to be securely clamped by the flow line clamp 875 when the flow line clamp 875 is engaged with both the flow line clamping point 855 and the clamping point on the flow line.

Figure 73:
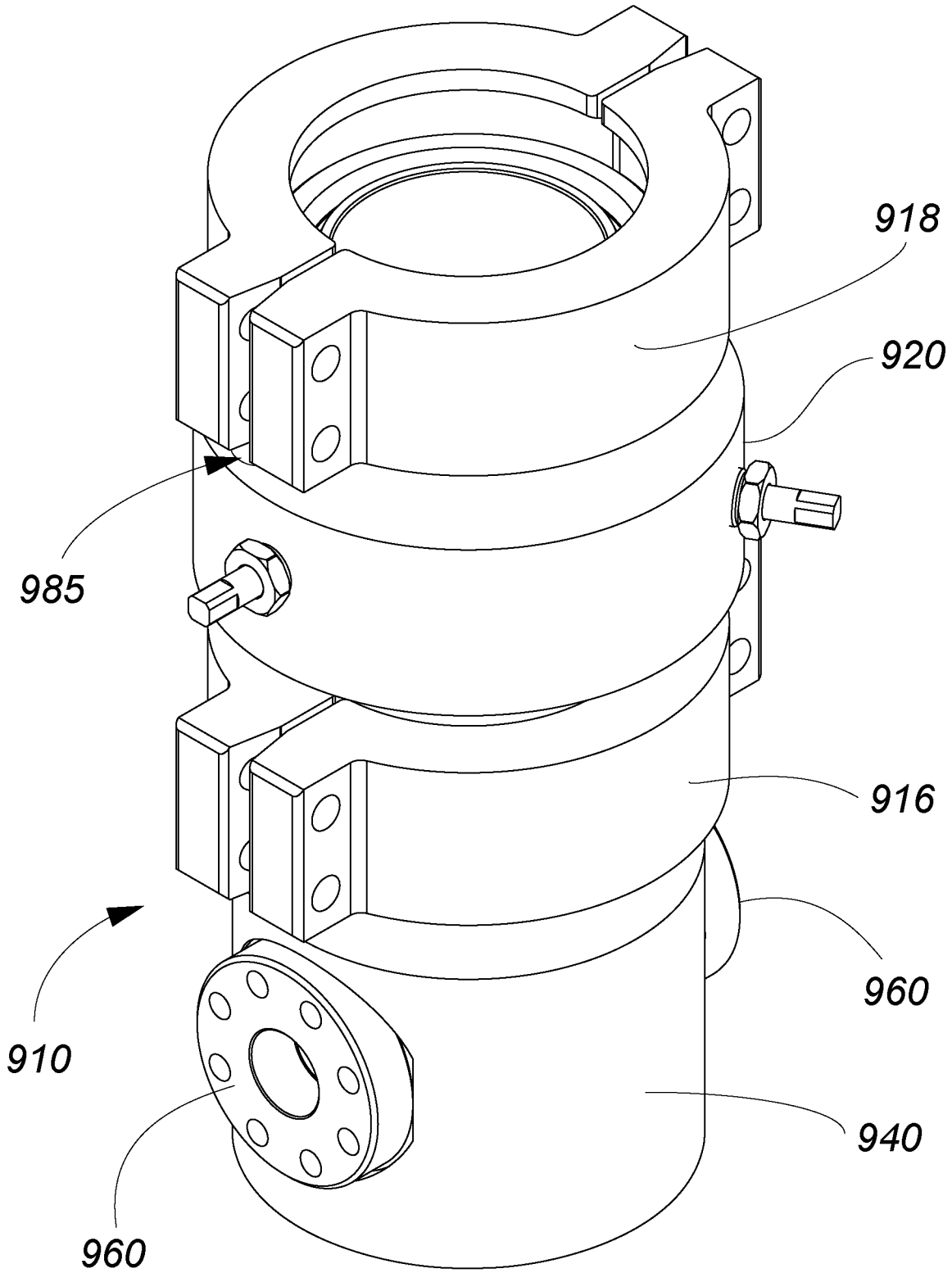
FIG. 73 is an isometric view of a tubing head.
Figure 74:
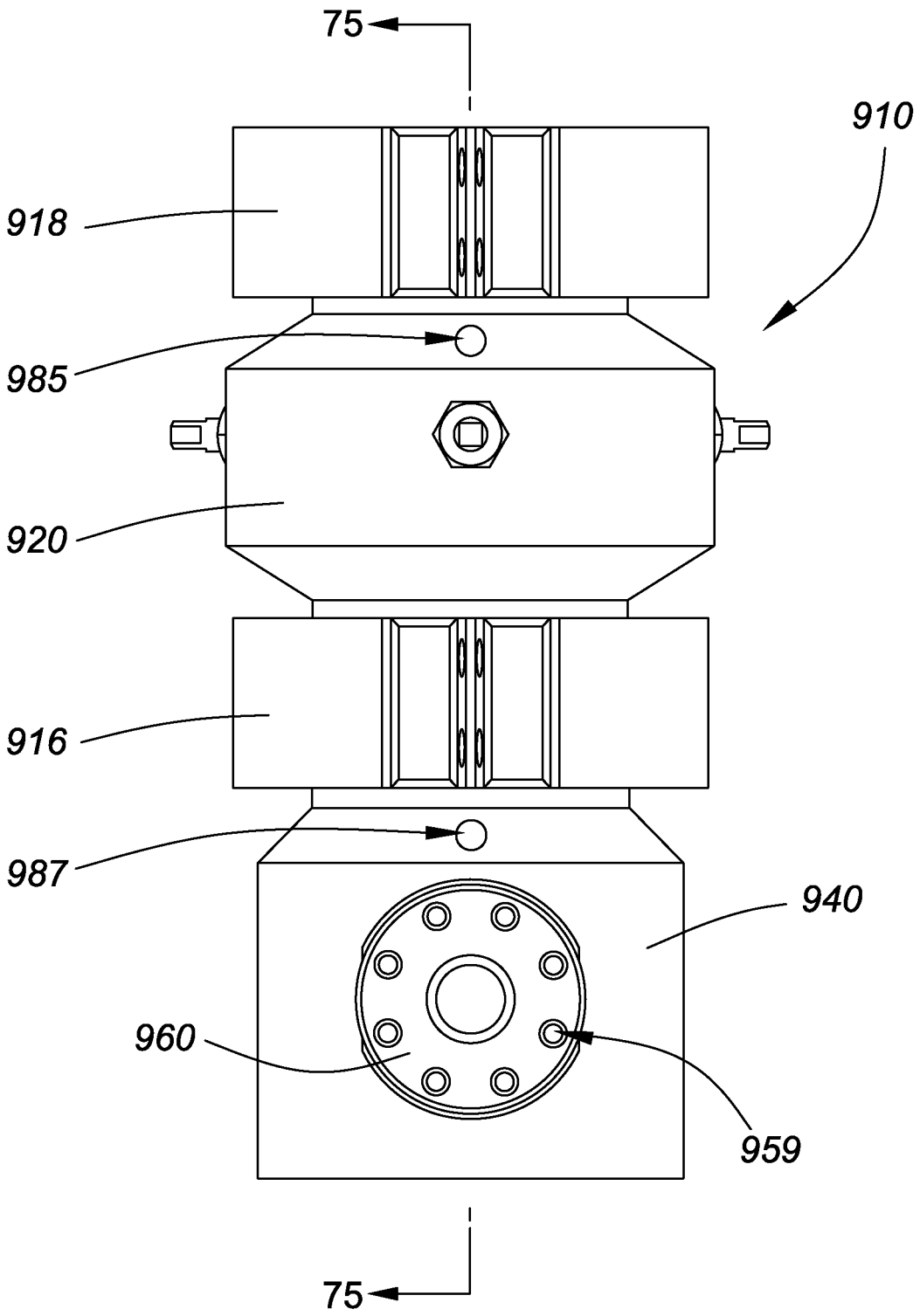
FIG. 74 is an elevation view of the tubing head of FIG. 73.
Figure 75:
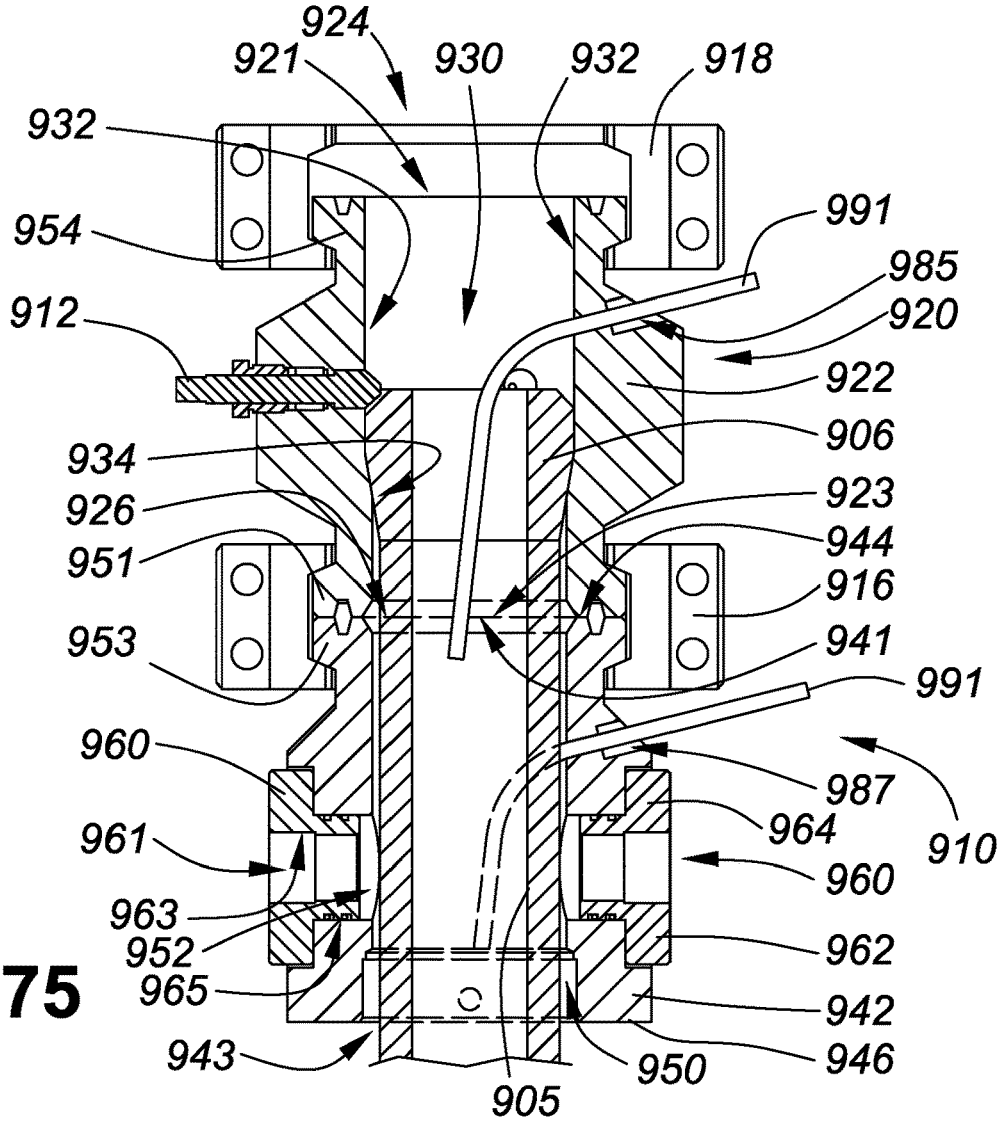
FIG. 75 is a cross section elevation view of the tubing head of FIG. 73.

FIGS. 73 to 75 show a tubing head 910. The tubing head 910 includes the bowl tubular 920 that may be connected with the casing connector 940. A pair of flanged plugs 960 are connected with the casing connector 940. The tubing 905 is hanging from the tubing hanger 906 into the channel 930 and the channel 950. The tubing hanger 906 is hanging from the hanger profile 934. The tubing head 910 includes features providing access by coiled tubing 991 to the tubing 905.

The bowl tubular 920 includes the bowl body 922 extending between the first end 921 and the second end 923. The uphole component connection point 924 is located proximate the first end 921 for connecting with a blowout preventer, Christmas tree or other pressure rated equipment connected with the wellhead. The uphole component connection point 924 includes the uphole component clamping point 954 but any suitable connection point may be used. The first modular connection point 926 is located proximate the second end 923 for connecting the bowl tubular 920 to the casing connector 940. The first modular connection point 926 includes the bowl tubular clamping point 951. Other suitable reversible connection points may be used. When the bowl tubular 920 and the casing connector 940 are connected with each other, o-rings may be received within grooves 925, and shear pins may be threadedly connected with the casing connector 940 into grooves 925 defined in the bowl tubular 920 proximate the second end 923. The set screw 994 may be threaded through the set screw aperture 996 in the casing connector body 942 and into contact with the bowl tubular 920 to maintain additional connections between the casing connector 940 and the bowl tubular 920.

The gripping portion 928 is defined on the bowl body 922 for manipulating the bowl tubular 920 when connecting the bowl tubular 920 with the casing connector 940. A portion of the gripping portion 928 may overlap with the profile 934.

The channel 930 is defined within the bowl body 922. An inside surface 932 of the bowl body 922 is shaped to define the hanger profile 934 in the bowl body 922. The bowl body 922 includes the threaded bores 929 for the lockdown pins 912 to engage the hanger profile when securing the tubing head 910 in a well.

A bowl tubular access port 985 is defined on the bow body 922 for providing an access point for running coiled tubing 991 into the channel 930 or otherwise accessing the channel 930 with additional tools, chemicals or other interventions. The coiled tubing 991 may be run though the bowl tubular access port 985 and into the tubing 905, or may be run into an annulus between the tubing 905 and casing (not shown; similar to the casing 03), or between the tubing 905 and the tubing head 910.

The casing connector 940 includes the connector body 942 extending between the first end 941 and the second end 943. The second modular connection point 944 is located proximate the first end 941 for connecting with the bowl tubular 920. The second modular connection point 944 includes the casing connector clamping point 953, but any suitable reversible connection point may be used. The casing connection point 946 is located proximate the second end 943 for connecting the casing connector 940 to casing. The casing connection point 946 includes a weld surface but any suitable connection point may be used. The channel 950 includes a port near the second end 943 for pressure testing a casing weld.

A casing connector access port 987 is defined on the casing connector body 942 for providing an access point for running coiled tubing 991 into the channel 950 or otherwise accessing the channel 950 with additional tools, chemicals or other interventions. The coiled tubing 991 may be run though the casing connector access port 987 and into an annulus within the channel 950 and between the tubing 905 and casing (not shown; similar to the casing 03), or between the tubing 905 and the tubing head 910. The coiled tubing 991 may be run though the casing connector access port 987 and into the tubing 905 (not shown).

The modular connection clamp 916 engages with the bowl tubular clamping point 951 and with the casing connector clamping point 953 on the casing connector 940, to connect the bowl tubular 920 with the casing connector 940. The bowl tubular clamping point 951 and the casing connector clamping point 953 are each shaped with a cam or other feature to be securely clamped by the modular connection clamp 916 when the modular connection clamp 916 is engaged with both the bowl tubular clamping point 951 and the casing connector clamping point 953. A gasket may be included between the bowl tubular clamping point 951 and the casing connector clamping point 953.

The uphole component connection point clamp 918 engages with the uphole component clamping point 954 and with a clamping point on an uphole component (not shown), for connecting the bowl tubular 920 with the uphole component. The uphole component clamping point 954 and the clamping point on the uphole component are each shaped with a cam or other feature to be securely clamped by the uphole component connection point clamp 918 when the uphole component connection point clamp 918 is engaged with both the bowl tubular clamping point 951 and the clamping point on the uphole component. The uphole component connection point clamp 918 may be an API connecting hub clamp or any suitable clamp. A gasket may be included between the uphole component clamping point 954 and a clamping point on the uphole component.

The channel 950 is defined within the connector body 942, providing a flow path for fluids around tubing hanging through the casing head 910. The ports 952 are defined in the connector body 942 for providing fluid communication between the channel 950 and a flow line connected with the connector body 942. The recessed connection point 948 with the plurality of bolt holes 949 allow flanged connection between the connector body 942 and the flanged adaptor 960.

The flanged plug 960 includes the plug body 962 and the flange 964 having a plurality of bolt holes 959. The channel 961 is defined within the plug body 962 for providing fluid communication with the channel 950. The flange 964 connects with the connector body 942 in this example but any suitable reversible connection may be used. The flow line connection point 963 is defined by the plug body 962 within the channel 961. The flow line connection point 963 is a threaded box end in this example but any suitable reversible connection may be used. The sealing point 965 is included on the plug body 962, and includes grooves for holding o-rings to provide a seal between the plug body 962 and an inside surface of the connector body 942 at the port 952.

Figure 76:
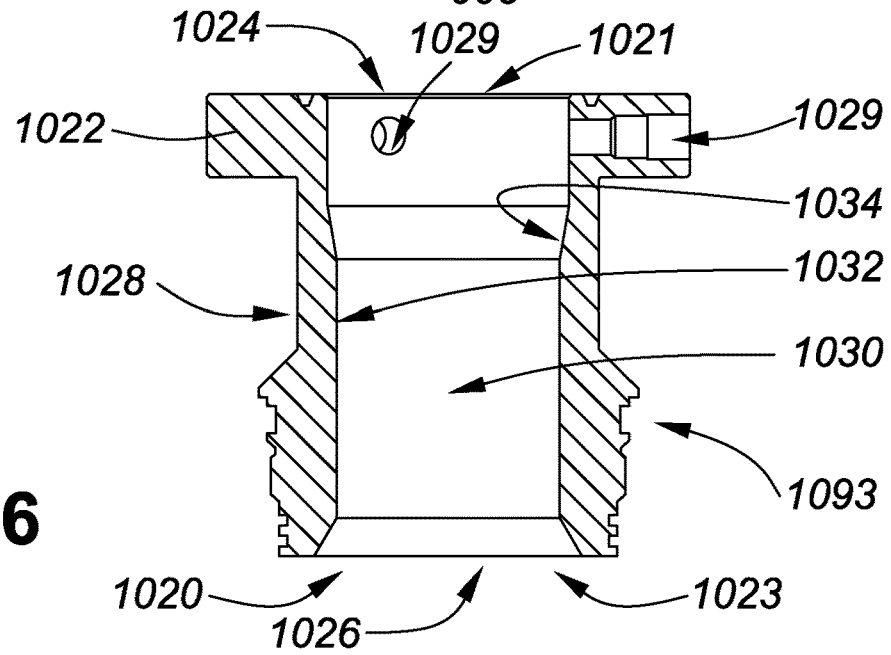
FIG. 76 is a cross section elevation view of a bowl tubular for use in a tubing head.

FIG. 76 is a cross section elevation view of a bowl tubular 1020 for use in a tubing head. The bowl tubular 1020 includes the bowl body 1022 extending between the first end 1021 and the second end 1023. The uphole component connection point 1024 is located proximate the first end 1021 for connecting with a blowout preventer, Christmas tree or other pressure rated equipment connected with the wellhead. The uphole component connection point 1024 but any suitable connection point may be used. The first modular connection point 1026 is located proximate the second end 1023 for connecting the bowl tubular 1020 to a casing connector. The first modular connection point 1026 includes a threaded pin end but any suitable reversible connection point may be used.

When the bowl tubular 1020 and the casing connector are connected with each other, o-rings may be received within grooves 1025, and shear pins may be threadedly connected with the casing connector 1040 into grooves 1025 defined in the bowl tubular 1020 proximate the second end 1023. In addition, set screws may be threaded through the casing connector into contact with the bowl tubular 1020 to maintain additional connections between the casing connector and the bowl tubular 1020.

The gripping portion 1028 is defined on the bowl body 1022 for manipulating the bowl tubular 1020 when connecting the bowl tubular 1020 with the casing connector 1040. A portion of the gripping portion 1028 may overlap with the profile 1034.

A channel 1030 is defined within the bowl body 1022. An inside surface 1032 of the bowl body 1022 is shaped to define a hanger profile 1034 in the bowl body 1022. The hanger profile 1034 is shaped to receive a well tubular hanger with a matching profile on an outside surface of the well tubular hanger.

Figure 77:
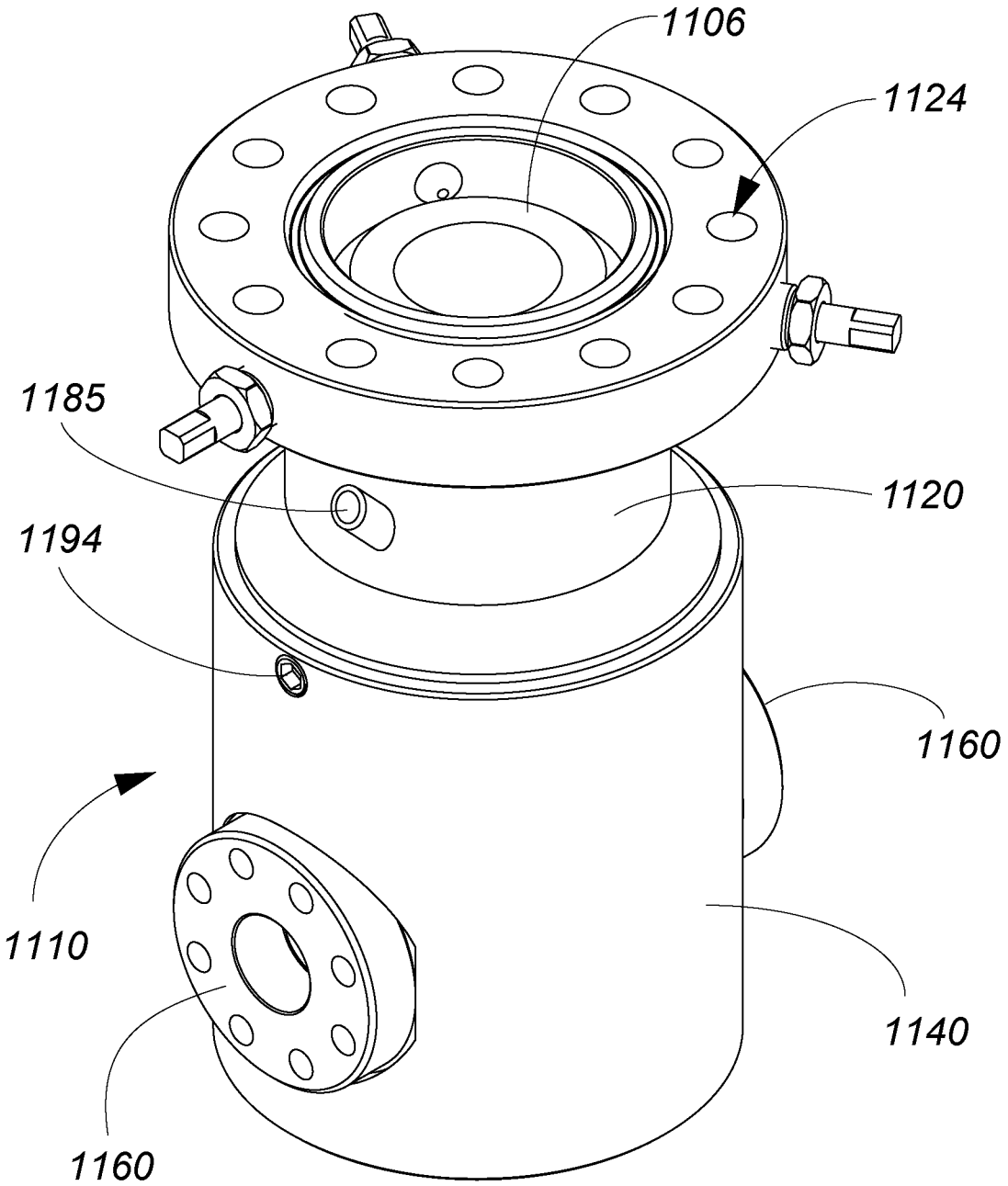
FIG. 77 is an isometric view of a tubing head.
Figure 78:
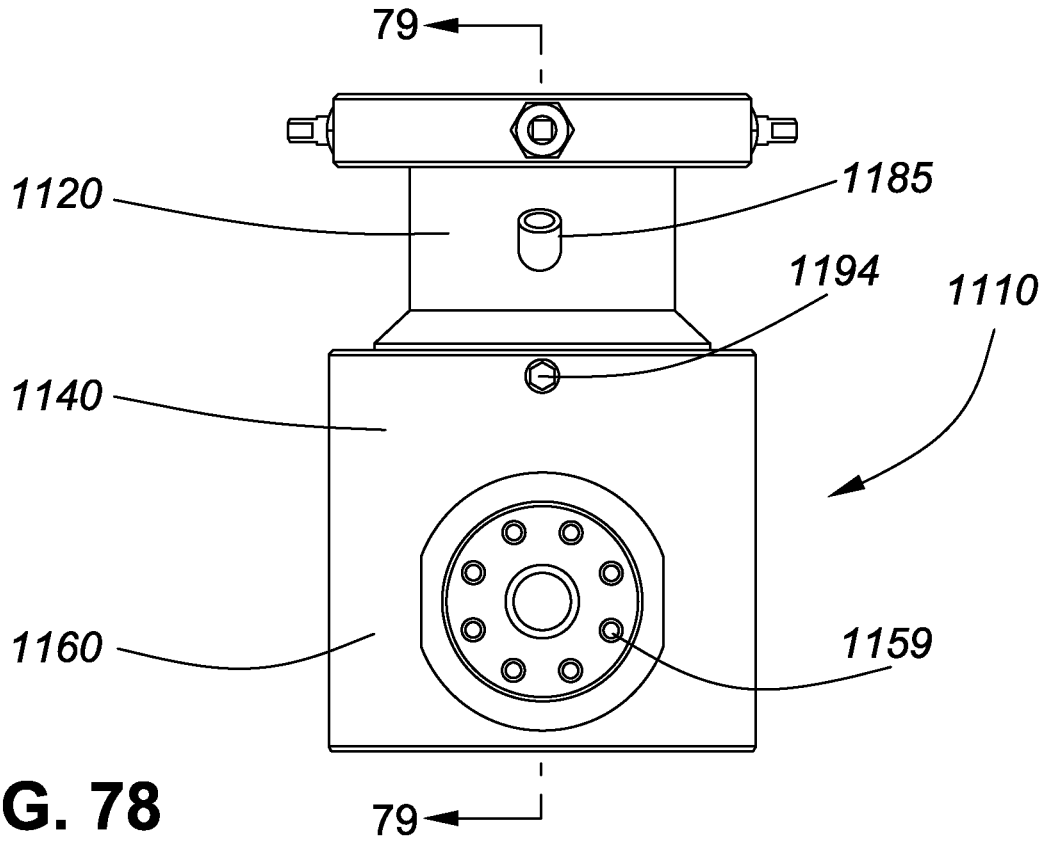
FIG. 78 is an elevation view of the tubing head of FIG. 77.
Figure 79:
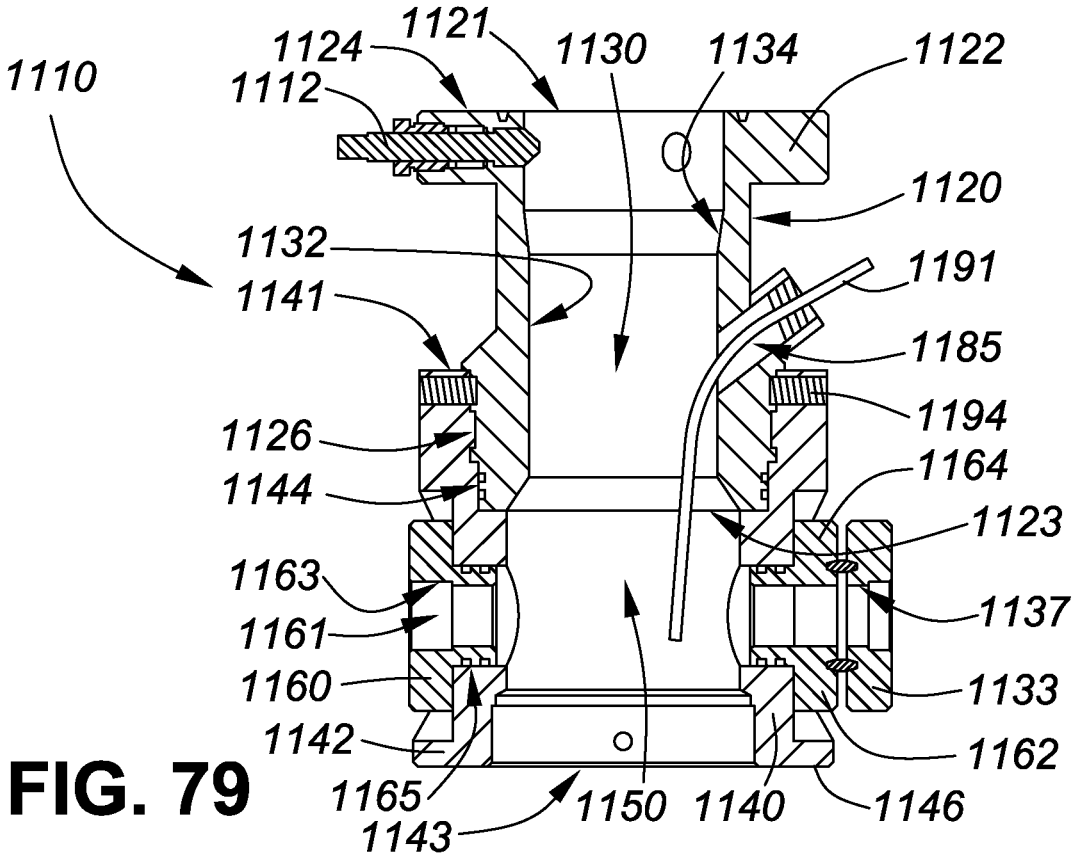
FIG. 79 is a cross section elevation view of the tubing head of FIG. 77.

FIGS. 77 to 79 show a tubing head 1110. The tubing head 1110 includes the bowl tubular 1120 that may be connected with the casing connector 1140. A pair of flanged plugs 1160 are connected with the casing connector 1140. The tubing head 1110 includes features providing access by coiled tubing 1191 to the tubing 1105 or to the channel 1130 and the channel 1150.

Figure 80:
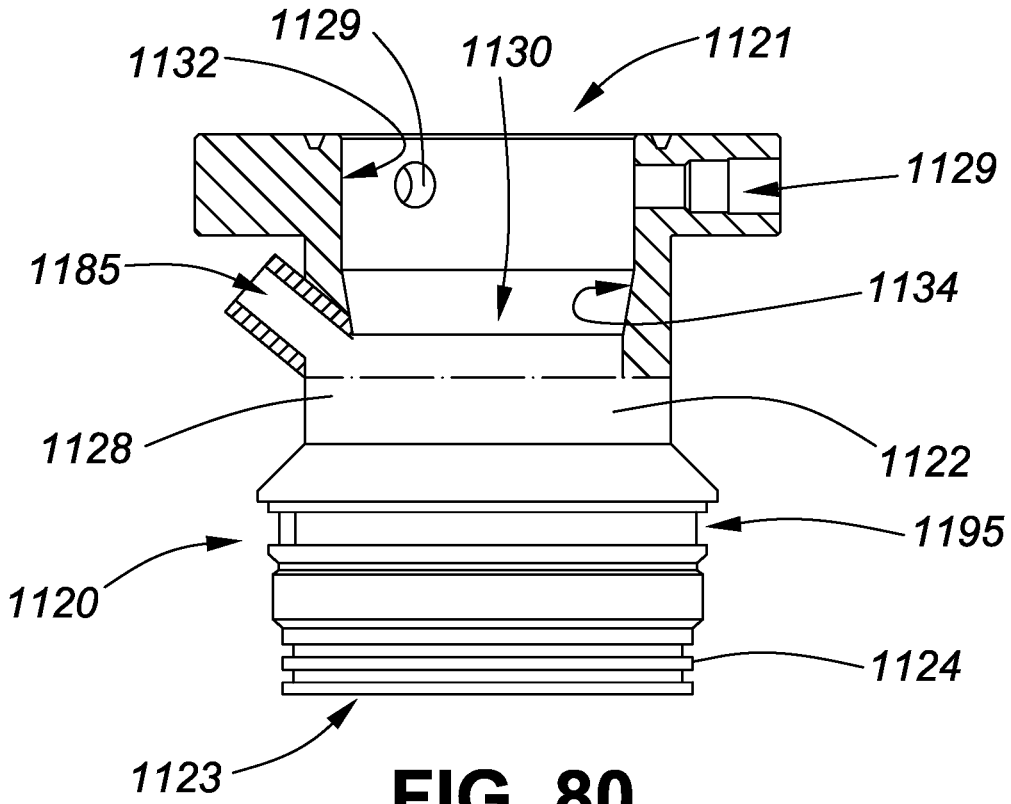
FIG. 80 is an elevation view of a bowl tubular of the tubing head of FIG. 77 showing interior details.
Figure 81:
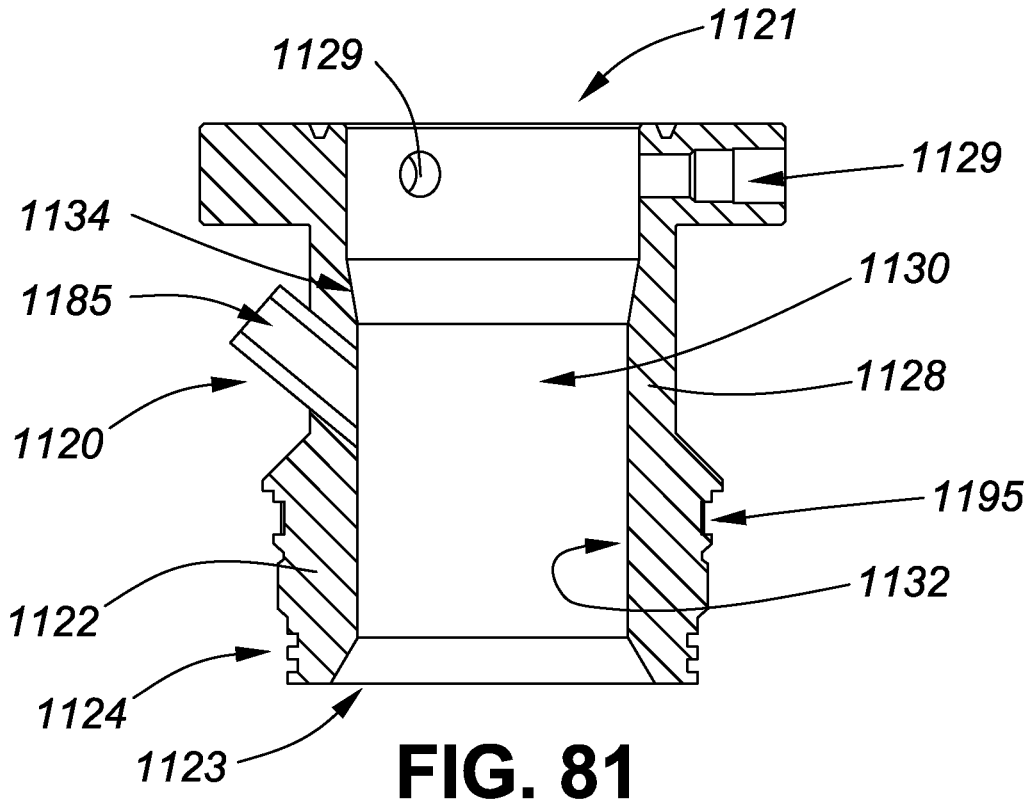
FIG. 81 is a cross section elevation view of the bowl tubular of FIG. 80.

FIGS. 80 and 81 show the bowl tubular 1120. The bowl tubular 1120 includes the bowl body 1122 extending between the first end 1121 and the second end 1123. The uphole component connection point 1124 is located proximate the first end 1121 for connecting with a blowout preventer, Christmas tree or other pressure rated equipment connected with the wellhead. The uphole component connection point 1124 includes a flange but any suitable connection point may be used. The first modular connection point 1126 is located proximate the second end 1123 for connecting the bowl tubular 1120 to the casing connector 1140. The first modular connection point 1126 includes a threaded pin end but any suitable reversible connection point may be used. When the bowl tubular 1120 and the casing connector 1140 are connected with each other, o-rings may be received within grooves 1125, and shear pins may be threadedly connected with the casing connector 1140 into grooves 1125 defined in the bowl tubular 1120 proximate the second end 1123. The set screw 1194 may be threaded through the set screw aperture 1196 in the casing connector body 1142 and into contact with the bowl tubular 1120 to maintain additional connections between the casing connector 1140 and the bowl tubular 1120. The set screw 1194 contacts the bowl tubular at a notch 1195, which in contrast to the groove 1093 of the bowl tubular 1020, does not extend around the circumference of the bowl body 1122 to any large degree.

The gripping portion 1128 is defined on the bowl body 1122 for manipulating the bowl tubular 1120 when connecting the bowl tubular 1120 with the casing connector 1140. A portion of the gripping portion 1128 may overlap with the profile 1134.

The channel 1130 is defined within the bowl body 1122. An inside surface 1132 of the bowl body 1122 is shaped to define the hanger profile 1134 in the bowl body 1122. The bowl body 1122 includes the threaded bores 1129 for the lockdown pins 1112 to engage the hanger profile when securing the tubing head 1110 in a well.

The bowl tubular access port 1185 is defined on the bow body 1122 for providing an access point for running coiled tubing 1191 into the channel 1130 or otherwise accessing the channel 1130 with additional tools, chemicals or other interventions. The coiled tubing 1191 may be run though the bowl tubular access port 1185 and into the tubing (not shown; similar to the tubing 905), or may be run into an annulus between the tubing and casing (not shown; similar to the casing 03), or between the tubing and the tubing head 1110.

Figure 82:
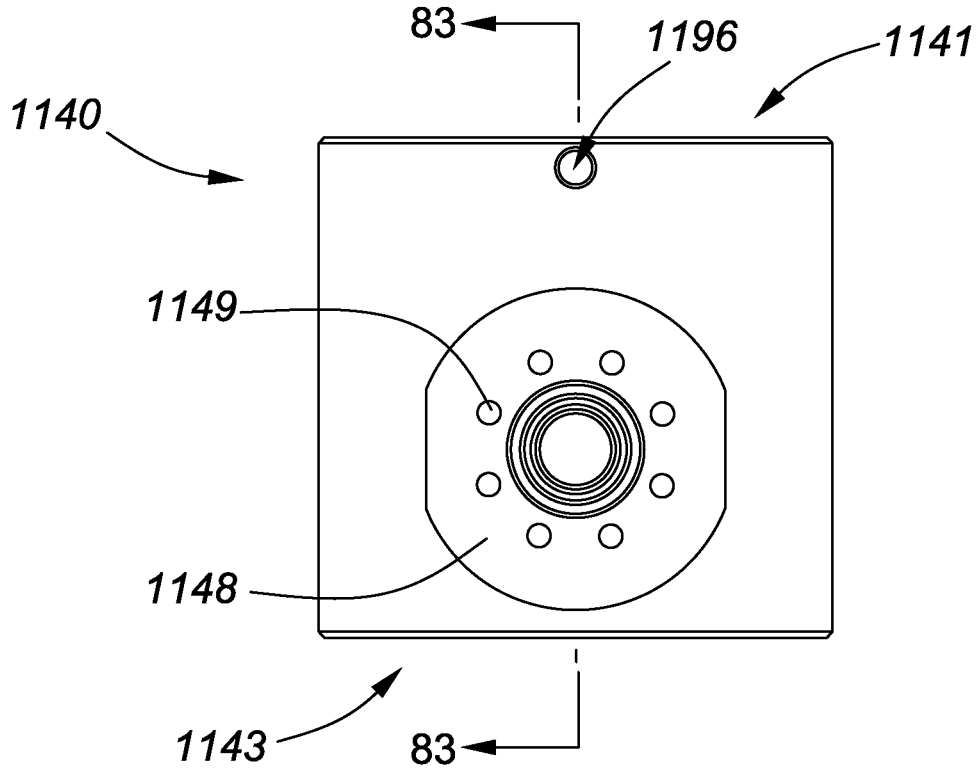
FIG. 82 is an elevation view of a casing connector of the bowl tubular of FIG. 80.
Figure 83:
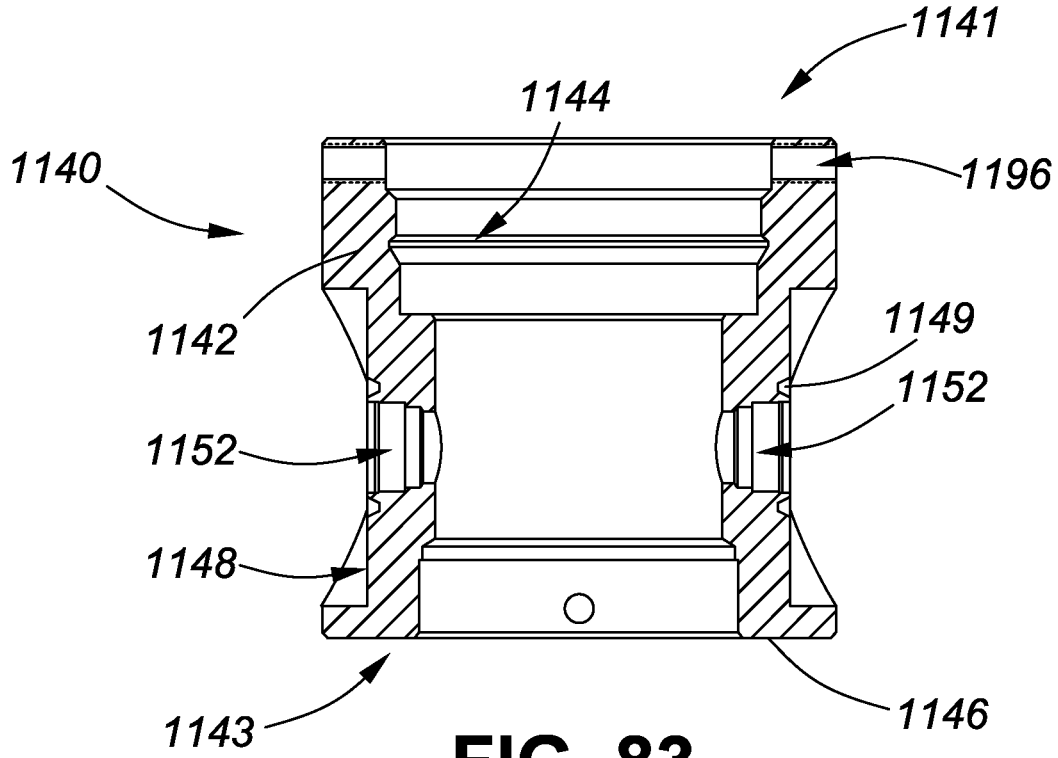
FIG. 83 is a cross section elevation view of a casing connector of FIG. 82.

FIGS. 82 and 83 show various views of the casing connector 1140. The casing connector 1140 includes the connector body 1142 extending between the first end 1141 and the second end 1143. The second modular connection point 1144 is located proximate the first end 1141 for connecting with the bowl tubular 1120. The second modular connection point 1144 includes a threaded box end but any suitable connection reversible point may be used. The casing connection point 1146 is located proximate the second end 1143 for connecting the casing connector 1140 to casing. The casing connection point 1146 includes a weld surface but any suitable connection point may be used. The channel 1150 includes a port near the second end 1143 for pressure testing a casing weld.

The channel 1150 is defined within the connector body 1142, providing a flow path for fluids around tubing hanging through the casing head 1110. The ports 1152 are defined in the connector body 1142 for providing fluid communication between the channel 1150 and a flow line connected with the connector body 1142. The recessed connection point 1148 with the plurality of bolt holes 1149 allows flanged connection between the connector body 1142 and the flanged adaptor 1160.

The flanged plug 1160 includes the plug body 1162 and the flange 1164 having a plurality of bolt holes 1159. The channel 1161 is defined within the plug body 1162 for providing fluid communication with the channel 1150. The flange 1164 connects with the connector body 1142 in this example but any suitable reversible connection may be used. The flow line connection point 1163 is defined by the plug body 1162 within the channel 1161. The flow line connection point 1163 is a threaded box end in this example but any suitable reversible connection may be used. The sealing point 1165 is included on the plug body 1162, and includes grooves for holding o-rings to provide a seal between the plug body 1162 and an inside surface of the connector body 1142 at the port 1152.

One of the two flanged plugs 1160 includes a removable connection point adaptor 1133 with a modular flow line connection point 1137. The removable connection point adaptor 1133 may be connected with the flange 1164 through bolts and sealed with an o-ring, such as an API RTJ groove. The removable connection point adaptor 1133 may also be connected through a threaded connection with the flow line connection point 1163 or through any suitable connection. The channel 1161 on the flanged plug 1160 including the removable connection point adaptor 1133 extends through the removable connection point adaptor 1133.

Figure 84:
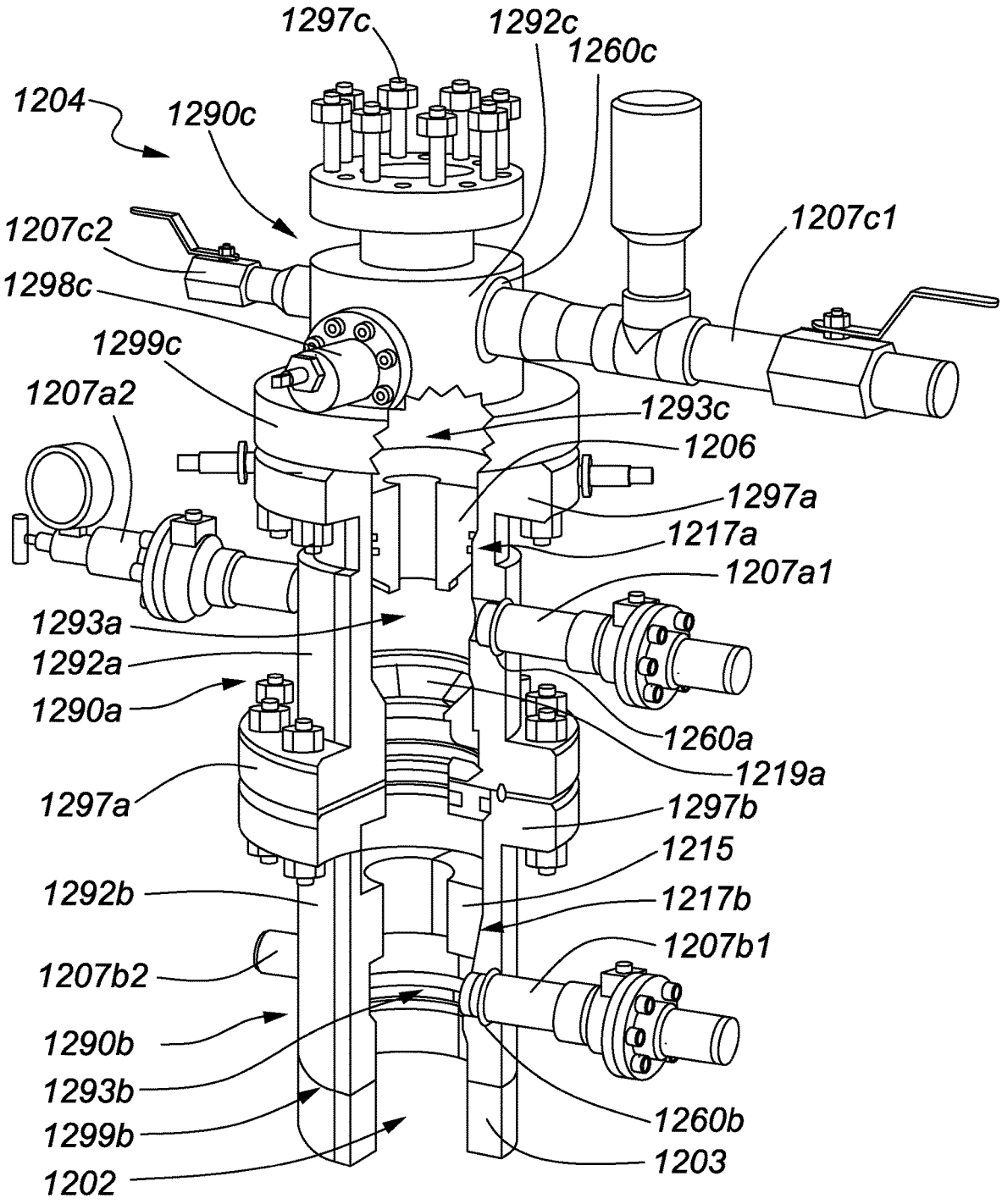
FIG. 84 is a blowout preventer including removable flow lines.

FIG. 84 shows an uphole equipment stack 1204. The uphole equipment stack 1204 includes six connection points for flow lines 1207. The connection points include removable connection points, in this example, flanged plugs 1260. The flanged plugs 1260 are located in three different examples of the flow line connector 1290. References to the flow line connectors 1290 being downhole or uphole of each other are relative as each of the flow line connectors 1290 are uphole components of the equipment stack 1204 in the sense that they are located above grade, and above the wellbore 1202.

A first flow line connector 1290*a* includes the first flow line connector body 1292*a* that includes features to serve the purpose of a unitary-body tubing bowl. The first flow line connector body 1292*a* extends between the first uphole component connection point 1297*a* and a second uphole component connection point 1299*a*. The first channel 1293*a* is defined through the first flow line connector body 1292*a*. The first flow line connector body 1292*a* defines a hanger profile 1217*a* inside the channel 1293*a* from which the tubing hanger 1206 is hanging. Tubing, such as tubing 05, is not shown in FIG. 84 to simplify the drawing.

The flanged plug 1260*a* is connected with the first flow line connector body 1292*a*. A flow line 1207*a*1 is connected with the removable connection point 1260*a*. A flow line 1207*a*2 is also connected with the first flow line connector body 1292*a*. The connection between the flow line 1207*a*2 and the first flow line connector body 1292*a* is not shown in FIG. 84. The connection between the flow line 1207*a*2 and the first flow line connector body 1292*a* may be a removable connection point, such as the removable connection point 1260*a* or any suitable removable connection point, or through an integral connection point, such as the integral connection point 156 or any suitable integral connection point. Casing slips 1219*a* are located inside the channel 1293*a*.

The first uphole component connection point 1297*a* may be connected with an uphole component that is located uphole relative to the first flow line connector 1290*a*, such as the third flow line connector 1290*c*. The second uphole component connection point 1299*a* may be connected with a second uphole component that is located downhole relative to the first flow line connector body 1292*a*, such as the second flow line connector 1290*b*. The first flow line connector body 1292*a* is shown with flanged connectors at both the first uphole component connection point 1297*a* and the second uphole component connection point 1299*a*, although any suitable connection points may be used.

A second flow line connector 1290*b* includes the second flow line connector body 1292*b* that includes features to serve the purpose of a unitary-body casing bowl. The second flow line connector body 1292*b* extends between the first uphole component connection point 1297*b* and a second uphole component connection point 1299*b*. The second channel 1293*b* is defined through the second flow line connector body 1292*b*. The second flow line connector body 1292*b* defines a hanger profile 1217*b* inside the channel 1293*b* from which the casing hanger 1215 is hanging. Second casing within the casing 1203, such as the second set of casing 113, is not shown in FIG. 84 to simplify the drawing.

The flanged plug 1260*b* is connected with the second flow line connector body 1292*b*. A flow line 1207*b*1 is connected with the removable connection point 1260*b*. A flow line 1207*b*2 is also connected with the second flow line connector body 1292*b*. The connection between the flow line 1207*b*2 and the second flow line connector body 1292*b* is not shown in FIG. 84. The connection between the flow line 1207*b*2 and the second flow line connector body 1292*b* may be a removable connection point, such as the removable connection point 1260*b* or any suitable removable connection point, or through an integral connection point, such as the integral connection point 156 or any suitable integral connection point.

The first uphole component connection point 1297*b* may be connected with an uphole component that is located uphole relative to the second flow line connector body 1292*b*, such as the first flow line connector 1290*a*. The second uphole component connection point 1299*b* may be connected with a second uphole component that is located downhole relative to the second flow line connector body 1292*b*, such as the casing 1203. The second flow line connector body 1292*b* is shown with a flanged connectors at the first uphole component connection point 1297*b* and a weld surface for the casing 1203 at the second uphole component connection point 1299*b*, although any suitable connection points may be used.

A third flow line connector 1290*c* includes the first flow line connector body 1292*c* that includes features to serve the purpose of a blowout preventer. The third flow line connector body 1292*c* extends between a first uphole component connection point 1297*c* and a second uphole component connection point 1299*c*. The third channel 1293*c* is defined through the third flow line connector body 1292*c*. The third flow line connector 1290*c* includes a ram 1298*c* in communication with the third channel 1293*c* for preventing blowouts.

The flanged plug 1260*c* is connected with the third flow line connector body 1292*c*. A flow line 1207*c*1 is connected with the removable connection point 1260*c*. A flow line 1207*c*2 is also connected with the third flow line connector body 1292*c*. The connection between the flow line 1207*c*2 and the third flow line connector body 1292*c* is not shown in FIG. 84. The connection between the flow line 1207*c*2 and the third flow line connector body 1292*c* may be a removable connection point, such as the removable connection point 1260*c* or any suitable removable connection point, or through an integral connection point, such as the integral connection point 156 or any suitable integral connection point.

The second uphole component connection point 1299*c* may be connected with a second uphole component that is located downhole relative to the third flow line connector body 1292*c*, such as the first flow line connector 1290*a*. The third flow line connector body 1292*c* is shown with flanged connectors at the second uphole component connection point 1299*c*, although any suitable connection points may be used.

Subject to the presence of additional casing (not shown) or tubing (not shown), the first channel 1293*a*, the second channel 1293*b* and the third channel 1293*c* are in fluid communication, providing one flow path for fluids from the wellbore 1202 to pass through the uphole equipment stack 1204.

Figure 85:
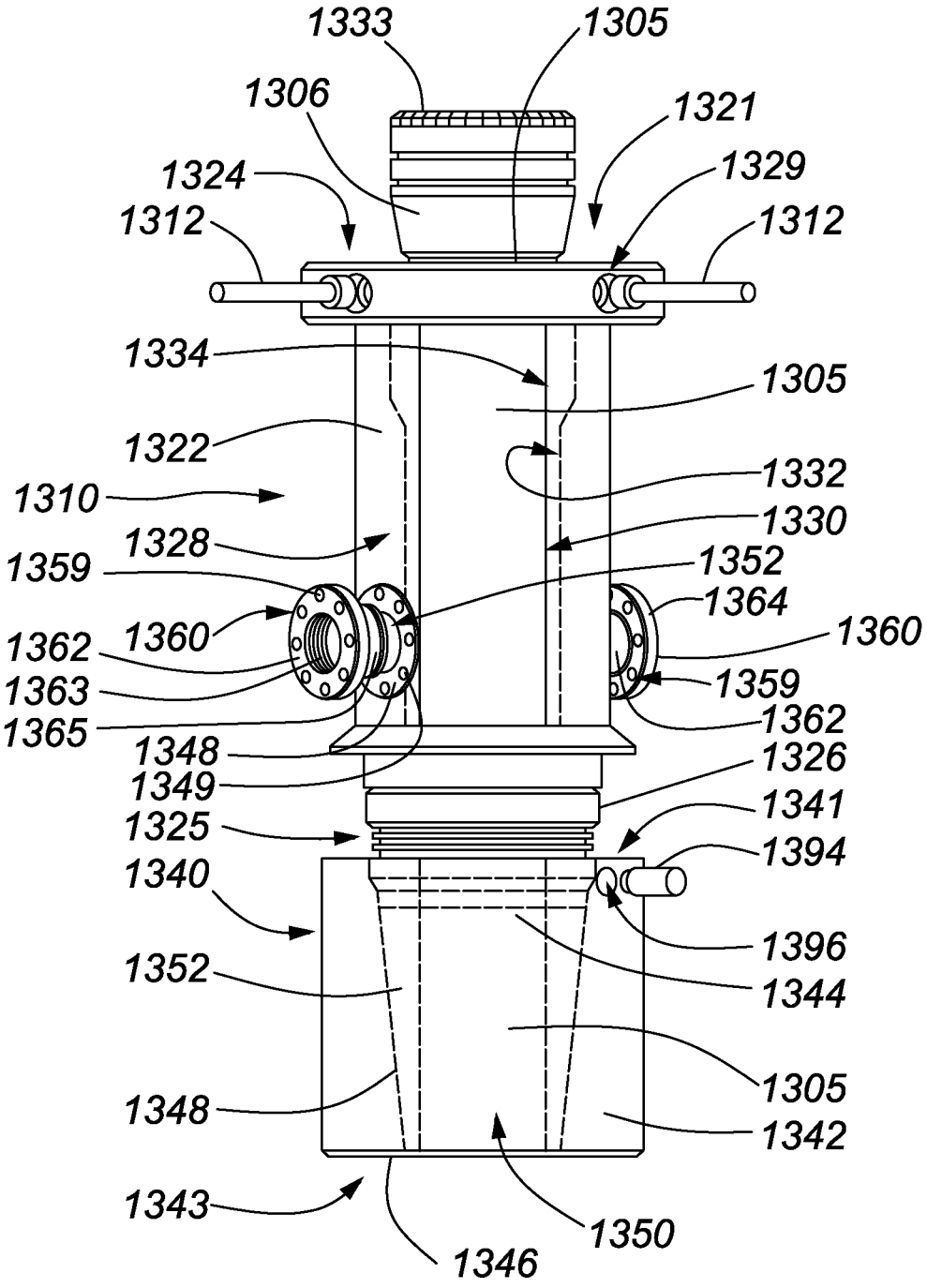
FIG. 85 is a schematic exploded view of a tubing head.

FIG. 85 is a schematic exploded view of a tubing head 1310. The tubing head 1310 includes the bowl tubular 1320 that may be connected with the casing connector 1340. A pair of flanged plugs 1360 are connected with the bowl tubular 1320.

The bowl tubular 1320 includes the bowl body 1322 extending between the first end 1321 and the second end 1323. The uphole component connection point 1324 is located proximate the first end 1321 for connecting with a blowout preventer, Christmas tree or other pressure rated equipment connected with the wellhead. The uphole component connection point 1324 includes a flange but any suitable connection point may be used. The first modular connection point 1326 is located proximate the second end 1323 for connecting the bowl tubular 1320 to the casing connector 1340. The first modular connection point 1326 includes a threaded pin end but any suitable reversible connection point may be used. When the bowl tubular 1320 and the casing connector 1340 are connected with each other, o-rings may be received within grooves 1325, and shear pins may be threadedly connected with the casing connector 1340 into grooves 1325 defined in the bowl tubular 1320 proximate the second end 1323. The set screw 1394 may be threaded through the set screw aperture 1396 in the casing connector body 1342 and into contact with the bowl tubular 1320 to maintain additional connections between the casing connector 1340 and the bowl tubular 1320.

The gripping portion 1328 is defined on the bowl body 1322 for manipulating the bowl tubular 1320 when connecting the bowl tubular 1320 with the casing connector 1340. A portion of the gripping portion 1328 may overlap with the profile 1334.

The channel 1330 is defined within the bowl body 1322. An inside surface 1332 of the bowl body 1322 is shaped to define the hanger profile 1334 in the bowl body 1322. The bowl body 1322 includes the threaded bores 1329 for the lockdown pins 1312 to engage the hanger profile when securing the tubing head 1310 in a well.

The casing connector 1340 includes the connector body 1342 extending between the first end 1341 and the second end 1343. The second modular connection point 1344 is located proximate the first end 1341 for connecting with the bowl tubular 1320. The second modular connection point 1344 includes a threaded box end but any suitable connection reversible point may be used. The casing connection point 1346 is located proximate the second end 1343 for connecting the casing connector 1340 to casing. The casing connection point 1346 includes a weld surface but any suitable connection point may be used.

The channel 1350 is defined within the connector body 1342, providing a flow path for fluids around tubing hanging through the casing head 1310. The ports 1352 are defined in the bowl body 1322 for providing fluid communication between the channel 1330 and a flow line connected with the connector body 1342. The recessed connection point 1348 with the plurality of bolt holes 1349 allow flanged connection between the bowl body 1322 and the flanged plug 1360.

The flanged plug 1360 includes the plug body 1362 and the flange 1364 having a plurality of bolt holes 1359. The channel 1361 is defined within the plug body 1362 for providing fluid communication with the channel 1330. The flange 1364 connects with the connector body 1342 in this example but any suitable reversible connection may be used. The flow line connection point 1363 is defined by the plug body 1362 within the channel 1361. The flow line connection point 1363 is a threaded box end in this example but any suitable reversible connection may be used. The sealing point 1365 is included on the plug body 1362, and includes grooves for holding o-rings to provide a seal between the plug body 1362 and an inside surface of the bowl body 1322 at the port 1352.

Figure 86:
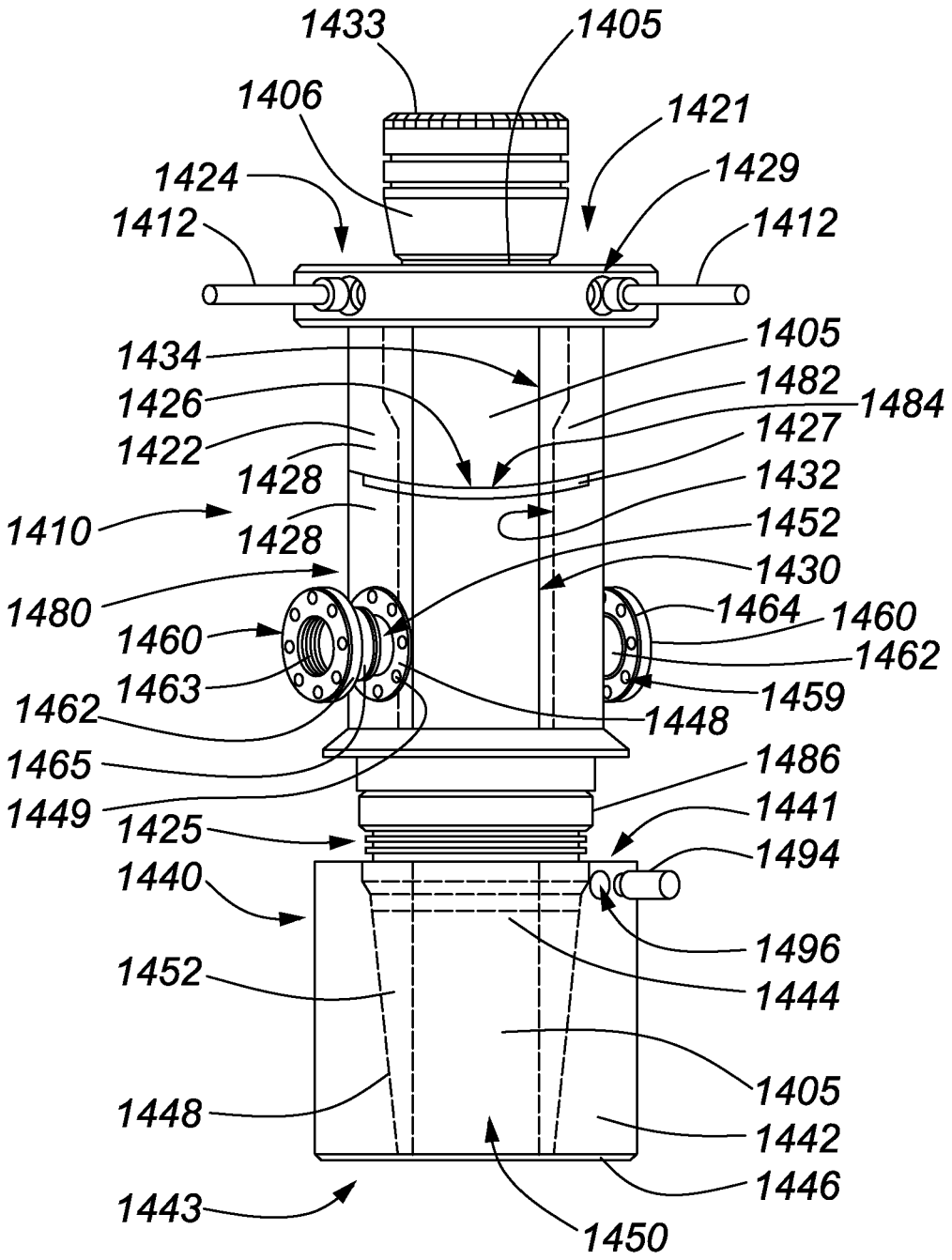
FIG. 86 is a schematic exploded view of a tubing head.

FIG. 86 is a schematic exploded view of a tubing head 1410. The tubing head 1410 includes the bowl tubular 1420 that may be connected with the adaptor tubular 1480, which may in turn be connected with the casing connector 1440. A pair of flanged plugs 1460 are connected with the adaptor tubular 1480.

The bowl tubular 1420 includes the bowl body 1422 extending between the first end 1421 and the second end 1423. The uphole component connection point 1424 is located proximate the first end 1421 for connecting with a blowout preventer, Christmas tree or other pressure rated equipment connected with the wellhead. The uphole component connection point 1424 includes a flange but any suitable connection point may be used. The first modular connection point 1426 is located proximate the second end 1423 for connecting the bowl tubular 1420 with the adaptor tubular 1480. The first modular connection point 1426 includes a threaded pin end but any suitable reversible connection point may be used.

The adaptor tubular 1480 includes the adaptor body 1482 extending between the first end 1481 and the second end 1483. The channel 1488 is defined within the adaptor body 1482 for providing fluid communication between the channel 1430 and the channel 1450. The casing connector connection point 1486, in this example a threaded pin end but any suitable reversible connection point may be used, is located proximate the second end 1483 for connecting with the casing connector 1440. The bowl tubular connector point 1484, in this case a groove in the adaptor body 1482 to receive the ring 1427 but any suitable reversible connection point may be used, is located proximate the first end 1481 for connecting with the first modular connection point 1426. The ports 1452 are defined in the adaptor body 1482 for providing fluid communication between the channel 1488 and a flow line connected with the adaptor body 1482. The recessed connection point 1488 with the plurality of bolt holes 1489 allow flanged connection between the adaptor body 1482 and the flanged plug 1460.

When the bowl tubular 1420 is connected with the adaptor tubular 1480, the groove in the adaptor body 1482 receives the ring 142. When the adaptor tubular 1480 is connected with the casing connector 1440, o-rings may be received within grooves 1425, and shear pins may be threadedly connected with the casing connector 1440 into grooves 1425 defined in the adaptor tubular 1480 proximate the second end 1423. The set screw 1494 may be threaded through the set screw aperture 1496 in the casing connector body 1442 and into contact with the adaptor tubular 1480 to maintain additional connections between the casing connector 1440 and the adaptor tubular 1480.

The gripping portion 1428 is defined on the bowl body 1422 and on the adaptor body 1482, for manipulating the bowl tubular 1420 when connecting the bowl tubular 1420 with the casing connector 1440. A portion of the gripping portion 1428 may overlap with the profile 1434.

The channel 1430 is defined within the bowl body 1422. An inside surface 1432 of the bowl body 1422 is shaped to define the hanger profile 1434 in the bowl body 1422. The bowl body 1422 includes the threaded bores 1429 for the lockdown pins 1412 to engage the hanger profile when securing the tubing head 1410 in a well.

The casing connector 1440 includes the connector body 1442 extending between the first end 1441 and the second end 1443. The second modular connection point 1444 is located proximate the first end 1441 for connecting with the bowl tubular 1420. The second modular connection point 1444 includes a threaded box end but any suitable connection reversible point may be used. The casing connection point 1446 is located proximate the second end 1443 for connecting the casing connector 1440 to casing. The casing connection point 1446 includes a weld surface but any suitable connection point may be used. The channel 1450 is defined within the connector body 1442, providing a flow path for fluids around tubing hanging through the casing head 1410.

The flanged plug 1460 includes the plug body 1462 and the flange 1464 having a plurality of bolt holes 1459. The channel 1461 is defined within the plug body 1462 for providing fluid communication with the channel 1450. The flow line connection point 1463 is defined by the plug body 1462 within the channel 1461. The flow line connection point 1463 is a threaded box end in this example. The flow line connection point 1463 is a threaded box end in this example but any suitable reversible connection may be used. The sealing point 1465 is included on the plug body 1462, and includes grooves for holding o-rings to provide a seal between the plug body 1462 and an inside surface of the adaptor body 1482 at the port 1452.

EXAMPLES ONLY

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

What is claimed is:

1. A modular well tubular head comprising:

a bowl tubular for connecting with an uphole component, the bowl tubular comprising a bowl body;

a casing connector for reversibly connecting with the bowl tubular and for sealingly connecting with casing, the casing connector comprising a connector body, wherein a flow path is defined through the connector body and the bowl body;

a casing connector port defined in the connector body for providing fluid communication between the flow path and a flow line;

a removable connection point reversibly connected with the connector body at the casing connector port, the removable connection point for connecting with the flow line; and a rotation drive;

wherein the bowl tubular comprises an uphole component connection point on the bowl body for connecting with the uphole component, a first modular connection point on the bowl body for reversibly connecting with the casing connector, and a hanger profile defined on an inside surface of the bowl body, wherein the hanger profile is configured to support a tubing hanger and tubing string;

the casing connector comprises a casing connection point on the connector body for sealingly connecting with the casing, and a second modular connection point on the connector body for reversibly connecting with the bowl body; and the rotation drive is connected with the bowl body for rotating the tubing string hanging on the hanger profile.

2. The well tubular head of claim 1 further comprising a bowl tubular extended gripping surface on the bowl body for gripping with power tongs.

3. The well tubular head of claim 1 further comprising a bowl tubular port defined in the bowl body for providing fluid communication between the flow path and a flow line.

4. The well tubular head of claim 3 further comprising a removable connection point connected with the bowl body at the bowl tubular port.

5. The well tubular head of claim 1 further comprising a bowl tubular access port defined in the bowl body for establishing fluid communication between the flow path and coiled tubing.

6. The well tubular head of claim 1 further comprising a casing connector extended gripping surface on the connector body for gripping with power tongs.

7. The well tubular head of claim 1 further comprising a casing connector access port defined in the connector body for establishing fluid communication between the flow path and coiled tubing.

8. The well tubular head of claim 1, further comprising an adaptor tubular connected with the bowl, body and with the connector body, and wherein the flow path is further defined through the adaptor tubular.

9. The well tubular head of claim 8 further comprising an adaptor extended gripping surface on the adaptor tubular for gripping with power tongs.

10. The well tubular head of claim 8 further comprising an adaptor port defined in the adaptor tubular for providing fluid communication between the flow path and a flow line.

11. The well tubular head of claim 10 further comprising a removable connection point connected with the adaptor tubular at the adaptor port.

12. The well tubular head of claim 8 further comprising an adaptor access port defined in the adaptor tubular for establishing fluid communication between the flow path and coiled tubing.

13. The well tubular head of claim 1 wherein the hanger profile is configured to support a casing hanger and casing string.

14. The well tubular head of claim 1 wherein the flow path has a uniform inside diameter through the connector body.

15. The well tubular head of claim 1 wherein an inside diameter of the flow path within the connector body is equal to an inside diameter of the casing.

16. The well tubular head of claim 1, wherein the removable connection point comprises a plurality of bolt holes for connecting with the connector body and a threaded box end for connecting with the flow line.

17. The well tubular head of claim 16, wherein the removable connection point comprises a flanged plug or a flanged ring.

18. The well tubular head of claim 1, wherein the casing connector does not include a hanger profile defined on an inside surface of the casing connector.

19. A method of establishing fluid communication with a well including casing, the method comprising:

sealingly securing a casing connector to the casing;

reversibly connecting a bowl tubular having a hanger profile with the casing connector;

providing a flow path from the casing, through the casing connector and through the bowl tubular;

wherein the casing connector comprises a casing connector port defined in the casing connector for providing fluid communication between the flow path and a flow line;

providing a removable connection point reversibly connected with the casing connector at the casing connector port, the removable connection point for connecting with the flow line; and receiving a string through the casing connector and the bowl tubular, the string having a hanger profiled to match the hanger profile, wherein the string comprises a tubing string, wherein the bowl tubular comprises a rotation drive for rotating the tubing string.

20. The method of claim 19, wherein the removable connection point comprises a plurality of bolt holes for connecting with the connector body and a threaded box end for connecting with the flow line.

21. The method of claim 20, wherein the removable connection point comprises a flanged plug or a flanged ring.

22. The method of claim 19, wherein the casing connector does not include a hanger profile defined on an inside surface of the casing connector.

23. The method of claim 19, further comprising replacing the removable connection point for the flow line with a different removable connection point.

24. The method of claim 19, further comprising replacing the bowl tubular with a different bowl tubular.

25. The method of claim 19, further comprising securing a flow line with the casing connector.

26. The method of claim 19, further comprising replacing the bowl tubular with a seal plug.

27. The method of claim 19, further comprising replacing the casing connector.

28. The method of claim 19, further comprising establishing fluid communication between the well and a first coiled tubing string.

29. The method of claim 28, wherein establishing fluid communication between the well and the first coiled tubing string comprises running the first coiled tubing string through a port in the bowl tubular.

30. The method of claim 19, further comprising connecting an adaptor tubular with the bowl tubular and with the casing connector.

31. The method of claim 19, wherein the flow path has a uniform inside diameter through the casing connector.

* * * * *